US008114562B2

(12) United States Patent
Ishigami et al.

(10) Patent No.: US 8,114,562 B2
(45) Date of Patent: Feb. 14, 2012

(54) TWO-COMPONENT DEVELOPER, REPLENISHING DEVELOPER, AND IMAGE-FORMING METHOD

(75) Inventors: Koh Ishigami, Mishima (JP); Kazuo Terauchi, Numazu (JP); Noriyoshi Umeda, Susono (JP); Tetsuya Ida, Mishima (JP); Naoki Okamoto, Mishima (JP); Yojiro Hotta, Mishima (JP); Yoshinobu Baba, Yokohama (JP); Takayuki Itakura, Mishima (JP); Takeshi Yamamoto, Yokohama (JP); Manami Haraguchi, Yokohama (JP); Kenta Kubo, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 136 days.

(21) Appl. No.: 12/716,714

(22) Filed: Mar. 3, 2010

(65) Prior Publication Data

US 2010/0203438 A1 Aug. 12, 2010

Related U.S. Application Data

(60) Division of application No. 12/182,031, filed on Jul. 29, 2008, now Pat. No. 7,767,370, which is a continuation of application No. PCT/JP2008/051648, filed on Feb. 1, 2008.

(30) Foreign Application Priority Data

Feb. 2, 2007 (JP) ..... 2007-024381

(51) Int. Cl.
*G03G 9/08* (2006.01)

(52) U.S. Cl. ..... 430/111.4; 430/111.41; 430/111.35; 430/108.1; 430/108.6; 430/123.56; 430/123.57; 430/123.58

(58) Field of Classification Search ..... 430/111.4, 430/111.41, 111.35, 108.1, 123.56, 123.57, 430/123.58, 108.6
See application file for complete search history.

(56) References Cited

U.S. PATENT DOCUMENTS

| | | | | |
|---|---|---|---|---|
| 5,342,876 | A | 8/1994 | Abe et al. | 524/493 |
| 6,013,402 | A | 1/2000 | Kanbayashi et al. | 430/45 |
| 6,403,271 | B1 | 6/2002 | Suzuki et al. | 430/108.6 |
| 6,905,808 | B2 | 6/2005 | Itakura et al. | 430/124 |
| 6,936,394 | B2 | 8/2005 | Okado et al. | 430/111.33 |
| 7,016,630 | B2 | 3/2006 | Yoshizaki et al. | |
| 7,229,727 | B2 | 6/2007 | Itakura et al. | 430/45 |
| 7,241,546 | B2 | 7/2007 | Moriki et al. | |
| 7,292,797 | B2 | 11/2007 | Kunugi et al. | 399/49 |
| 7,320,850 | B2 | 1/2008 | Itakura et al. | 430/108.3 |
| 7,344,816 | B2 | 3/2008 | Matsumura et al. | 430/124.31 |
| 7,361,441 | B2 | 4/2008 | Itakura et al. | 430/107.1 |
| 7,542,707 | B2 | 6/2009 | Omata | |
| 2002/0037466 | A1 | 3/2002 | Kambayashi et al. | 430/108.23 |
| 2005/0014079 | A1 | 1/2005 | Itakura et al. | 430/45 |
| 2005/0106488 | A1 | 5/2005 | Ida et al. | 430/108.23 |
| 2006/0154164 | A1 | 7/2006 | Kidokoro | 430/108.23 |
| 2006/0172209 | A1 | 8/2006 | Kidokoro | |
| 2007/0184372 | A1 | 8/2007 | Itakura et al. | 430/45.4 |
| 2007/0224531 | A1 | 9/2007 | Ida et al. | 430/102 |
| 2008/0299475 | A1 | 12/2008 | Kidokoro | |

FOREIGN PATENT DOCUMENTS

| | | | |
|---|---|---|---|
| JP | 08-137135 | | 5/1996 |
| JP | 9-160293 | A | 6/1997 |
| JP | 10-312088 | A | 11/1998 |
| JP | 11-338190 | | 12/1999 |
| JP | 2001-109194 | | 4/2001 |
| JP | 2001-142257 | | 5/2001 |
| JP | 2001-154411 | | 6/2001 |
| JP | 2003-262980 | A | 9/2003 |
| JP | 2004-117653 | | 4/2004 |
| JP | 2004-117654 | | 4/2004 |
| JP | 2004-117655 | | 4/2004 |
| JP | 2004-354987 | A | 12/2004 |
| JP | 2005-15251 | A | 1/2005 |
| JP | 2005-62857 | A | 3/2005 |
| JP | 2005-141081 | A | 6/2005 |
| JP | 2005-195674 | | 7/2005 |
| JP | 2005-249972 | | 9/2005 |
| JP | 2005-316058 | | 11/2005 |
| JP | 2006-78981 | A | 3/2006 |
| JP | 2006-91373 | A | 4/2006 |
| JP | 2006-195079 | | 7/2006 |
| JP | 2006-209034 | A | 8/2006 |
| JP | 2007-11293 | A | 1/2007 |
| JP | 2008-083565 | | 4/2008 |
| KR | 10-2005-0009177 | A | 1/2005 |
| WO | 2006/014007 | A1 | 2/2006 |

OTHER PUBLICATIONS

Translation of IPRP for PCT/JP2008/051648, dated Aug. 13, 2009, 8 pages.

Japanese Office Action issued in the counterpart application No. 2008-556194 dated Mar. 2, 2010, along with partial English language translation—12 pages.

Japanese Office Action issued in the counterpart application No. 2010-025710 dated Mar. 16, 2010, along with partial English language translation—12 pages.

*Primary Examiner* — Christopher Rodee
(74) *Attorney, Agent, or Firm* — Fitzpatrick, Cella, Harper & Scinto

(57) ABSTRACT

A two-component developer containing a yellow toner and a magnetic carrier, wherein the yellow toner has the characteristics: (i) when the concentration of the yellow toner in a solution of the yellow toner in chloroform is represented by Cy (mg/ml) and the absorbance of the solution at a wavelength of 422 nm is represented by A422, a relationship between Cy and A422 satisfies the relationship of $6.00<A422/Cy<14.40$; (ii) the lightness L* and chroma C* of the yellow toner determined in a powder state satisfy the relationships of $85.0 \leqq L^* \leqq 95.0$ and $100.0 \leqq C^* \leqq 115.0$; and (iii) the absolute value for the triboelectric charge quantity of the yellow toner measured by a two-component method using the yellow toner and the magnetic carrier is 50 mC/kg or more and 120 mC/kg or less.

10 Claims, 17 Drawing Sheets

TWO-COMPONENT DEVELOPER, REPLENISHING DEVELOPER, AND IMAGE-FORMING METHOD

This application is a division of application Ser. No. 12/182,031, filed Jul. 29, 2008, now U.S. Pat. No. 7,767,370, which is a continuation of International Application No. PCT/JP2008/051648, filed Feb. 1, 2008.

BACKGROUND OF THE INVENTION

1. Field of the Invention

The present invention relates to a two-component developer, a replenishing developer, and an image-forming method each of which is used in an electrophotographic system, an electrostatic recording system, or an electrostatic printing system.

2. Description of the Related Art

A print-on-demand (POD) technology has been attracting attention in recent years. The digital printing technology involves directly printing an image without through a plate making step. As a result, the technology can respond to small-lot printing and a demand within a short delivery time, and can respond also to printing in which contents vary from sheet to sheet (variable printing) and dispersion printing in which multiple output devices are activated on the basis of one piece of data by utilizing a communication facility. Accordingly, the technology has advantage over the conventional offset printing. When one attempts to apply an image-forming method based on an electrophotographic system to a POD market, tinge stability as well as the three basic elements of printing, that is, a high speed, high image quality, and a low running cost must be improved. In view of the foregoing, essential performance requested of toner is as follows: the toner achieves an image with quality and definition each of which is comparable to or higher than the conventional one without narrowing a color reproduction range, and a toner consumption is reduced. Further, the toner must respond to a reduction in fixation energy and various kinds of recording paper.

The following proposal has been made (Patent Document 1): a toner laid-on level is set to 0.35 mg/cm$^2$ or less, and a deficiency (blister or the like) occurring at the time of fixation is suppressed while a toner consumption is reduced, whereby a high-quality, good-appearance color image stably having a wide color reproduction range is formed. According to the proposal, a high-quality, good-appearance color image which rages to a small extent, is excellent in fixing performance, and stably has a wide color reproduction range can be formed. The use of toner having a toner particle in which the amount of a colorant is increased in a conventional electrophotographic system is expected to have a certain improving effect on fixing property, but may reduce the chroma, or narrow the color gamut, of an image. A possible cause for the foregoing is as follows: as a result of an increase in amount of the colorant, the dispersibility of the colorant reduces, and the hue of the toner changes, with the result that the chroma of the image reduces, and the color gamut of the image narrows.

As described above, an increase in amount of a colorant in a toner particle is apt to reduce the density stability and gradation of an image at the time of the long-term use of toner. Conventional toner corresponds to the curve A of FIG. 1 where the axis of abscissa indicates a potential (development contrast) and the axis of ordinate indicates a density (it should be noted that the characteristic represented by the curve is referred to as "γ characteristic"). An increase in content of the colorant as compared to that of the conventional toner allows a predetermined density to be represented on recording paper with a reduced toner laid-on level, whereby gradation is represented with an additionally narrow development contrast potential (Patent Document 1). In this case, the resultant γ characteristic is represented by the curve B of FIG. 1: the γ characteristic becomes sharp, and it may be difficult to obtain high gradation. In addition, owing to the sharp γ characteristic, a change in image density due to a fluctuation in potential is large as compared to that of the conventional toner, so the stability of the image density may reduce.

The ability to obtain wide gradation and tinge stability have been essential conditions in the POD market, so development must be performed so that the γ characteristic shows a gradual slope even when a toner laid-on level is small. An increase in triboelectric charge quantity of toner with an increased colorant content is one useful approach to forming gradation by using the toner with the same development contrast potential as a conventional one. Patent Document 1 does not refer to the triboelectric charge quantity of toner, and shows no sign of actively controlling the triboelectric charge quantity.

However, an increase in triboelectric charge quantity of toner increases the electrostatic adhesive force of the toner with respect to the surface of a carrier or photosensitive member, with the result that developing performance and transferring performance reduce, and an image density reduces in some cases. There has been a proposal specifying a relationship between a toner charge quantity and an adhesive force between toner and a carrier (Patent Document 2). According to Patent Document 2, setting each of the toner charge quantity and the adhesive force within a predetermined range allows the formation of a high-quality image with no image failure. However, in the documents it is not assumed that region of a triboelectric charge quantity requested of toner with so large a colorant content that a toner consumption can be reduced, so the adhesive force between the carrier and the toner is still strong, and a sufficient image density cannot be obtained in some cases.

Accordingly, in order that an image may be formed with a smaller toner laid-on level than a conventional one, the image must be efficiently developed with toner which has a large colorant content, contains a colorant having high dispersibility, shows high coloring power, and has a high triboelectric charge quantity. Toner having the following characteristics and a developer containing the toner have been desired: the toner contains a colorant having good dispersibility, and has a high triboelectric charge quantity, a high-resolution, high-definition image can be efficiently developed with the toner, and each of the toner and the developer can stably express good image quality even when continuously used without impairing the color gamut, chroma, and lightness of the image.

Patent Document 1: JP 2005-195674 A

Patent Document 2: JP 2006-195079 A

SUMMARY OF THE INVENTION

The present invention has solved the above problems of the related art.

That is, an object of the present invention is to provide a two-component developer, a replenishing developer, and an image-forming method each of which allows a high-definition image to be obtained with a smaller toner laid-on level than a conventional one.

Another object of the present invention is to provide a two-component developer and a replenishing developer each of which can respond to an increase in printing speed, and allows an image with a stable tinge to be continuously output even in long-term use, and an image-forming method involving the use of any such developer.

The present invention relates to a two-component developer including a cyan toner having cyan toner particles each having at least a binder resin and a colorant, and an external additive, and a magnetic carrier, in which the cyan toner has the following characteristics:

(i) when a concentration of the cyan toner in a solution of the cyan toner in chloroform is represented by Cc (mg/ml) and an absorbance of the solution at a wavelength of 712 nm is represented by A712, a relationship between Cc and A712 satisfies the following expression (1)

$$2.00<A712/Cc<8.15 \quad (1);$$

(ii) a lightness L* and a chroma C* of the cyan toner determined in a powder state satisfy relationships of $25.0 \leqq L^* \leqq 40.0$ and $50.0 \leqq C^* \leqq 60.0$; and (iii) an absolute value for a triboelectric charge quantity of the cyan toner measured by a two-component method using the cyan toner and the magnetic carrier is 50 mC/kg or more and 120 mC/kg or less.

Further, the present invention relates to a two-component developer including a magenta toner having magenta toner particles each having at least a binder resin and a colorant, and an external additive, and a magnetic carrier, in which the magenta toner has the following characteristics:

(i) when a concentration of the magenta toner in a solution of the magenta toner in chloroform is represented by Cm (mg/ml) and an absorbance of the solution at a wavelength of 538 nm is represented by A538, a relationship between Cm and A538 satisfies the following expression (3)

$$2.00<A538/Cm<6.55 \quad (3);$$

(ii) a lightness L* and a chroma C* of the magenta toner determined in a powder state satisfy relationships of $35.0 \leqq L^* \leqq 45.0$ and $60.0 \leqq C^* \leqq 72.0$; and (iii) an absolute value for a triboelectric charge quantity of the magenta toner measured by a two-component method using the magenta toner and the magnetic carrier is 50 mC/kg or more and 120 mC/kg or less.

In addition, the present invention relates to a two-component developer including a yellow toner having yellow toner particles each having at least a binder resin and a colorant, and an external additive, and a magnetic carrier, in which the yellow toner has the following characteristics:

(i) when a concentration of the yellow toner in a solution of the yellow toner in chloroform is represented by Cy (mg/ml) and an absorbance of the solution at a wavelength of 422 nm is represented by A422, a relationship between Cy and A422 satisfies the following expression (5)

$$6.00<A422/Cy<14.40 \quad (5);$$

(ii) a lightness L* and a chroma C* of the yellow toner determined in a powder state satisfy relationships of $85.0 \leqq L^* \leqq 95.0$ and $100.0 \leqq C^* \leqq 115.0$; and (iii) an absolute value for a triboelectric charge quantity of the yellow toner measured by a two-component method using the yellow toner and the magnetic carrier is 50 mC/kg or more and 120 mC/kg or less.

In addition, the present invention relates to an image-forming method involving the use of the above two-component developer.

According to the present invention, there can be provided a two-component developer and a replenishing developer each having the following characteristics, and an image-forming method involving the use of any such developer: toner having a large colorant content and showing strong coloring power is used, a high-resolution, high-definition image is achieved while a toner consumption is reduced, and the toner can stably express good image quality even when continuously used without impairing the color gamut, chroma, and lightness of the image.

Further feature of the present invention will become apparent from the following description of exemplary embodiments (with reference to the attached drawings).

DESCRIPTION OF REFERENCE NUMERALS

Figure 1:
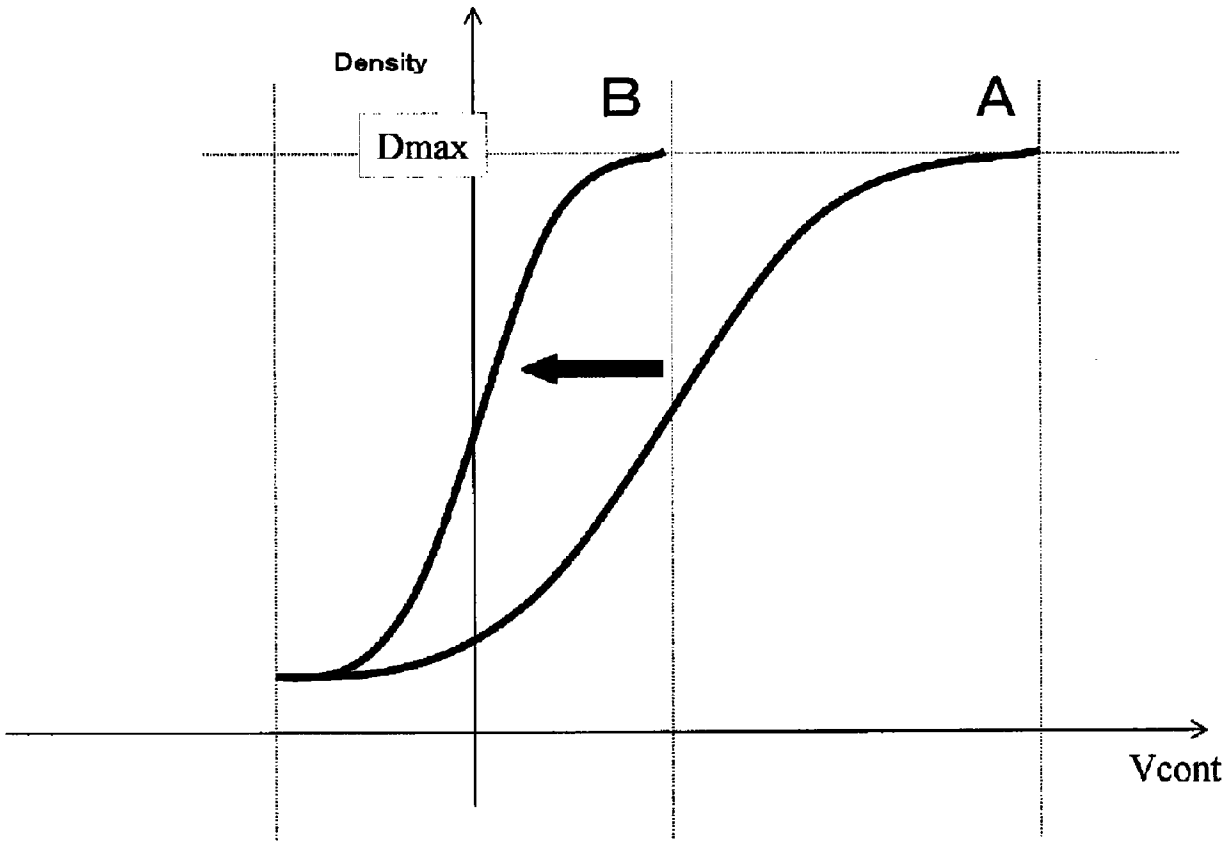
FIG. 1 is a view showing the characteristic of toner.

11 lower electrode
12 upper electrode
13 insulator
14 ampere meter
15 volt meter
16 voltage stabilizer
17 magnetic carrier
18 guide ring
61*a* photosensitive member
62*a* charging roller
63*a* developing device
64*a* transferring blade
65*a* replenishing developer container
67*a* exposure light

68 transfer material bearing member
69 detach charging device
70 fixing apparatus
71 fixing roller
72 pressure roller
75 heating means
76 heating means
79 cleaning member
80 driver roller
81 belt driven roller
82 belt static eliminator
83 resist roller
85 toner concentration detecting sensor
101 replenishing developer storing container
102 developing device
103 cleaning unit
104 developer collecting container
105 replenishing developer introduction port
106 discharge port
Pa image-forming unit
Pb image-forming unit
Pc image-forming unit
Pd image-forming unit
E resistance measurement cell
L sample width

DESCRIPTION OF THE EMBODIMENTS

Hereinafter, the Best Mode for carrying out the present invention will be described in detail.

The inventors of the present invention have made extensive studies. As a result, the inventors have found that, when (1) a relationship between the concentration C (mg/ml) of a solution of toner in chloroform and the absorbance A of the solution at a predetermined wavelength, (2) the lightness L* and chroma C* of the toner determined in a powder state, and (3) the absolute value for the triboelectric charge quantity of the toner are each adjusted to fall within a predetermined numerical range, the toner can achieve a high-resolution, high-definition image, and can stably provide an image with good image quality when continuously used without impairing the color gamut, chroma, and lightness of the image. Thus, the inventors have reached the present invention.

In addition, the present invention aims to achieve the above object by developing an image with toner having a large colorant content and showing strong coloring power as toner having a high charge quantity while suppressing a change in hue as one detrimental effect when the colorant content is increased.

In the case of a two-component developer containing a cyan toner, a cyan toner having the following characteristic is used: when the concentration of the cyan toner in a solution of the cyan toner in chloroform is represented by Cc (mg/ml) and the absorbance of the solution at a wavelength of 712 nm is represented by A712, a value determined by dividing A712 by Cc (A712/Cc) is larger than 2.00 and smaller than 8.15. The above value (A712/Cc) is more preferably larger than 2.40 and smaller than 4.90 in order that needed coloring power may be obtained. When the above value (A712/Cc) is 2.00 or less, the degree of coloring of the toner per unit mass reduces, so a toner laid-on level on recording paper must be increased and the thickness of a toner layer on the paper must be increased in order that a needed degree of coloring may be obtained. As a result, a toner consumption cannot be reduced, with the result that dust may be generated at the time of transfer or fixation, or a "transfer void" phenomenon in which the central portion of a line in a line image or letter image on an image is not transferred, and only an edge portion of the line is transferred may occur.

On the other hand, when the above value (A712/Cc) is 8.15 or more, sufficient coloring power can be obtained, but the lightness of the toner reduces, so the resultant image is apt to be dark and to have reduced sharpness. In addition, the amount of a colorant exposed to the surface of the toner tends to increase, so the charging performance of the toner may deteriorate, triboelectric charge quantity of toner may decrease, fogging may occur in an image blank portion, or the inside of an developing assembly may be contaminated owing to toner scattering.

In the case of a two-component developer containing a magenta toner, a magenta toner having the following characteristic is used: when the concentration of the magenta toner in a solution of the magenta toner in chloroform is represented by Cm (mg/ml) and the absorbance of the solution at a wavelength of 538 nm is represented by A538, a value determined by dividing A538 by Cm (A538/Cm) is larger than 2.00 and smaller than 6.55. The above value (A538/Cm) is more preferably larger than 2.40 and smaller than 4.90 in order that needed coloring power may be obtained. When the above value (A538/Cm) is 2.00 or less, the degree of coloring of the toner per unit mass reduces, so a toner laid-on level on recording paper must be increased and the thickness of a toner layer on the paper must be increased in order that a needed degree of coloring may be obtained. As a result, a toner consumption cannot be reduced, with the result that dust may be generated at the time of transfer or fixation, or a "transfer void" phenomenon in which the central portion of a line in a line image or letter image on an image is not transferred, and only an edge portion of the line is transferred may occur.

On the other hand, when the above value (A538/Cm) is 6.55 or more, sufficient coloring power can be obtained, but the lightness of the toner reduces, so the resultant image is apt to be dark and to have reduced sharpness. In addition, the amount of a colorant exposed to the surface of the toner tends to increase, so the charging performance of the toner may deteriorate, and triboelectric charge quantity of toner may decrease, fogging may occur in an image blank portion, or the inside of an developing assembly may be contaminated owing to toner scattering.

Further, in the case of a two-component developer containing a yellow toner, a yellow toner having the following characteristic is used: when the concentration of the yellow toner in a solution of the yellow toner in chloroform is represented by Cy (mg/ml) and the absorbance of the solution at a wavelength of 422 nm is represented by A422, a value determined by dividing A422 by Cy (A422/Cy) is larger than 6.00 and smaller than 14.40. The above value (A422/Cy) is more preferably larger than 7.00 and smaller than 12.00 in order that needed coloring power may be obtained. When the above value (A422/Cy) is 6.00 or less, the degree of coloring of the toner per unit mass reduces, so a toner laid-on level on recording paper must be increased and the thickness of a toner layer on the paper must be increased in order that a needed degree of coloring may be obtained. As a result, a toner consumption cannot be reduced, with the result that dust may be generated at the time of transfer or fixation, or a "transfer void" phenomenon in which the central portion of a line in a line image or letter image on an image is not transferred, and only an edge portion of the line is transferred may occur.

On the other hand, when the above value (A422/Cy) is 14.40 or more, sufficient coloring power can be obtained, but the lightness of the toner reduces, so the resultant image is apt to be dark and to have reduced sharpness. In addition, the amount of a colorant exposed to the surface of the toner tends to increase, so the charging performance of the toner may deteriorate, and triboelectric charge quantity of toner may decrease, fogging may occur in an image blank portion, or the inside of an developing assembly may be contaminated owing to toner scattering.

Each of the above values (A712/Cc), (A538/Cm), and (A422/Cy) can be controlled by adjusting the kind and amount of a colorant to be incorporated into toner, and one skilled in the art can adjust these values.

In the case of the two-component developer containing a cyan toner, the lightness L* and chroma C* of the cyan toner determined in a powder state satisfy the following relationships: the L* is 25.0 or more and 40.0 or less, or preferably 28.0 or more and 40.0 or less, and the C* is 50.0 or more and 60.0 or less. When each of the lightness L* and chroma C* of the cyan toner determined in a powder state falls within the above range, the representable color space of an image is sufficiently wide, the quality of the image becomes good, and a toner amount on recording paper can be reduced.

When the L* of the cyan toner is less than 25.0, a representable color space may be small when a full-color image is formed by combining the toner with a toner having any other color. On the other hand, when the L* of the cyan toner exceeds 40.0, a desired image density is hardly obtained. An increase in toner amount on recording paper for obtaining a needed image density makes the generation of dust at the time of transfer or fixation, or the occurrence of a transfer void. In addition, in association with the increase in toner amount, the step height of the toner enlarges, and image quality reduces in some cases.

When the C* of the cyan toner is less than 50.0, a desired image density is hardly obtained. On the other hand, when the C* of the cyan toner exceeds 60.0, a color balance is apt to be lost when a full-color image is formed. The hue of toner with an increased colorant content changes, and the L* and C* of the toner change in many cases. This is probably because an increase in colorant content causes the reagglomeration of a pigment to reduce the coloring power of the toner, thereby causing the change in hue. Therefore, the use of toner showing high coloring power can reduce a toner laid-on level, and can reduce a toner consumption.

In the case of the two-component developer containing a magenta toner, with regard to the lightness L* and chroma C* of the magenta toner determined in a powder state, the L* is 35.0 or more and 45.0 or less. When the L* of the magenta toner falls within the above range, the representable color space of an image becomes sufficiently wide, and the quality of the image is improved. When the L* of the magenta toner is less than 35.0, a representable color space may be small when a full-color image is formed by combining the toner with a toner having any other color. On the other hand, when the L* of the magenta toner exceeds 45.0, a desired image density is hardly obtained. An increase in toner amount on recording paper for obtaining a needed image density makes the generation of dust at the time of transfer or fixation, or the occurrence of a transfer void. In addition, in association with the increase in toner amount, the step height of the toner enlarges, and image quality reduces in some cases.

In addition, the chroma C* of the magenta toner is 60.0 or more and 72.0 or less, or preferably 62.0 or more and 72.0 or less. When the C* of the magenta toner falls within the above range, the representable color space of an image is sufficiently wide, and a toner amount on recording paper can be reduced. When the C* of the magenta toner is less than 60.0, a desired image density is hardly obtained. On the other hand, when the C* of the magenta toner exceeds 72.0, a color balance is apt to be lost when a full-color image is formed.

In the case of the two-component developer containing a yellow toner, with regard to the lightness L* and chroma C* of the yellow toner determined in a powder state, the L* is 85.0 or more and 95.0 or less, or preferably 87.0 or more and 95.0 or less. When the L* of the yellow toner falls within the above range, the representable color space of an image becomes sufficiently wide, and the quality of the image is improved. When the L* of the yellow toner is less than 85.0, a representable color space may be small when a full-color image is formed by combining the toner with a toner having any other color. On the other hand, when the L* of the yellow toner exceeds 95.0, a desired image density is hardly obtained. An increase in toner amount on recording paper for obtaining a needed image density makes the generation of dust at the time of transfer or fixation, or the occurrence of a transfer void. In addition, in association with the increase in toner amount, the step height of the toner enlarges, and image quality reduces in some cases.

In addition, the chroma C* of the yellow toner is 100.0 or more and 115.0 or less. When the C* of the yellow toner falls within the above range, the representable color space of an image is sufficiently wide, and a toner amount on recording paper can be reduced. When the C* of the yellow toner is less than 100.0, a desired image density is hardly obtained. On the other hand, when the C* of the yellow toner exceeds 115.0, a color balance is apt to be lost when a full-color image is formed.

Each of the lightness L* and chroma C* of any one of the above toners determined in a powder state can be appropriately adjusted to fall within the above range by controlling the kind and amount of a colorant to be incorporated into the toner, and the dispersed state of the colorant. In addition, those numerical values can be adjusted depending on the kind of the binder resin, a production method for the binder resin, and the conditions under which the binder resin is produced.

However, an image developed with toner showing high coloring power in a conventional system may be deficient in tinge stability when the toner is used over a long time period. Accordingly, the use of toner having a high triboelectric charge quantity is of importance.

Each of the cyan, magenta, and yellow toners each used in the two-component developer of the present invention (each of which may hereinafter be simply referred to as "toner of the present invention" or "toner") is characterized in that the absolute value for the triboelectric charge quantity of the toner measured by a two-component method using the toner and a magnetic carrier is 50 mC/kg or more and 120 mC/kg or less. In the case of a developer using a toner the above absolute value for the triboelectric charge quantity of which is less than 50 mC/kg, when a toner showing strong coloring power to be used in the present invention is used, a γ characteristic becomes sharp, a fluctuation in density becomes large owing to the long-term use of the developer, and the density is deficient in stability in some cases. On the other hand, when the above absolute value for the triboelectric charge quantity of the toner exceeds 120 mC/kg, an image density or transfer efficiency may reduce. This is probably because an electrostatic adhesive force between the magnetic carrier and the surface of a photosensitive member becomes large.

A method of adjusting the above absolute value for the triboelectric charge quantity of each of the above toners within the above range is, for example, a method involving controlling the kind of an external additive, the kind and particle diameter of a surface treatment agent, and the percentage by which a toner particle is coated with the external additive, a method involving optimizing the kind of a coat resin for the magnetic carrier or the amount in which the carrier is coated with the resin, or a method involving adding a particle or a charge control agent into a coat resin.

The reason why such toner having a high triboelectric charge quantity as described above is needed is as described below.

For example, suppose a developer in which the triboelectric charge quantity of conventional toner is −40 mC/kg, and a toner laid-on level on a photosensitive member at Vcont=500 V is 0.5 mg/cm$^2$ and a system using the developer. In order that a saturation image density may be obtained by using the conventional toner, there is given such γ characteristic as represented by the curve A of FIG. 1 where the axis of abscissa indicates a contrast potential and the axis of ordinate indicates an image density. Development is performed by filling the contrast potential with the charge of the toner. An a point in FIG. 2 is the point at which the saturation density is obtained by the conventional toner.

Figure 2:
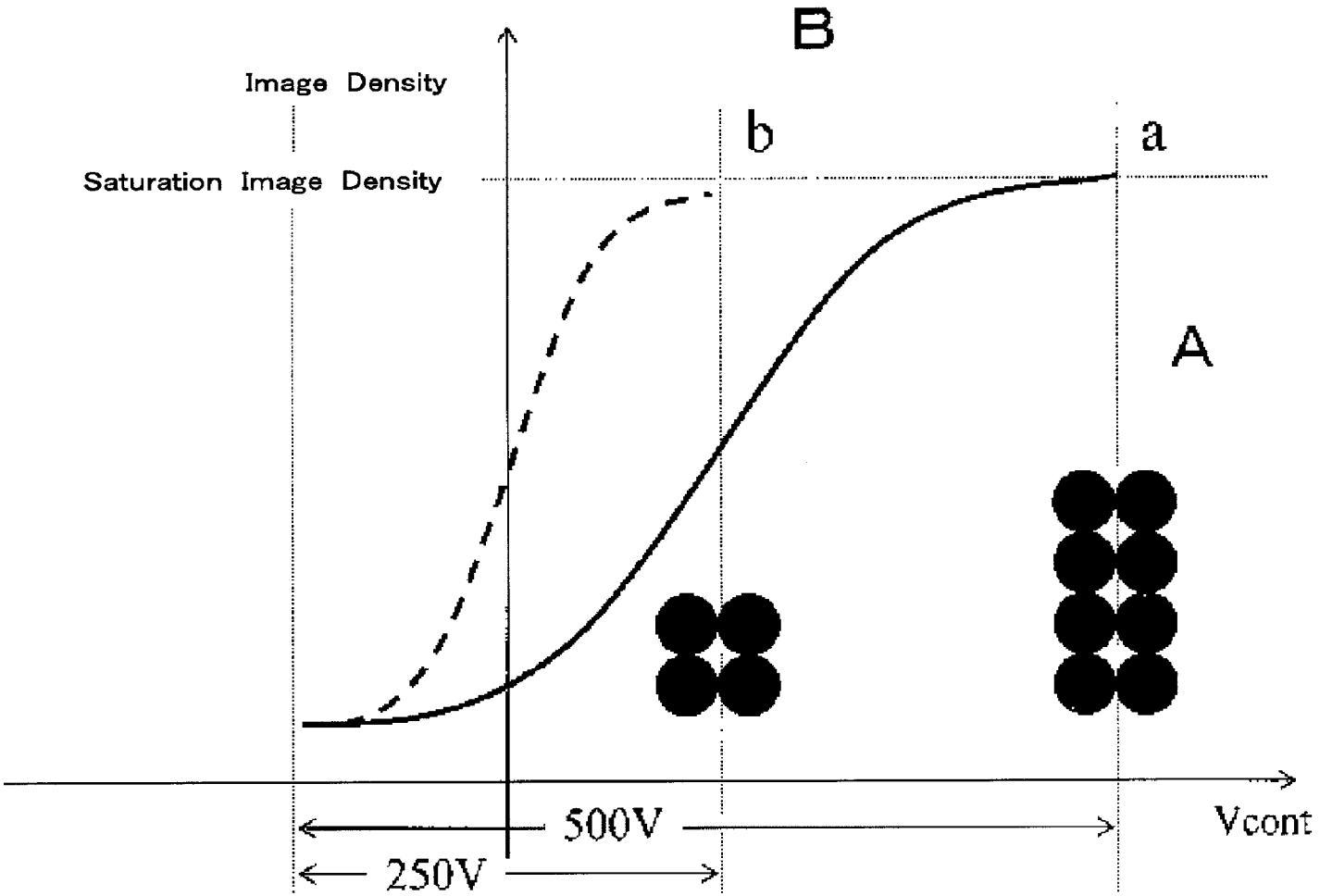
FIG. 2 is a view showing a relationship between a contrast potential and a (saturation) image density in toner.
Figure 3:
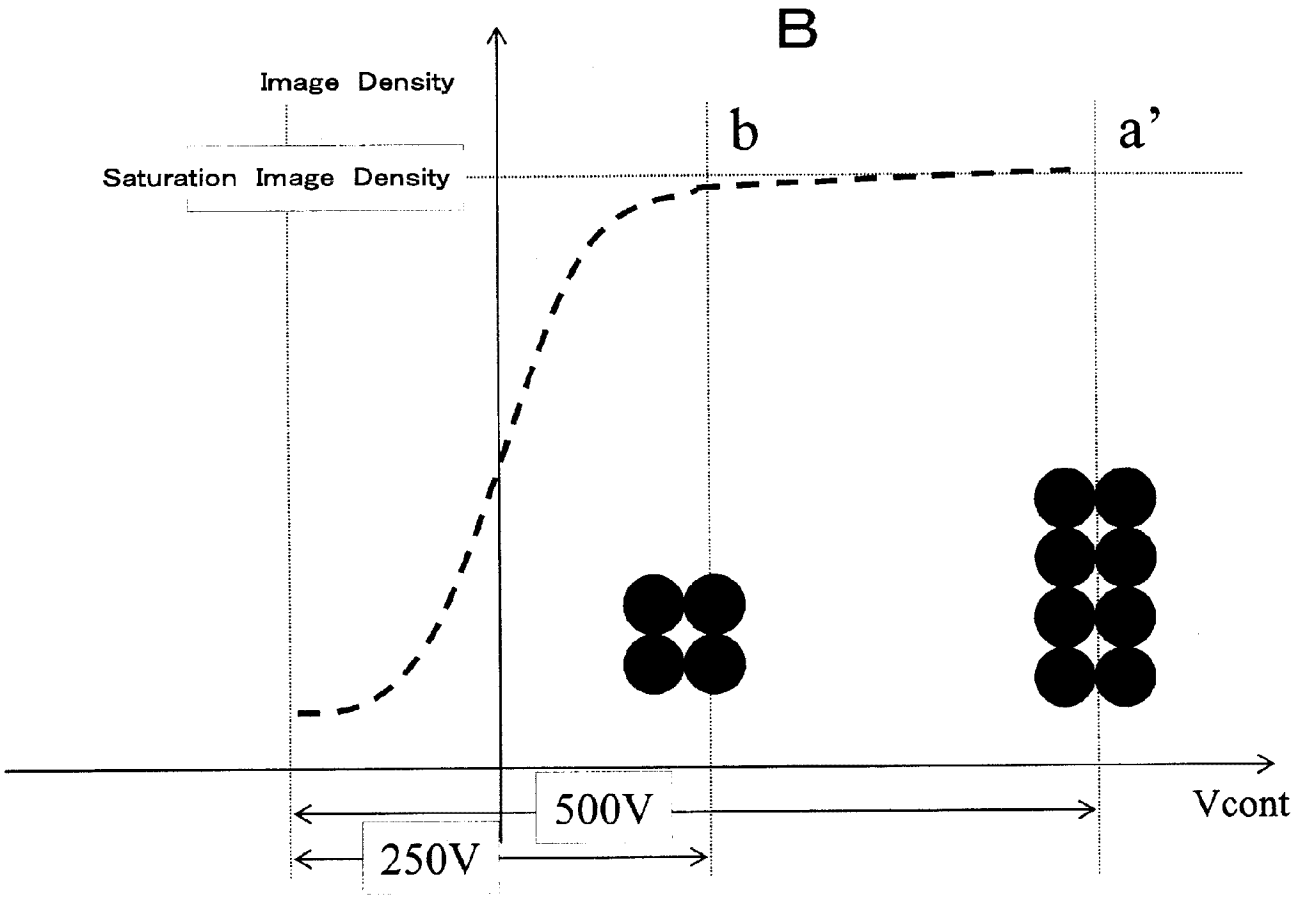
FIG. 3 is a view for explaining the relationship between the contrast potential and the (saturation) image density in the toner.
Figure 4:
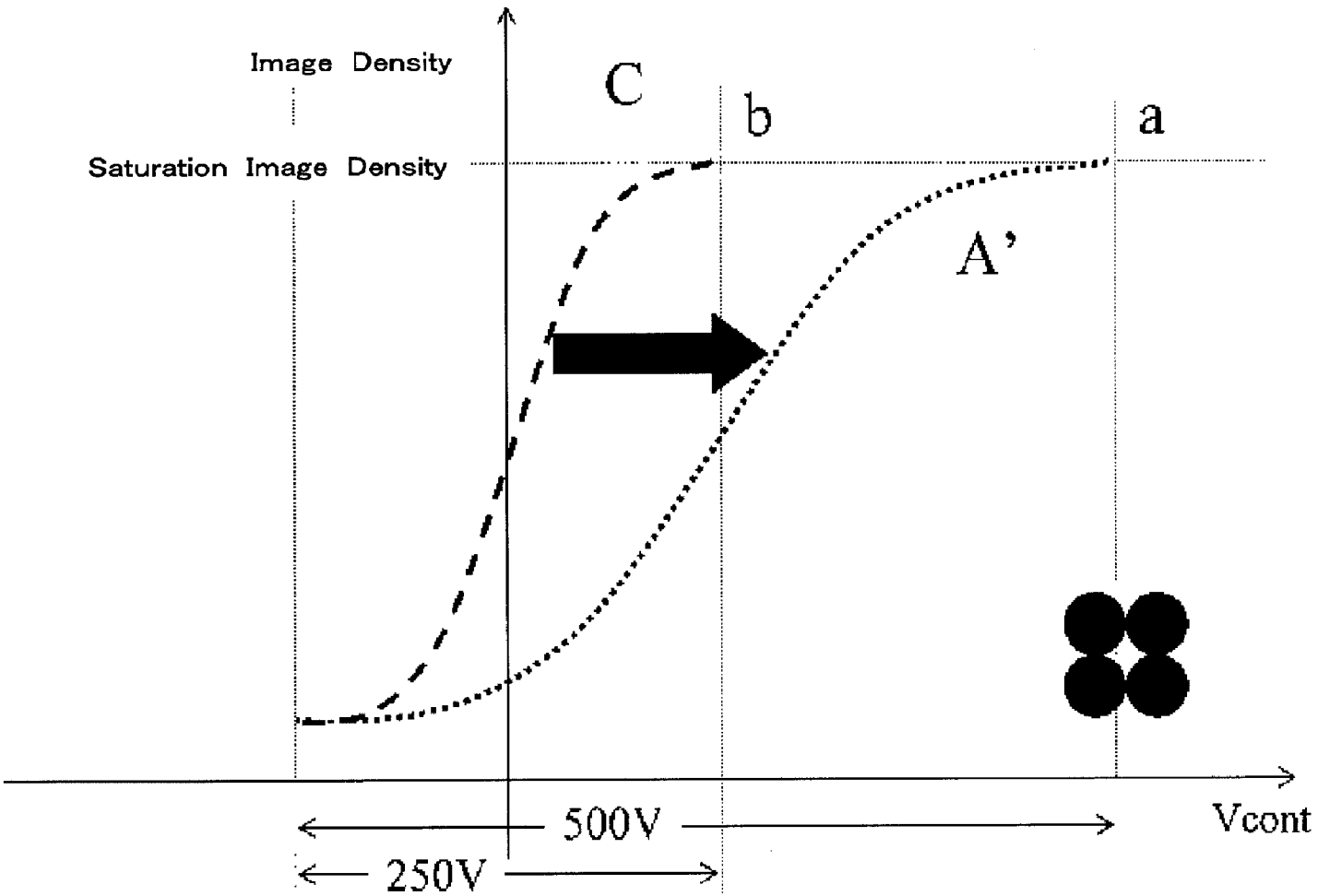
FIG. 4 is a view for explaining a change in γ characteristic of toner.
Figure 5:
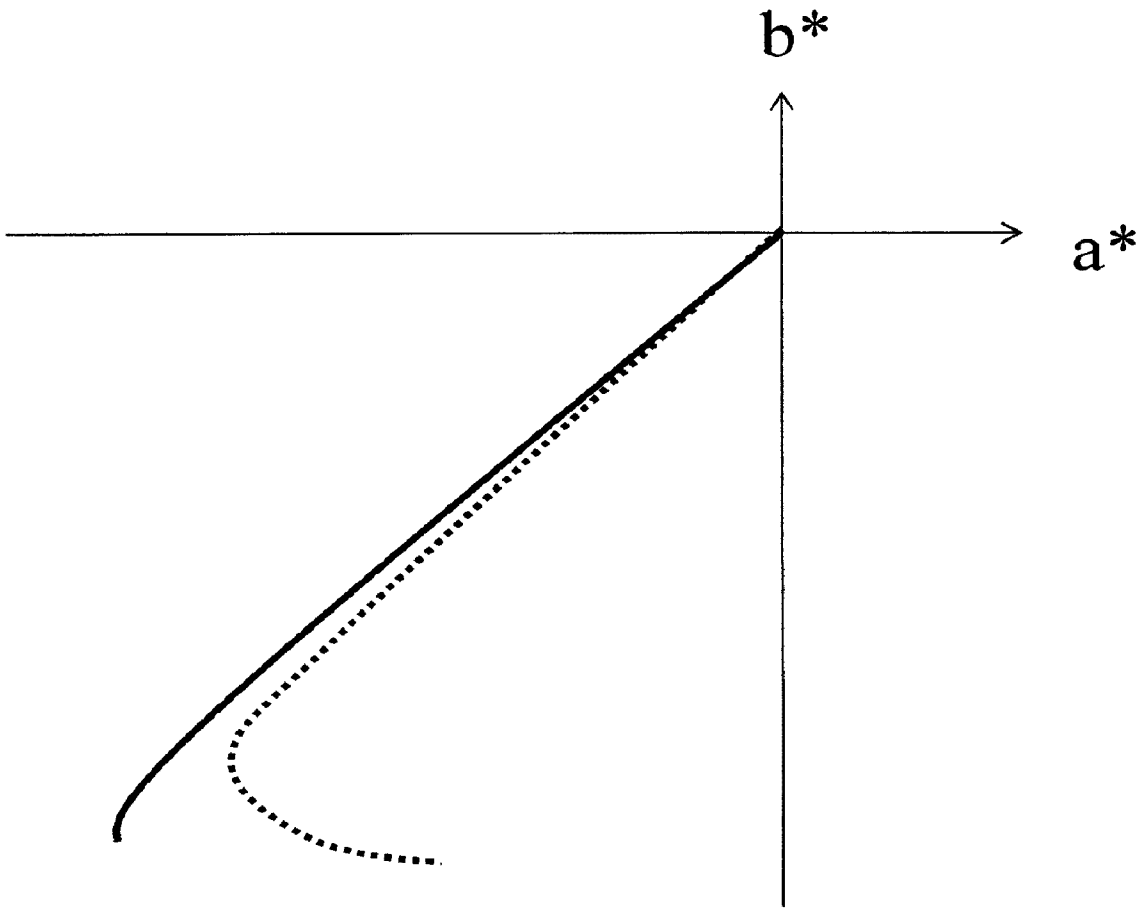
FIG. 5 is a view showing the hue profile of each of a conventional toner and a toner showing high coloring power in the a*b* plane of CIELAB.

On the other hand, when toner showing high coloring power like the toner of the present invention is used, if the coloring power is twice as high as that of the conventional toner, the saturation image density is obtained with a laid-on level of 0.25 mg/cm$^2$ which is one half of that of the conventional toner, so needed toner is used for development at a b point in FIG. 2 with Vcont=250 V. When the Vcont is additionally increased from the b point, the laid-on level increases, but the image density has already been saturated, and the density no longer increases (see FIG. 3). When the Vcont reaches 500 V, the toner laid-on level becomes 0.5 mg/cm$^2$ to reach the a point. At the a point, an excess amount of the toner showing high coloring power is present, with the result that the resultant image is dark and grave, and shows a large change in its hue. FIG. 5 shows the hue profile of each of the conventional toner and the toner showing high coloring power in the a*b* plane of CIELAB. A solid line corresponds to the conventional toner, and a dotted line corresponds to the toner showing high coloring power. The hue profile corresponds to the case where an image is developed with the toner showing high coloring power so that a characteristic curve exceeds a b point in FIG. 3 to reach an a' point in the figure. When the characteristic curve reaches the a' point, the curve of FIG. 5 curves toward the a* axis, whereby the hue of the resultant image changes. A reduction in lightness of the image occurs simultaneously with the change. Accordingly, the saturation image density has only to be output with the lowest toner amount in which the image density is saturated. However, when a system for developing an image with toner showing high coloring power the image density of which is saturated at a laid-on level of 0.25 mg/cm$^2$ and Vcont=250 V is assumed, gradation cannot help being formed with the Vcont one half of a conventional one (=250 V) as represented by the curve B of FIG. 1, with the result that the stability of the image involves the following problem: a fluctuation in density with a fluctuation in potential becomes large. If gradation can be obtained with the Vcont comparable to that of the conventional toner (=500 V) while a laid-on level is reduced in half, in other words, the slope of a γ characteristic can be as gradual as that of the conventional toner like a curve A' (dotted line) obtained by extending the curve C (broken line) of FIG. 4 along the axis of abscissa, a change in hue caused by the presence of an excess amount of toner showing high coloring power can be suppressed, and, at the same time, the stability of the hue against a fluctuation in potential can be improved. To this end, the charge quantity of the toner must be increased so that the contrast potential Vcont comparable to that of the conventional toner (=500 V) may be filled with the toner amount one half of that of the conventional toner. In order that the saturation image density may be obtained by using the toner with improved coloring power of the present invention at a laid-on level of 0.25 mg/cm$^2$ and a contrast potential Vcont of 500 V, gradation can be formed in accordance with a γ characteristic comparable to that of the conventional toner as long as an image is developed with toner the saturation triboelectric charge quantity of which is twice as high as that of the conventional toner, that is, −80 mC/kg. As described above, in order that high gradation may be maintained and a fluctuation in density may be suppressed while the laid-on level of toner with improved coloring power is reduced, an image must be efficiently developed with the toner as toner having a high triboelectric charge quantity.

In addition, an adhesive force (F50) between each of the toners and a magnetic carrier by a centrifugal separation method when the absolute value for the triboelectric charge quantity of the toner measured by the two-component method using the toner and the magnetic carrier is 50 mC/kg is preferably 11 nN or more and 16 nN or less.

When the adhesive force falls within the above range, the releasing performance of the toner with respect to the carrier becomes suitable, the occurrence of toner scattering can be favorably suppressed, and high development efficiency or high transfer efficiency can be obtained.

A method of adjusting the above adhesive force (F50) within the above range is, for example, a method involving adjusting the circularity of a toner particle of the toner, or a method involving controlling the kind of an external additive, the kind and particle diameter of a surface treatment agent, and the percentage by which a toner particle of the toner is coated with the external additive. It should be noted that a method of adjusting the adhesive force by controlling a parameter related to the carrier will be described later.

In addition, the magnetic carrier to be used in the two-component developer of the present invention (which may hereinafter be simply referred to as "magnetic carrier of the present invention" or "magnetic carrier") is not particularly limited as long as the triboelectric charge quantity of toner measured when the magnetic carrier is mixed with the toner falls within a predetermined range, and a magnetic carrier containing at least a magnetic component and a resin component can be preferably used. From the viewpoint of a reduction in adhesive force with respect to the toner, a magnetic carrier containing resin-containing magnetic particles obtained by incorporating a resin into the pores of porous magnetic core particles, the magnetic carrier having the following characteristics, is preferably used: when the packed bulk density and true density of the porous magnetic core particles are represented by ρ1 (g/cm$^3$) and ρ2 (g/cm$^3$), respectively, ρ1 is 0.80 or more and 2.40 or less and ρ1/ρ2 is 0.20 or more and 0.42 or less, and the specific resistance of each of the porous magnetic core particles is $1.0\times10^3$ Ω·cm or more and $5.0\times10^7$ Ω·cm or less. In addition, the above magnetic carrier particularly preferably has the following characteristic: when the 50% particle diameter on a volume basis of the magnetic carrier is represented by D50, the average breaking strength of the magnetic carrier having a particle diameter of D50−5 μm or more and D50+5 μm or less is represented by P1 (MPa), and the average breaking strength of the magnetic carrier having a particle diameter of 10 μm or more and less than 20 μm is represented by P2 (MPa), P2/P1 is 0.50 or more and 1.10 or less.

When the packed bulk density ρ1 of the porous magnetic core particles is set to be 0.80 g/cm$^3$ or more and 2.40 g/cm$^3$ or less, the prevention of the adhesion of the magnetic carrier to a photosensitive drum and an improvement in dot reproducibility of an electrostatic latent image can be achieved. Setting ρ1 within the above range can improve the dot reproducibility while suppressing the adhesion of the magnetic carrier to the photosensitive drum. The dot reproducibility is preferably improved because the toner of the present invention shows so high coloring power that the collapse of a dot or toner scattering is apt to be remarkable.

In addition, at the same time, when the packed bulk density and true density of the porous magnetic core particles are represented by ρ1 ($g/cm^3$) and ρ2 ($g/cm^3$), respectively, setting ρ1/ρ2 to 0.20 or more and 0.42 or less can prevent a reduction in image density while suppressing the adhesion of the magnetic carrier to the photosensitive drum even when 100,000 images each having a wide image area (for example, an image area ratio of 50%) are printed under a normal-temperature, low-humidity (for example, 23° C./5 RH %) environment.

Further, setting the specific resistance of each of the porous magnetic core particles to $1.0\times10^3$ Ω·cm or more and $5.0\times10^7$ Ω·cm or less can prevent a reduction in density at the back end of a solid image.

The inventors of the present invention consider the reason for the foregoing to be as described below.

When an image is developed with the toner, counter charge opposite in polarity to the toner remains in the magnetic carrier. The charge pulls back the toner used for the development onto the photosensitive drum, thereby reducing the density at the back end portion. However, setting the specific resistance of each of the porous magnetic core particles within the above range can cause the counter charge remaining in the magnetic carrier to escape toward a developing sleeve through the magnetic component of the magnetic carrier while suppressing the leak of the charge. As a result, a force for pulling back the toner toward the photosensitive drum weakens, and a reduction in image density even at the back end of the solid image is suppressed.

Next, a specific approach to adjusting for example, each of the packed bulk density, the true density, and the specific resistance described above within the above range will be described. Each of the packed bulk density, the true density, and the specific resistance described above can be adjusted within the above range by controlling, for example, the kind of the element of the magnetic component in each magnetic core particle, and the crystalline diameters, pore diameters, pore diameter distribution, and pore ratio of the porous magnetic core particles.

For example, each of the following approaches (1) to (4) can be employed:

(1) the growth rate of a crystal of the magnetic component is controlled by adjusting a temperature at the time of the sintering of the magnetic component;

(2) a blowing agent or a pore-forming agent formed of organic fine particles is added to the magnetic component so that a pore is generated;

(3) the pore diameters, the pore diameter distribution, the pore ratio, and the like are adjusted by controlling the kind and amount of a blowing agent, and the time period for which the magnetic component is sintered; or (4) the pore diameters, the pore diameter distribution, and the pore ratio are adjusted by controlling the diameter, diameter distribution, and amount of a pore-forming agent, and the time period for which the magnetic component is sintered.

The above blowing agent is not particularly limited as long as it is a substance which generates a gas in association with its vaporization or decomposition at 60 to 180° C. Examples of the above blowing agent include: blowing, azo polymerization initiators such as azobisisobutyronitrile, azobisdimethylvaleronitrile, and azobiscyclohexanecarbonitrile; hydrogen carbonates of metals such as sodium, potassium, and calcium; ammonium hydrogen carbonate; ammonium carbonate; calcium carbonate; an ammonium nitrate salt; an azide compound; 4,4'-oxybis(benzenesulfohydrazide); allylbis(sulfohydrazide); and diaminobenzene.

Examples of the above organic fine particles include: wax; thermoplastic resins such as polystyrene, an acrylic resin, and a polyester resin; and thermosetting resins such as a phenol resin, a polyester resin, a urea resin, a melamine resin, and a silicone resin. Each of them is turned into fine particles before use. A known method can be employed as a method of turning each of them into fine particles. For example, each of them is pulverized into particles each having a desired particle diameter in a pulverization step. In the pulverization step, for example, the following method is employed: each of them is coarsely pulverized with a grinder such as a crusher, a hammer mill, or a feather mill, and, furthermore, the coarsely pulverized products are finely pulverized with a Kryptron system manufactured by Kawasaki Heavy Industries, a Super rotor manufactured by Nisshin Engineering Inc., a Turbo mill (RSS rotor/SNNB liner) manufactured by Turbo Kogyo Co., Ltd., or an air-jet pulverizer.

Alternatively, the following procedure may be performed: fine particles are classified after pulverization so that the grain size distribution of the particles is adjusted. An apparatus for the classification is, for example, a classifier or a screen classifier such as an Elbow Jet based on an inertial classification system (manufactured by Nittetsu Mining Co., Ltd.) or a Turboplex based on a centrifugal classification system (manufactured by Hosokawa Micron Corporation).

The diameters, diameter distribution, and pore ratio of the pores of the magnetic component can be adjusted depending on the diameters, diameter distribution, and amount of those fine particles to be used.

In addition, a material for the magnetic component is, for example, (1) an iron powder with an oxidized surface or an iron powder with an unoxidized surface, (2) a metal particle formed of, for example, any one of lithium, calcium, magnesium, nickel, copper, zinc, cobalt, manganese, chromium, and a rare earth element, (3) an alloy particle containing a metal such as iron, lithium, calcium, magnesium, nickel, copper, zinc, cobalt, manganese, chromium, or a rare earth element, or an oxide particle containing any one of these elements, or (4) a magnetite particle or a ferrite particle.

The above ferrite particle is a sintered body represented by the following formula:

$$(LO)_w(MO)_x(QO)_y(Fe_2O_3)_z$$

where w+x+y+z=100 mol % (each of w, x, and y may represent 0, but the case where all of them each represent 0 is excluded), and L, M, and Q each represent a metal atom selected from Ni, Cu, Zn, Li, Mg, Mn, Sr, Ca, and Ba.

Examples of the ferrite particle include a magnetic Li ferrite, Mn—Zn ferrite, Mn—Mg ferrite, MnMgSr ferrite, Cu—Zn ferrite, Ni—Zn ferrite, Ba ferrite, and Mn ferrite. Of those, the Mn ferrite or the Mn—Zn ferrite each containing an Mn element is preferable from the viewpoint of the easy control of the growth rate of the crystal.

The specific resistance of each of the porous magnetic core particles is adjusted by reducing the surface of the magnetic component of the magnetic carrier through a heat treatment for the magnetic component in an inert gas instead of controlling the kind of a magnetic material for the carrier. For example, the following approach is suitably employed: the magnetic component is subjected to a heat treatment under an inert gas (such as nitrogen) atmosphere at 600° C. or higher and 1,000° C. or lower.

When the 50% particle diameter on a volume basis of the above magnetic carrier is represented by D50, the average breaking strength of the magnetic carrier having a particle diameter of D50−5 μm or more and D50+5 μm or less is represented by P1 (MPa), and the average breaking strength of the magnetic carrier having a particle diameter of 10 μm or more and less than 20 μm is represented by P2 (MPa), P2/P1 is preferably 0.50 or more and 1.10 or less. Setting P2/P1 within the above range can: favorably suppress the generation of a flaw on a photosensitive drum when the developer is used over a long time period; and favorably prevent the occurrence of fogging. P2/P1 is more preferably 0.70 or more and 1.10 or less.

The inventors of the present invention consider the reason for the foregoing to be as described below.

The magnetic carrier having a particle diameter of 10 μm or more and less than 20 μm tends to have a smaller resin content in each of the porous magnetic core particles than that of the magnetic carrier having a particle diameter around the 50% particle diameter on a volume basis. The magnetic carrier containing resin-containing magnetic particles each having a small resin content is apt to have a low strength, and is apt to be broken by a stress applied to the magnetic carrier at the time of its stirring in a developing device or a stress applied by a regulating member on a developing sleeve so as to be turned into fine particles. In addition, when additionally fine magnetic components as particles are produced by the breakage, these particles have a high true specific gravity and are hard, so, when the particles migrate onto a photosensitive drum, the particles are apt to scratch the surface layer of the photosensitive drum at the time of the cleaning of the photosensitive drum so as to be responsible for the generation of a scratch. As a result, the particles are responsible for the generation of white stripes in a solid image.

Therefore, the resin component must be properly incorporated into each porous magnetic core particle particularly in the magnetic carrier having a particle diameter of 10 μm or more and less than 20 μm so that P2/P1 is 0.50 or more. In addition, setting P2/P1 within the above range uniformizes charge-providing performance for the toner, and can provide good triboelectric charging performance.

The adjustment of P2/P1 in the range of 0.50 or more to 1.10 or less can be achieved by: controlling the pores of the porous magnetic core particles, the composition of the resin component to be incorporated, and the step of incorporating the resin component; and uniformly incorporating the resin component.

In order that the resin component may be uniformly incorporated, a solution of the resin component to be incorporated more preferably has a viscosity (25° C.) of 0.6 Pa·s or more and 100 Pa·s or less. Setting the viscosity of the solution of the resin component within the above range allows the resin component to penetrate into the pores uniformly and sufficiently, and allows the resin component to adhere to the magnetic component properly, whereby the resin component is in a state of being favorably incorporated.

The above resin component to be incorporated into each porous magnetic core particle is not particularly limited as long as the resin component shows high wettability with respect to the magnetic component of the magnetic carrier, and each of a thermoplastic resin and a thermosetting resin may be used.

Examples of the thermoplastic resin includes the following: a polystyrene; acrylic resins such as polymethyl methacrylate and a styrene-acrylic acid copolymer; a styrene-butadiene copolymer; an ethylene-vinyl acetate copolymer; polyvinyl chloride; polyvinyl acetate; a polyvinylidene fluoride resin; a fluorocarbon resin; a perfluorocarbon resin; a solvent-soluble perfluorocarbon resin; polyvinyl pyrrolidone; a petroleum resin; a novolac resin; aromatic polyester resins such as a saturated alkylpolyester resin, polyethylene terephthalate, polybutylene terephthalate, and polyallylate; a polyamide resin; a polyacetal resin; a polycarbonate resin; a polyethersulfone resin; a polysulfone resin; a polyphenylene sulfide resin; and a polyetherketone resin.

Examples of the thermosetting resin can include the following: A phenol resin; a modified phenol resin; a maleic resin; an alkyd resin; an epoxy resin; an acrylic resin; unsaturated polyester obtained by polycondensation of maleic anhydride, terephthalic acid, and a polyhydric alcohol; a urea resin; a melamine resin; a urea-melamine resin; a xylene resin; a toluene resin; a guanamine resin; a melamine-guanamine resin; an acetoguanamine resin; a glyptal resin; a furan resin; a silicone resin; a polyimide resin; a polyamideimide resin; a polyetherimide resin; and a polyurethane resin.

Resins obtained by denaturing those resins are also permitted. Of those, a fluorine-containing resin such as a polyvinylidene fluoride resin, a fluorocarbon resin, or a perfluorocarbon resin, or a solvent-soluble perfluorocarbon resin, an acrylic-denatured silicone resin, or a silicone resin is preferable because these resins each have high wettability with respect to the magnetic component of the magnetic carrier.

To be more specific, a conventionally known silicone resin can be used as the silicone resin. Examples of the silicone resin include: a straight silicone resin composed only of an organosiloxane bond; and a silicone resin denatured with, for example, an alkyd, polyester, an epoxy, or urethane.

A commercially available straight silicone resin is, for example, a KR271, KR255, or KR152 manufactured by Shin-Etsu Chemical Co., Ltd., or an SR2400 or SR2405 manufactured by Dow Corning Toray Co., Ltd. A commercially available denatured silicone resin is, for example, KR206 (alkyd-denatured), KR5208 (acrylic-denatured), ES1001N (epoxy-denatured), or KR305 (urethane-denatured) manufactured by Shin-Etsu Chemical Co., Ltd., or SR2115 (epoxy-denatured) or SR2110 (alkyd-denatured) manufactured by Dow Corning Toray Co., Ltd.

A general method of incorporating the resin component into each of the porous magnetic core particles involves: diluting the resin component with a solvent; and adding the solution to the magnetic component of the magnetic carrier. The solvent used here has only to be capable of dissolving each resin component. In the case of a resin soluble in an organic solvent, examples of the organic solvent include toluene, xylene, cellosolve butyl acetate, methyl ethyl ketone, methyl isobutyl ketone, and methanol. In the case of a water-soluble resin component or an emulsion type resin component, water has only to be used. A method of adding the resin component diluted with a solvent into each of the porous magnetic core particles is, for example, a method involving: impregnating the particles with the resin component by an application method such as a dipping method, a spray method, a brush coating method, a fluidized bed method, or a kneading method; and volatilizing the solvent after the impregnation.

In addition, the magnetic carrier of the present invention may have another resin component with which the surface of the magnetic carrier is coated as well as the above resin component to be incorporated into each porous magnetic core particle. In that case, the resin component to be incorporated into each magnetic core particle and the resin component with which the surface of the magnetic carrier is coated may be identical to or different from each other. An acrylic resin is more preferably used as the resin component with which the surface of the magnetic carrier is coated because the durability of the magnetic carrier can be improved.

The 50% particle diameter on a volume basis (D50) of the above magnetic carrier is preferably 20 μm or more and 70 μm or less from the viewpoints of: triboelectric charging performance for the toner; and the prevention of carrier adhesion to an image region and of fogging.

The 50% particle diameter (D50) of the magnetic carrier can be adjusted within the above range by performing air classification or screen classification.

The toner preferably has the following characteristic: the toner having a circle-equivalent diameter (number basis) measured with a flow-type particle image measuring apparatus having an image processing resolution of 512×512 pixels (each measuring 0.37 μm by 0.37 μm) of 2.0 μm or more has an average circularity of 0.945 or more and 0.970 or less. Setting the average circularity of the toner within the above range improves contact between the toner and the magnetic carrier, provides good developing performance, and suppresses the embedding of the external additive in a toner particle surface. Further, setting the average circularity within the above range provides good cleaning performance.

Means for adjusting the average circularity of the toner is not particularly limited; any one of various methods such as a method involving sphering pulverized toner particles by a mechanical impact method and a method involving atomizing a molten mixture with a disk or a multi-fluid nozzle in the air to provide spherical toner particles can be adopted for adjusting the above average circularity within the above range.

When toner particles are obtained by the mechanical impact method out of the above methods, a wax amount on the surface of each toner particle can be simply controlled. In addition, the method is more preferable because the surface profile of each toner particle can also be simply controlled. The wax amount on the surface of each toner particle can be adjusted by controlling: the physical properties of raw materials, in particular, the viscoelasticity of a resin; or conditions under which the toner particles are produced, in particular, conditions for melting and kneading, and a condition for polymerization. However, a method for the adjustment is not particularly limited as long as desired physical properties can be obtained. A mechanical grinder used in the mechanical impact method is, for example, a HYBRIDIZER manufactured by NARA MACHINERY CO., LTD., a Kryptron system manufactured by Kawasaki Heavy Industries, or a Super rotor manufactured by Nisshin Engineering Inc.

Figure 8:
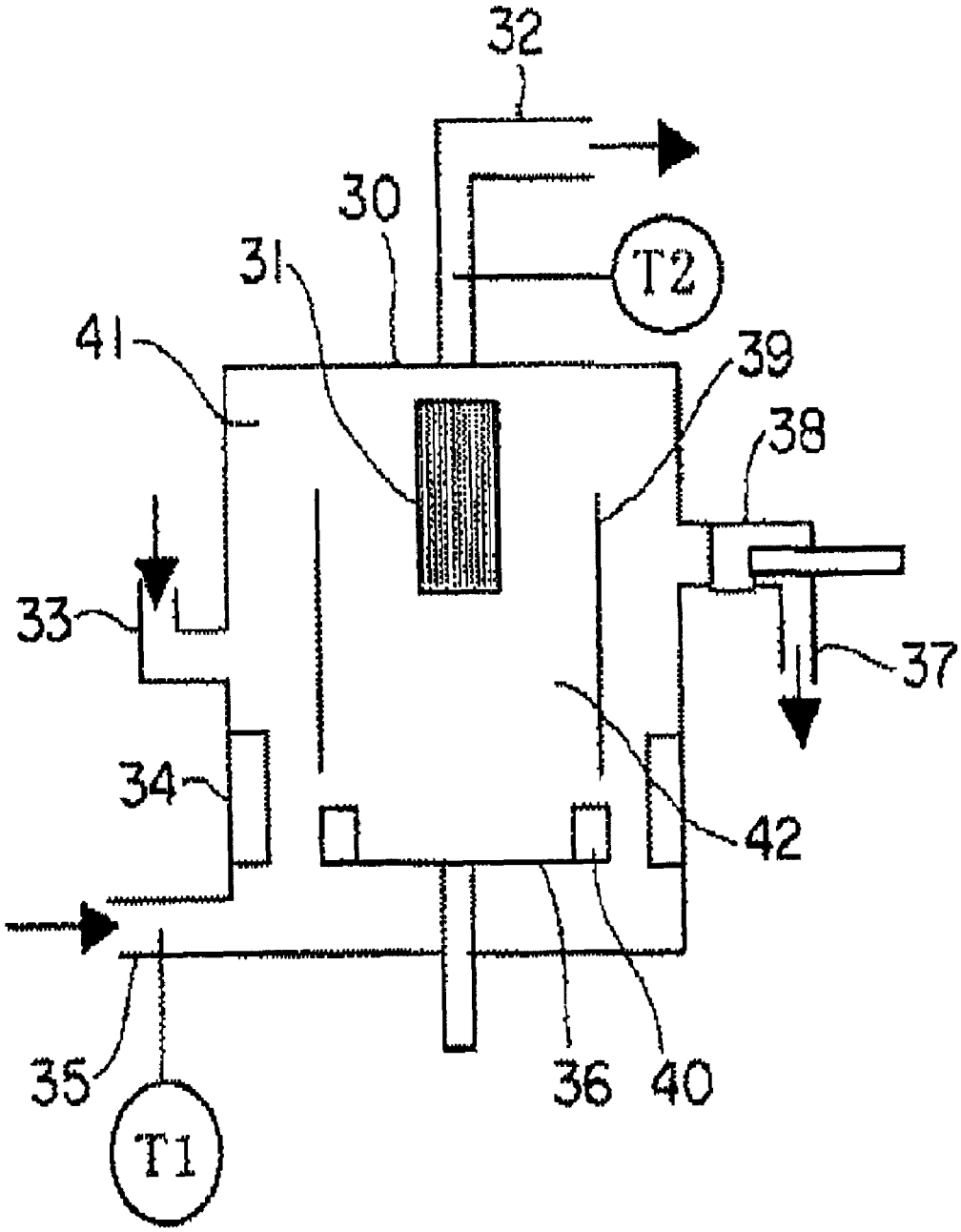
FIG. 8 is a schematic sectional view showing an example of the constitution of a surface modification apparatus preferably used in the production of a toner of the present invention.

An apparatus shown in FIG. 8 is preferably used in order that a toner having an appropriate wax amount on a toner particle surface and an average circularity of 0.945 to 0.970 out of various kinds of toners may be favorably obtained. The use of the apparatus can provide a toner capable of achieving excellent fixing performance and excellent transferring performance at high levels.

Figure 9:
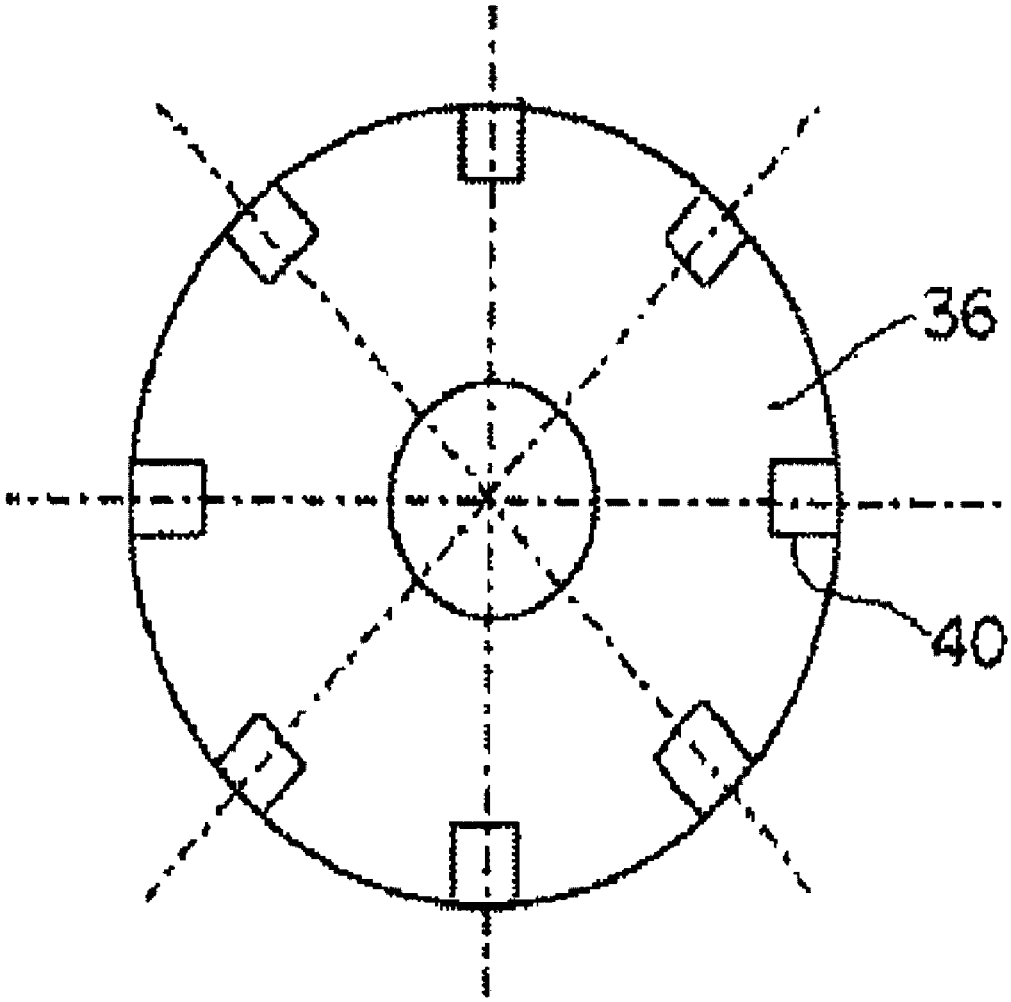
FIG. 9 is a schematic plan view showing the constitution of a dispersion rotor provided to the surface modification apparatus of FIG. 8.

FIG. 8 is a schematic sectional view showing an example of the constitution of a surface modification apparatus preferably used in the production of the toner of the present invention. FIG. 9 is a schematic plan view showing the constitution of a dispersion rotor possessed by the surface modification apparatus of FIG. 8. The apparatus intends to obtain desired shapes and desired performance by applying a mechanical impact force while discharging a produced fine powder to the outside of the apparatus. In the case of a mechanical sphering treatment, considerably small fine powders produced at the time of pulverization typically agglomerate again to provide uneven shapes, so the treatment must be performed while the produced fine powders are discharged to the outside, and hence a mechanical impact force more than necessary is needed for obtaining a desired sphericity. As a result, the following detrimental effect arises: a redundant heat quantity is applied to a toner surface, and a wax amount on the toner surface increases. In addition, an extremely small fine powder is mainly responsible for making the spent of the toner to the carrier remarkable. In contrast, in the apparatus shown in each of FIGS. 8 and 9, powders are classified while the same air flow applying a mechanical impact force is not stopped, so the powders can be efficiently discharged to the outside without being agglomerated again.

Additionally detailed description will be given below. The surface modification apparatus shown in FIG. 8 is formed of: a casing; a jacket (not shown) through which cooling water or antifreeze can pass; a dispersion rotor 36 as surface modification means, the dispersion rotor 36 being present in the casing and attached to a central rotation axis, the dispersion rotor 36 having multiple square disks or cylindrical pins 40 on its upper surface, and the dispersion rotor 36 being a disk-like rotator rotating at a high speed; a liner 34 placed on the outer periphery of the dispersion rotor 36 with a certain interval between the liner and the rotor, the liner 34 being provided with a large number of grooves on its surface (it should be noted that no grooves may be present on the liner surface); a classification rotor 31 as means for classifying surface-modified raw materials depending on a predetermined particle diameter; a cold air introduction port 35 for introducing cold air; a raw material feeding port 33 for introducing raw materials to be treated; a discharge valve 38 placed so as to be openable and closable for freely adjusting a surface modification time; a product discharge port 37 for discharging a powder after a treatment; and a cylindrical guide ring 39 as guiding means for partitioning a space between the classification rotor 31 and a set of the dispersion rotor 36 and the liner into a first space 41 before the introduction of the raw materials to the classification rotor 31 and a second space 42 for introducing particles from which a fine powder has been removed by classification by the classification rotor 31 to surface treatment means. A gap portion between the dispersion rotor 36 and the liner 34 is a surface modification zone, and the classification rotor 31 and its peripheral portion constitute a classification zone.

In the surface modification apparatus constituted as described above, when finely pulverized products are loaded from the raw material feeding port 33 in a state where the discharge valve 38 is closed, the loaded finely pulverized products are firstly sucked by a blower (not shown) and classified by the classification rotor 31. At this time, a fine powder having a particle diameter equal to or smaller than the predetermined particle diameter obtained as a result of the classification is removed by being continuously discharged to the outside of the apparatus. A coarse powder having a particle diameter equal to or larger than the predetermined particle diameter is guided to the surface modification zone by a circulation flow generated by the dispersion rotor 36 along the inner periphery of the guide ring 39 (the second space 42) by virtue of a centrifugal force.

The raw materials guided to the surface modification zone receive a mechanical impact force between the dispersion rotor 36 and the liner 34 to be subjected to a surface modification treatment. The particles with their surfaces modified ride on cold air passing through the inside of the apparatus, whereby the particles are guided to the classification zone along the outer periphery of the guide ring 39 (the first space 41). A fine powder generated at that time is discharged by the classification rotor 31 to the outside of the apparatus again, and a coarse powder rides on the circulation flow to return to the surface modification zone again. Then, the coarse powder repeatedly receives a surface modification action. After a predetermined time period has passed, the discharge valve 38 is opened, and the surface-modified particles are collected from the product discharge port 37.

Investigation conducted by the inventors of the present invention have shown that a time period commencing on the loading of the finely pulverized products from the raw material feeding port 33 and ending on the opening of the discharge valve (cycle time) and the number of revolutions of the dispersion rotor in the step of the surface modification treatment with the above surface modification apparatus each play an important role in controlling the average circularity of the toner and a wax amount on a toner particle surface. Lengthening the cycle time or increasing the circumferential speed of the dispersion rotor is effective in increasing the average circularity. In addition, in contrast, shortening the cycle time or reducing the circumferential speed is effective in suppressing the transmittance of the toner. In particular, unless the circumferential speed of the dispersion rotor is equal to or larger than a certain value, the toner cannot be subjected to efficient sphering, so the toner must be subjected to sphering with the cycle time lengthened, with the result that the transmittance of the toner is increased more than necessary in some cases. A circumferential speed of the dispersion rotor of $1.2\times10^{-5}$ mm/s or more and a cycle time of 5 to 60 seconds are effective in increasing the circularity of the toner to cause each of the average circularity and transmittance of the toner to fall within the above range while suppressing the transmittance to a level equal to or lower than a predetermined level.

The two-component developer of the present invention can be used also as a replenishing developer for use in a two-component developing method including: performing development while replenishing a developing device with the replenishing developer; and discharging an excess magnetic carrier in the developing device from the developing device. With such constitution, the performance of the two-component developer in the developing device can be maintained. When the two-component developer is used as the replenishing developer, the above toner is used at a mass ratio of 2 parts by mass or more and 50 parts by mass or less with respect to 1 part by mass of the above magnetic carrier. The use of the above replenishing developer allows the performance of the two-component developer in the developing device to be stably maintained over a long time period. As a result, an image which: shows a small fluctuation in charging performance of the toner; has good dot reproducibility; and undergoes fogging to a small extent can be obtained. When an image is formed with a developer using a toner showing high coloring power per particle like the toner of the present invention, fogging is apt to be remarkable as compared to the case where an image is formed with an ordinary developer that does not have such characteristic as described above. Accordingly, the ability of the developer to provide an image undergoing fogging to a small extent as described above is an advantage over the ordinary developer. In addition, in the case of a developer using a toner showing high coloring power like the present invention, an image is developed with a low developer consumption, so a stress to be applied to each of the toner and a carrier is expected to be larger than that in a developer using a conventional toner. The carrier that has received the stress often shows charge-providing performance reduced as compared to that in an initial state, so its durability may deteriorate. In view of the foregoing, in the present invention, the durability of the two-component developer of the present invention is improved by incessantly feeding a new carrier having high charge-providing performance together with a new toner from the replenishing developer, whereby an additionally stable image output can be obtained even when the developer is used over a long time period.

It should be noted that, in an image-forming apparatus using such replenishing developer as described above, the magnetic carrier the volume of which has been increased by virtue of the magnetic carrier in the replenishing developer with which the developing device is replenished overflows from the developing device in an amount corresponding to the increase in volume, and is taken in a developer collecting auger, transported to a replenishing developer container or another collecting container, and discharged.

In addition, the toners of the present invention, or the magnetic carriers of the present invention, used in the two-component developer with which the above developing device is filled first (which may hereinafter be referred to as "starting developer") and the above replenishing developer may be identical to or different from each other.

In addition, an image-forming method of the present invention is an image-forming method including: a charging step of charging an electrostatic latent image bearing member; an electrostatic latent image forming step of forming an electrostatic latent image on the electrostatic latent image bearing member charged in the charging step; a developing step of developing the electrostatic latent image formed on the electrostatic latent image bearing member with the two-component developer of the present invention to form a toner image; a transferring step of transferring the toner image on the electrostatic latent image bearing member onto a transfer material through or without through an intermediate transfer body; and a fixing step of fixing the toner image to the transfer material, and is characterized in that a laid-on level of a toner of a monochromatic solid image portion (having an image density of 1.5) in the unfixed toner image formed on the transfer material is in the range of 0.10 mg/cm$^2$ or more to 0.50 mg/cm$^2$ or less. The laid-on level of the toner of the monochromatic solid image portion in the unfixed toner image formed on the transfer material is more preferably in the range of 0.10 mg/cm$^2$ or more to 0.35 mg/cm$^2$ or less.

When the above laid-on level of the toner is less than 0.10 mg/cm$^2$, even if coloring power per toner particle is improved, the number of toner particles is insufficient, and a density does not increase owing to an influence of the formation of recording paper in some cases. In addition, when the above laid-on level of the toner exceeds 0.50 mg/cm$^2$, the step height of the toner becomes remarkable. In addition, dust at the time of transfer or fixation may become remarkable.

The toner of the present invention can be obtained by a suspension polymerization method, an emulsion agglomeration method, an association polymerization method, or a kneading pulverization method, and a production method for the toner is not particularly limited.

The toner of the present invention has a weight-average particle diameter of preferably 4.0 μm or more and 8.0 μm or less, more preferably 4.0 μm or more and 7.0 μm or less, or still more preferably 4.5 μm or more and 6.5 μm or less. Setting the weight-average particle diameter of the toner within the above range can sufficiently improve dot reproducibility and transfer efficiency. The weight-average particle diameter of the toner can be adjusted by the classification of toner particles at the time of the production of the toner or by the mixing of classified products.

A binder resin to be used in each of the toner particles of which the toner of the present invention is constituted preferably contains a resin having a polyester unit. The term "polyester unit" refers to a portion originating from polyester.

The above polyester unit is formed by the condensation polymerization of ester monomers. Examples of the ester monomers include: polyhydric alcohol components; and carboxylic acid components such as a polyvalent carboxylic acid, a polyvalent carboxylic anhydride, and a polyvalent carboxylate having two or more carboxyl groups.

Examples of a dihydric alcohol component out of the polyhydric alcohol component include bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, and hydrogenated bisphenol A.

Examples of a trihydric or higher alcohol component out of the polyhydric alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of a carboxylic acid component forming a polyester unit include the following: aromatic dicarboxylic acids such as phthalic acid, isophthalic acid, and terephthalic acid or anhydrides thereof; alkyldicarboxylic acids such as succinic acid, adipic acid, sebacic acid, and azelaic acid or anhydrides thereof; succinic acid substituted with an alkyl group having 6 to 12 carbon atoms or anhydrides thereof; and unsaturated dicarboxylic acids such as fumaric acid, maleic acid, and citraconic acid or anhydrides thereof.

As the preferred example of a resin containing a polyester unit, mentioned is a polyester resin obtained by a condensation polymerization using a bisphenol derivative typified by a structure represented by the following general formula as an alcohol component and a carboxylic acid component (such as fumaric acid, maleic acid, maleic anhydride, phthalic acid, terephthalic acid, dodecenylsuccinic acid, trimellitic acid, or pyromellitic acid) derived from a divalent or higher carboxylic acid, an anhydride thereof, or a lower alkylester thereof as carboxylic acid component. The polyester resin is preferred in the present invention because of its excellent charging property.

[Chem 1]

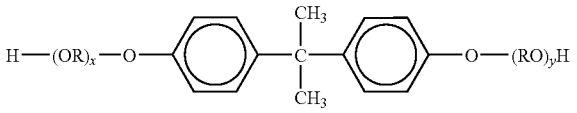

(where R represents an ethylene or propylene group, x and y each represent an integer of one or more, and x+y has an average value of 2 to 10.)

In addition, the preferable examples of the above resin having a polyester unit include polyester resins each having a crosslinked structure. Each of the polyester resins each having a crosslinked structure is obtained by a condensation polymerization reaction between a polyhydric alcohol and a carboxylic acid component containing a polyvalent carboxylic acid which is trivalent or more. Examples of the polyvalent carboxylic acid component which is trivalent or more include, but not limited to, 1,2,4-benzenetricarboxylic acid, 1,2,5-benzenetricarboxylic acid, 1,2,4-naphthalenetricarboxylic acid, 2,5,7-naphthalenetricarboxylic acid, and 1,2,4,5-benzenetetracarboxylic acid, and anhydrides and ester compounds of these acids. The content of the polyvalent carboxylic acid component which is trivalent or more in ester monomers to be subjected to condensation polymerization is preferably 0.1 to 1.9 mol % with reference to all the monomers.

Further, the preferable examples of the above resin having a polyester unit include: (a) a hybrid resin in which the polyester unit and a vinyl polymer unit are chemically bonded to each other; (b) a mixture of a hybrid resin and a vinyl polymer; (c) a mixture of a polyester resin and a vinyl polymer; (d) a mixture of a hybrid resin and a polyester resin; and (e) a mixture of a polyester resin, a hybrid resin, and a vinyl polymer.

The above hybrid resin is formed by, for example, bonding as a result of an ester exchange reaction between a polyester unit and a vinyl polymer unit obtained by the polymerization of a monomer component having a carboxylate group such as an acrylate or a methacrylate.

The hybrid resin is preferably a graft copolymer or block copolymer using a vinyl polymer as a stem polymer and a polyester unit as a branch polymer.

It should be noted that the above vinyl polymer unit means a portion originating from a vinyl polymer. The above vinyl polymer unit or vinyl polymer is obtained by the polymerization of a vinyl monomer.

Examples of the vinyl monomer may include the following: styrene monomer or an acrylic-based monomer; a methacrylic monomer; a monomer of ethylenically unsaturated monoolefins; a monomer of vinylesters; a monomer of vinylethers; a monomer of vinyl ketones; a monomer of N-vinyl compounds; and other vinyl monomers.

Examples of the styrene monomer may include the following: styrene; o-methylstyrene; m-methylstyrene; p-methylstyrene; p-methoxystyrene; p-phenylstyrene; p-chlorostyrene; 3,4-dichlorostyrene; p-ethylstyrene; 2,4-dimethylstyrene; p-n-butylstyrene; p-tert-butylstyrene; p-n-hexylstyrene; p-n-octylstyrene; p-n-nonylstyrene; p-n-decylstyrene; and p-n-dodecylstyrene.

Examples of the acrylic monomer may include the following: acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, dimethylaminoethyl acrylate, and phenyl acrylate; acrylic acids; and acrylamides.

Examples of the methacrylic monomer may include the following: methacrylates such as ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; methacrylic acids; and methacrylamides.

Examples of the monomer of ethylenically unsaturated monoolefins include ethylene, propylene, butylene, and isobutylene.

Examples of the monomer of vinylesters include vinyl acetate, vinyl propionate, and vinyl benzoate.

Examples of the monomer of vinylethers include vinyl methyl ether, vinyl ethyl ether, and vinyl isobutyl ether.

Examples of the monomer of vinyl ketones include vinyl methyl ketone, vinyl hexyl ketone, and methyl isopropenyl ketone.

Examples of the monomer of N-vinyl compounds include N-vinylpyrrole, N-vinylcarbazole, N-vinylindole, and N-vinylpyrrolidone.

Examples of the other kinds of vinyl monomers include vinylnaphthalenes and acrylic acid derivatives or methacrylic acid derivatives such as acrylonitrile, methacrylonitrile, and acrylamide.

One kind of the vinyl monomers may be used, or two or more kinds of them can be used in combination.

Examples of the polymerization initiator used when producing a vinyl polymer unit, a vinyl-based polymer, or a vinyl resin may include the following: azo or diazo polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; peroxide polymerization initiators or initiators having a peroxide on a sidechain, such as benzoylperoxide, methylethylketoneperoxide, diisopropylperoxycarbonate, cumene hydroperoxide, t-butylhydroxyperoxide, di-t-butylperoxide, dicumylperoxide, 2,4-dichlorobenzoylperoxide, lauroylperoxide, 2,2-bis(4,4-t-butylperoxycyclohexyl)propane, and tris-(t-butylperoxy) trizaine; persulfates such as potassium persulfate and ammonium persulfate; and hydrogen peroxide.

Further, examples of polymerization initiators which are radically polymerizable and has three or more functional groups include the following. Radically polymerizable polyfunctional polymerization initiators such as tris(t-butylperoxy)trizaine, vinyltris(t-butylperoxy)silane, 2,2-bis(4,4-di-t-butylperoxycyclohexyl)propane, 2,2-bis(4,4-di-t-amylperoxycyclohexyl)propane, 2,2-bis(4,4-di-t-octylperoxycyclohexyl)propane, and 2,2-bis(4,4-di-t-butylperoxycyclohexyl)butane.

Both the two-component developer and the replenishing developer of the present invention may be preferably used in an electrophotography process having an oilless fixing system. As such, it is preferable that the toner includes a release agent.

Examples of the above release agent include: aliphatic hydrocarbon waxes such as low-molecular-weight polyethylene, low-molecular-weight polypropylene, a polyolefin copolymer, a polyolefin wax, a microcrystalline wax, a paraffin wax, and a Fischer-Tropsch wax; oxides of aliphatic hydrocarbon waxes such as a polyethylene oxide wax, or block copolymers of the waxes; waxes mainly composed of aliphatic acid esters such as a carnauba wax, a montanic acid ester wax, and behenyl behenate; and partially or wholly deacidified aliphatic acid esters such as a deacidified carnauba wax.

It is preferable that the toner contain such release agent as described above, and have an endothermic peak in the temperature range of 30 to 200° C. in the endothermic curve of the toner in differential scanning calorimetry. In addition, the temperature of the highest endothermic peak out of the endothermic peaks is particularly preferably 50 to 110° C. in terms of low-temperature fixability and durability.

A differential scanning calorimeter is, for example, a DSC-7 manufactured by Perkin Elmer Co., Ltd., a DSC2920 manufactured by TA Instruments, or a Q1000 manufactured by TA Instruments. In measurement with the apparatus, the melting point of each of indium and zinc is used for correcting the temperature of the detecting portion of the apparatus, and the heat of fusion of indium is used for correcting a heat quantity. An aluminum pan is used for a measurement sample, and the measurement is performed by setting an empty pan as a reference.

The content of the above release agent is preferably 1 to 15 parts by mass, or more preferably 3 to 10 parts by mass with respect to 100 parts by mass of the binder resin in the toner particles. When the content of the release agent is 1 to 15 parts by mass, the agent can exert excellent releasing performance, for example, when an oilless fixing system is adopted.

The toner may contain a known charge control agent. Examples of the charge control agent include organometallic complexes, metal salts, chelate compounds, carboxylic acid derivatives such as carboxylic acid metal salts, carboxylic anhydrides, and carboxylates, condensates of aromatic compounds, and phenol derivatives such as bisphenols and calixarenes.

Examples of the organometallic complexes include monoazo metal complexes, acetylacetone metal complexes, hydroxycarboxylic acid metal complexes, polycarboxylic acid metal complexes, and polyol metal complexes.

Of those, a metal compound of an aromatic carboxylic acid is preferable from the viewpoint of an improvement in charge rising performance of the toner.

The content of the above charge control agent is preferably 0.1 to 10.0 parts by mass, or more preferably 0.2 to 5.0 parts by mass with respect to 100 parts by mass of the binder resin in the toner particles. Adjusting the amount of the charge control agent in the toner within the above range can reduce a change in charge quantity of the toner in any one of various environments ranging from a high-temperature, high-humidity environment to a low-temperature, low-humidity environment.

The toner contains a colorant. The colorant may be a pigment or a dye, or a combination of them.

Examples of the dye may include the following: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6.

Examples of the pigment may include the following: mineral Fast Yellow, Navel Yellow, Naphthol Yellow S, Hansa Yellow G, Permanent Yellow NCG, Tartrazine Lake, Molybdenum Orange, Permanent Orange GTR, Pyrazolone Orange, Benzidine Orange G, Permanent Red 4R, Watching Red calcium salt, eosine lake, Brilliant Carmine 3B, Manganese Violet, Fast Violet B, Methyl Violet Lake, Cobalt Blue, Alkali Blue Lake, Victoria Blue Lake, Phthalocyanine Blue, Fast Sky Blue, Indanthrene Blue BC, Chrome Green, Pigment Green B, Malachite Green Lake, and Final Yellow Green G.

In addition, when the two-component developer and replenishing developer of the present invention are each used as a developer for forming a full-color image, the toner can contain a coloring pigment for each of magenta, cyan, and yellow colors.

Examples of the magenta coloring pigment may include the following: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, and 238; C.I. Pigment Violet 19; and C.I. Vat Red 1, 2, 10, 13, 15, 23, 29, and 35.

The toner particles can includes only the magenta pigments, but when the dye and the pigment are combined, sharpness of a developer and image quality of a full color image are improved.

Examples of the magenta dye may further include the following: Oil soluble dyes such as C.I. Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40, and C.I. Basic Violet 1, 3, 7, 10, 14, 15, 21, 25, 26, 27, and 28.

Examples of the cyan coloring pigment may include the following: C.I. Pigment Blue 2, 3, 15, 15:1, 15:2, 15:3, 16, and 17; C.I. Acid Blue 6; C. I. Acid Blue 45; and copper phthalocyanine pigments having a phthalocyanine skelton substituted by 1 to 5 methyl phthalimide groups.

A yellow coloring pigment may include the following: C.I. Pigment Yellow 1, 2, 3, 4, 5, 6, 7, 10, 11, 12, 13, 14, 15, 16, 17, 23, 65, 73, 74, 83, 93, 97, 155, and 180; and C.I. Vat Yellow 1, 3, and 20.

A black pigment is, for example, carbon black such as furnace black, channel black, acetylene black, thermal black, or lamp black, or a magnetic powder such as magnetite or ferrite. Alternatively, a magenta dye and a magenta pigment, a yellow dye and a yellow pigment, and a cyan dye and a cyan pigment may be combined to tone a black color, and, furthermore, carbon black described above may be used in combination with any such dye or pigment.

In addition, the toner contains inorganic fine particles each serving as an external additive.

The inorganic fine particles have a number average particle diameter of preferably 80 nm or more and 300 nm or less, or more preferably 90 nm or more and 150 nm or less. When the number average particle diameter of the inorganic fine particles falls within the above range, the inorganic fine particles are hardly embedded in the toner particles, and can each continue to function as a spacer even when images are continuously output over a long time period. In addition, meanwhile, the inorganic fine particles are hardly liberated from the toner particles. As a result, even in the case of a toner the absolute value for the triboelectric charge quantity of which is 50 mC/kg or more and 120 mC/kg or less, toner release from a carrier does not become remarkable, and an image can be efficiently developed. In addition, not a state where the toner and a photosensitive drum contact with each other at the surface of each toner particle but a state where the inorganic fine particles and the photosensitive drum contact with each other in a point contact manner can be maintained, releasing performance between the toner and the photosensitive drum is also maintained, and a reduction in transfer efficiency can be suppressed. Such inorganic fine particles are externally added to the toner at a content of preferably 0.1 to 3.0 mass %, or more preferably 0.5 to 2.5 mass %.

Examples of the above inorganic fine particles include silica fine particles, alumina fine particles, and titanium oxide fine particles. In the case of the silica fine particles, all kinds of silica fine particles produced by employing a conventionally known technology such as a vapor-phase decomposition method, a combustion method, or a deflagration method can be used.

In addition, the above inorganic fine particles are preferably particles produced by a known sol-gel method involving: removing a solvent from a silica sol suspension obtained by the hydrolysis and condensation reaction of an alkoxysilane with a catalyst in an organic solvent in which water is present; drying the remainder; and turning the dried product into particles. The silica fine particles produced by the sol-gel method each have a substantially spherical shape, are monodisperse, and serve as excellent spacer particles.

The surface of the silica fine particles obtained by a sol-gel method may be subjected to a hydrophobic treatment and used. As the hydrophobic treatment agent, a silane compound is preferably used. Examples of the silane compound include: hexamethyl disilazane; monochlorosilanes such as trimethyl chlorosilane and triethyl chlorosilane; monoalkoxysilanes such as trimethyl methoxysilane and trimethyl ethoxysilane; monoaminosilanes such as trimethylsilyl dimethylamine and trimethylsilyl diethylamine; and monoacyloxysilanes such as trimethylacetoxysilane.

In addition, fine particles each serving as an external additive as well as the above inorganic fine particles having a number average particle diameter of 80 nm or more and 300 nm or less may be added to the toner; fine particles having a number average particle diameter of 5 nm or more and 60 nm or less are preferable. The external addition of the fine particles except the above inorganic fine particles to the toner can improve the flowability or transferring performance of the toner. The fine particles preferably contain inorganic fine particles selected from titanium oxide, aluminum oxide, and silica fine particles.

The surface of each of the above fine particles is preferably subjected to a hydrophobic treatment. The hydrophobic treatment is preferably performed with any one of the hydrophobic treatment agents such as: various titanium coupling agents; coupling agents such as a silane coupling agent; aliphatic acids and metal salts of the acids; silicone oil; and a combination of two or more of them.

Examples of the titanium coupling agent used in the hydrophobic treatment include the following: tetrabutyl titanate, tetraoctyl titanate, isopropyl triisostearoyl titanate, isopropyl tridecylbenzene sulfonyl titanate, and bis(dioctlypyrophosphate)oxyacetate titanate.

Examples of the silane coupling agent used in the hydrophobic treatment may include the following: γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyl trimethoxysilane, and p-methylphenyl trimethoxysilane.

Examples of the fatty acid and metal salts to be used in the hydrophobic treatment include the following. Long chain fatty acids such as undecyl acid, lauric acid, tridecyl acid, dodecyl acid, myristic acid, palmitic acid, pentadecyl acid, stearic acid, heptadecyl acid, arachic acid, montan acid, oleic acid, lionic acid, and arachidonic acid. Examples of the metals for the metal salts include zinc, iron, magnesium, aluminum, calcium, sodium, and lithium.

Examples of the above silicone oil for a hydrophobic treatment include a dimethyl silicone oil, a methyl phenyl silicone oil, and an amino-modified silicone oil.

The above hydrophobic treatment is preferably performed by adding 1 to 30 mass % (more preferably 3 to 7 mass %) of any one of the above hydrophobic treatment agents to the inorganic fine particles to coat the inorganic fine particles.

The hydrophobicity of each of the inorganic fine particles subjected to the hydrophobic treatment is not particularly limited. For example, a hydrophobicity determined by a methanol titration test for the inorganic fine particles after the hydrophobic treatment (methanol wettability; indicator showing wettability with respect to methanol) preferably falls within the range of 40 to 95.

The total content of the above external additive in the toner is preferably 0.1 to 5.0 mass %, or more preferably 0.5 to 4.0 mass %. Alternatively, the external additive may be a combination of multiple kinds of fine particles.

When a full-color image is formed, the cyan toner, the magenta toner, and the yellow toner described above can be used in combination. In addition, at that time, the laid-on level of a toner for each color is in the range of preferably 0.10 $mg/cm^2$ or more to 0.50 $mg/cm^2$ or less, or more preferably 0.10 $mg/cm^2$ or more to 0.35 $mg/cm^2$ or less.

Figure 7:
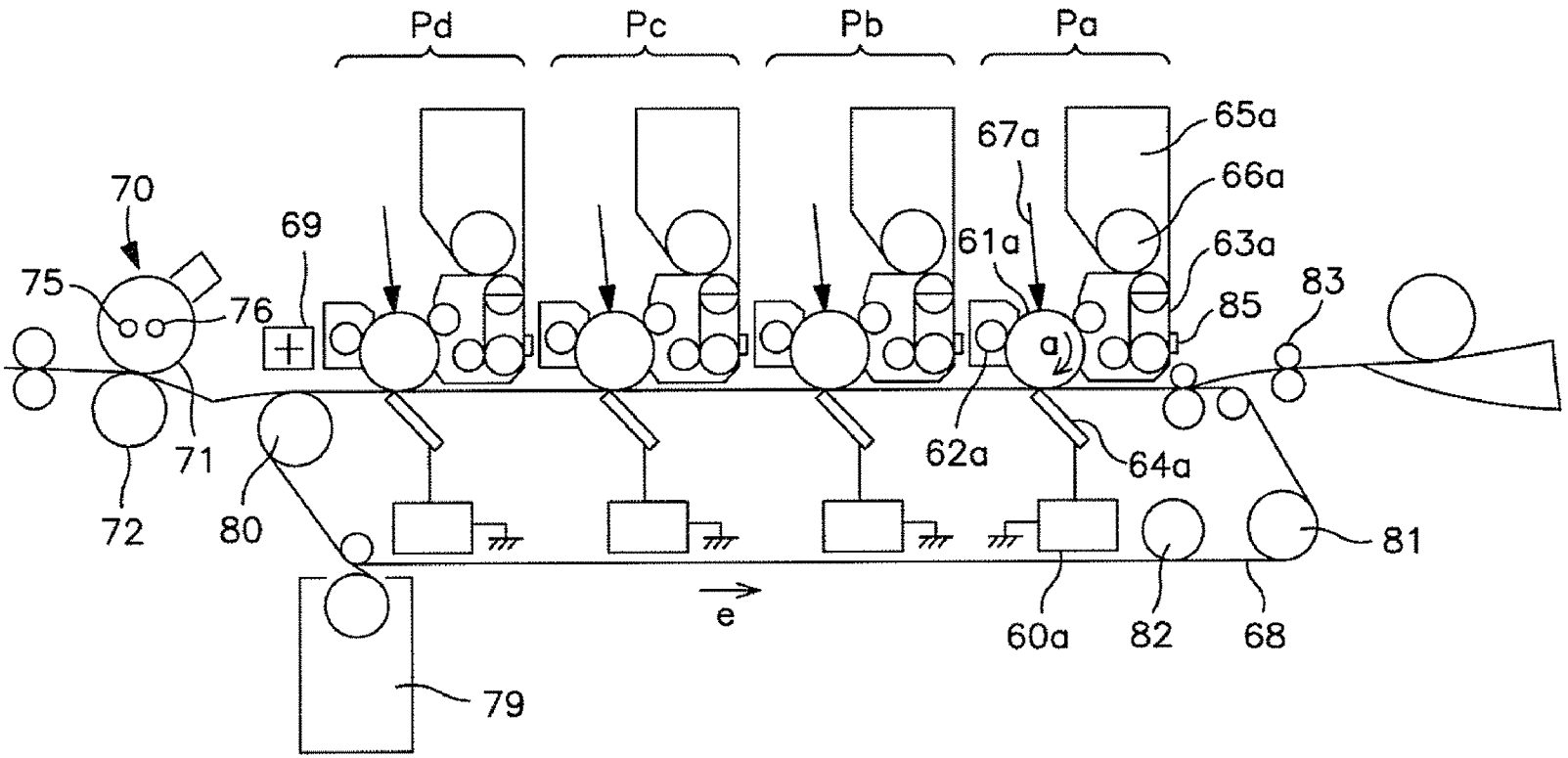
FIG. 7 is an outline constitution view as an embodiment of a full-color image-forming apparatus using a replenishing developer of the present invention.

FIG. 7 shows an outline view when the image-forming method of the present invention is applied to a full-color image-forming apparatus.

A first image-forming unit Pa, a second image-forming unit Pb, a third image-forming unit Pc, and a fourth image-forming unit Pd are provided for the main body of the full-color image-forming apparatus, and images different from each other in color are formed on a transfer material through latent image formation, development, and transfer processes.

The constitution of each of the image-forming units provided for the image-forming apparatus will be described by taking the first image-forming unit Pa as an example.

The first image-forming unit Pa is provided with a photosensitive member 61*a* having a diameter of 30 mm as an electrostatic latent image bearing member, and the photosensitive member 61*a* is rotated and moved in the direction indicated by an arrow a. A charging roller 62*a* like a primary charging device as charging means is placed so that a magnetic brush for charging formed on the surface of the sleeve of the roller having a diameter of 16 mm is in contact with the surface of the photosensitive member 61*a*. Exposure light 67*a* is applied to the photosensitive member 61*a* from an exposing device (not shown) for forming an electrostatic latent image on the photosensitive member 61*a* the surface of which is uniformly charged by the charging roller 62*a*. A developing device 63*a* as developing means for developing the electrostatic latent image borne by the photosensitive member 61*a* to form a color toner image holds a color toner. A transferring blade 64*a* as transferring means transfers the color toner image formed on the surface of the photosensitive member 61*a* onto the surface of a transfer material (recording material) transported by a belt-like transfer material bearing member 68. The transferring blade 64*a* can contact with the back surface of the transfer material bearing member 68 to apply a transfer bias.

In the first image-forming unit Pa, after the photosensitive member 61*a* has been subjected to uniform primary charging by the charging roller 62*a*, the electrostatic latent image is formed on the photosensitive member by the exposure light 67*a* from the exposing device, and the electrostatic latent image is developed with the color toner by the developing device 63*a*. The developed toner image is transferred onto the surface of the transfer material by applying the transfer bias from the transferring blade 64*a* contacting with the back surface side of the belt-like transfer material bearing member 68 for bearing and transporting the transfer material at a first transfer portion (position at which the photosensitive member and the transfer material contact with each other).

When a toner/magnetic carrier (T/C) ratio reduces as a result of the consumption of the toner in the development, the reduction is detected by a toner concentration detecting sensor 85 for measuring a change in permeability of the developer by utilizing the inductance of a coil, and the developing device is replenished with a replenishing developer from a replenishing developer container 65*a* in accordance with the toner consumption. It should be noted that the toner concentration detecting sensor 85 has the coil (not shown) in itself.

The image-forming apparatus of the present invention is obtained by providing the four image-forming units formed of the first image-forming unit Pa, and the second image-forming unit Pb, the third image-forming unit Pc, and the fourth image-forming unit Pd each of which: has the same constitution as that of the first image-forming unit Pa; and is different from the first image-forming unit Pa in the color of a color toner held in a developing device. For example, a yellow toner is used in the first image-forming unit Pa, a magenta toner is used in the second image-forming unit Pb, a cyan toner is used in the third image-forming unit Pc, and a black toner is used in the fourth image-forming unit Pd. As a result, the respective color toners are sequentially transferred onto the transfer material at the transfer portions of the respective image-forming units. In the step, the respective color toners are superimposed on the same transfer material by one movement of the transfer material while the toners are in register. After the completion of the superimposition, the transfer material is detached from the upper portion of the transfer material bearing member 68 by a detach charging device 69. After that, the transfer material is transported by transport means such as a transport belt to a fixing apparatus 70 where the final full-color image is obtained by only one fixation.

The fixing apparatus 70 has a fixing roller 71 and a pressure roller 72, and the fixing roller 71 has heating means 75 and 76 in itself.

An unfixed color toner image transferred onto the transfer material passes through a portion where the fixing roller 71 and pressure roller 72 of the fixing apparatus 70 are brought into press contact with each other so as to be fixed onto the transfer material by the actions of heat and a pressure.

In FIG. 7, the transfer material bearing member 68 is an endless, belt-like member, and the belt-like member is moved by a driver roller 80 in the direction indicated by an arrow e. The member has, in addition to the foregoing, a transfer belt cleaning member 79, a belt driven roller 81, and a belt static eliminator 82, and a pair of resist rollers 83 transports the transfer material in a transfer material holder to the transfer material bearing member 68. Contact transferring means capable of directly applying a transfer bias by bringing a roller-like transfer roller into contact with the back surface side of the transfer material bearing member 68 can also be used as transferring means instead of the transferring blade 64*a* contacting with the back surface side of the transfer material bearing member 68.

Further, generally used non-contact transferring means placed on the back surface side of the transfer material bearing member 68 in a non-contact manner to perform transfer by applying a transfer bias can also be used instead of the above contact transferring means.

The flow of a replenishing developer in an image-forming apparatus using the developer will be described with reference to FIG. 6. Toner in a developing device 102 is consumed by the development of an electrostatic latent image on a photosensitive member with the toner. A toner concentration detecting sensor (not shown) detects the reduction of the toner in the developing device, whereby the developing device 102 is fed with the replenishing developer from a replenishing developer storing container 101. An excess magnetic carrier in the developing device moves toward a developer collecting container 104. It should be noted that the developer collecting container 104 may collect the toner collected by a cleaning unit 103 together.

<Method of Measuring Absorbance of Toner Per Unit Concentration>

50 mg of toner are weighed, and 50 ml of chloroform are added to the toner with a pipette to dissolve the toner. Further, the solution is diluted with chloroform five-hold, whereby a 0.2-mg/ml solution of the toner in chloroform is obtained. The solution of the toner in chloroform is defined as a sample for absorbance measurement. An ultraviolet and visible spectrophotometer V-500V (manufactured by JASCO Corporation) is used in the measurement, and the absorbance of the solution is measured in the wavelength range of 350 nm to 800 nm with a quartz cell having an optical path length of 10 mm. When the toner is a cyan toner, the absorbance is measured at a wavelength of 712 nm, when the toner is a magenta toner, the absorbance is measured at a wavelength of 538 nm, and, when the toner is a yellow toner, the absorbance is measured at a wavelength of 422 nm. The resultant absorbances are each divided by the toner concentration of the above chloroform solution, and absorbances per unit concentration (mg/ml) are calculated. The calculated values are represented by (A712/Cc), (A538/Cm), and (A422/Cy).

<Method of Measuring Triboelectric Charge Quantity of Toner by Two-Component Method>

9.2 g of a magnetic carrier are weighed in a 50-ml polybottle. 0.8 g of toner is weighed on the magnetic carrier, and the laminate of the magnetic carrier and the toner is subjected to moisture conditioning under a normal-temperature, normal-humidity environment (23° C., 60%) for 24 hours. After the moisture conditioning, the polybottle is capped, and is rotated with a roll mill fifteen times at a speed of one rotation per one second. Subsequently, the polybottle containing the sample is attached to a shaker, and is shaken at a stroke of 150 times/min so that the toner and the magnetic carrier are mixed for 5 minutes, whereby a developer for measurement is prepared.

A suction separation type charge quantity measuring device Sepasoft STC-1-C1 type (manufactured by SANKYO PIO-TECH. CO., Ltd.) is used as a device for measuring a triboelectric charge quantity. A mesh (metal gauze) having an aperture of 20 μm is placed at the bottom of a sample holder (Faraday cage), 0.10 g of the developer prepared as described above is placed on the mesh, and the holder is capped. The mass of the entirety of the sample holder at that time is weighed and represented by W1 (g). Next, the sample holder is installed in the main body of the apparatus, and a suction pressure is set to 2 kPa by adjusting an air quantity control valve. In this state, the toner is removed by suction for 2 minutes. Charge at that time is represented by Q (μC). In addition, the mass of the entirety of the sample holder after the suction is weighed and represented by W2 (g). Since Q determined at that time corresponds to the measured value for the charge of the carrier, the triboelectric charge quantity of the toner is opposite in polarity to Q. The absolute value for the triboelectric charge quantity (mC/kg) of the developer is calculated from the following equation. It should be noted that the measurement is also performed under the normal-temperature, normal-humidity environment (23° C., 60%). Triboelectric charge quantity (mC/kg)=Q/(W1−W2)

<Method of Measuring Adhesive Force Between Toner and Magnetic Carrier by Centrifugal Separation Method>

An adhesive force is measured on the basis of the method described in JP 2006-195079 A. Details about the measurement are as described below.

Figure 12:
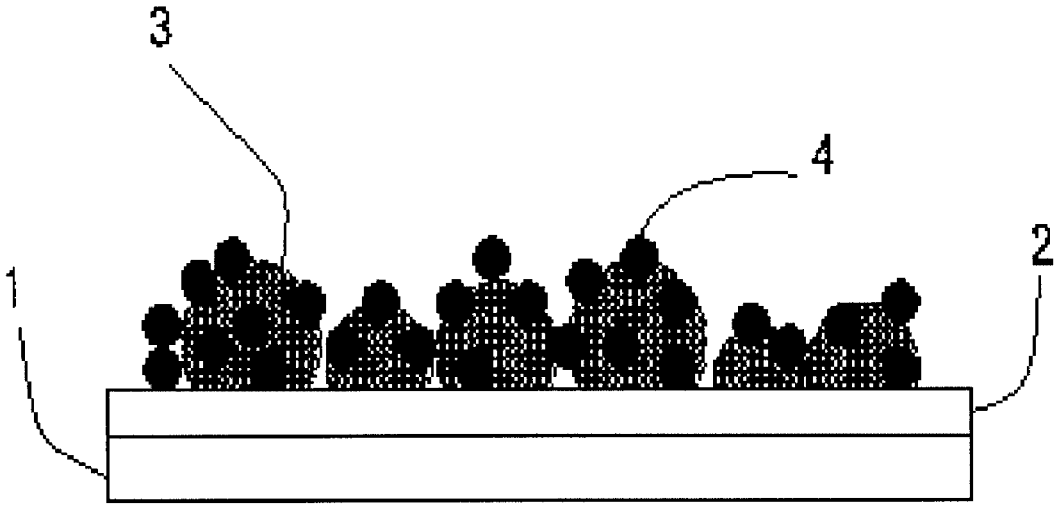
FIG. 12 is an outline view of a sample the adhesive force of which is measured.
Figure 13:
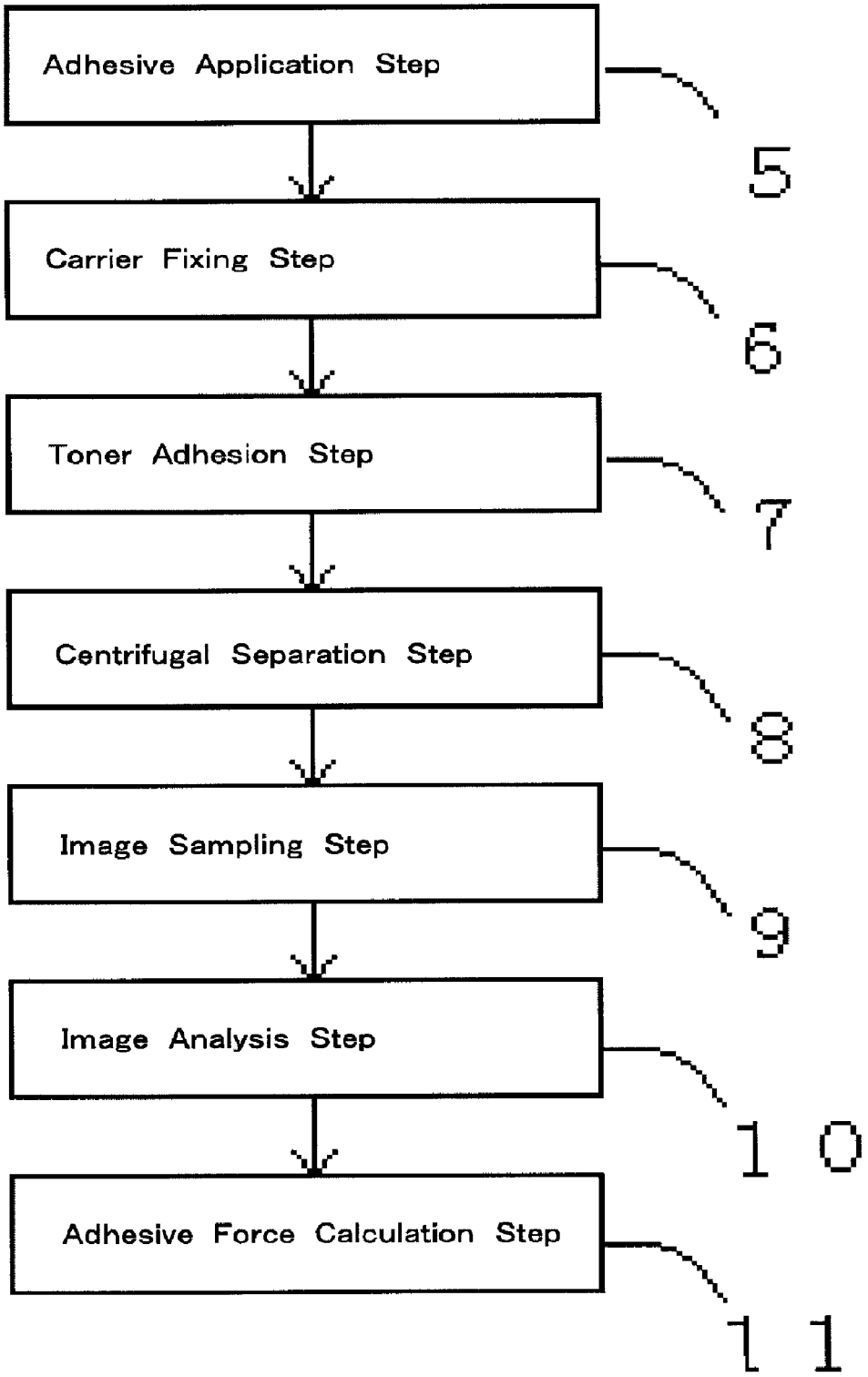
FIG. 13 is a view showing all steps for the measurement of the adhesive force.
Figure 14:
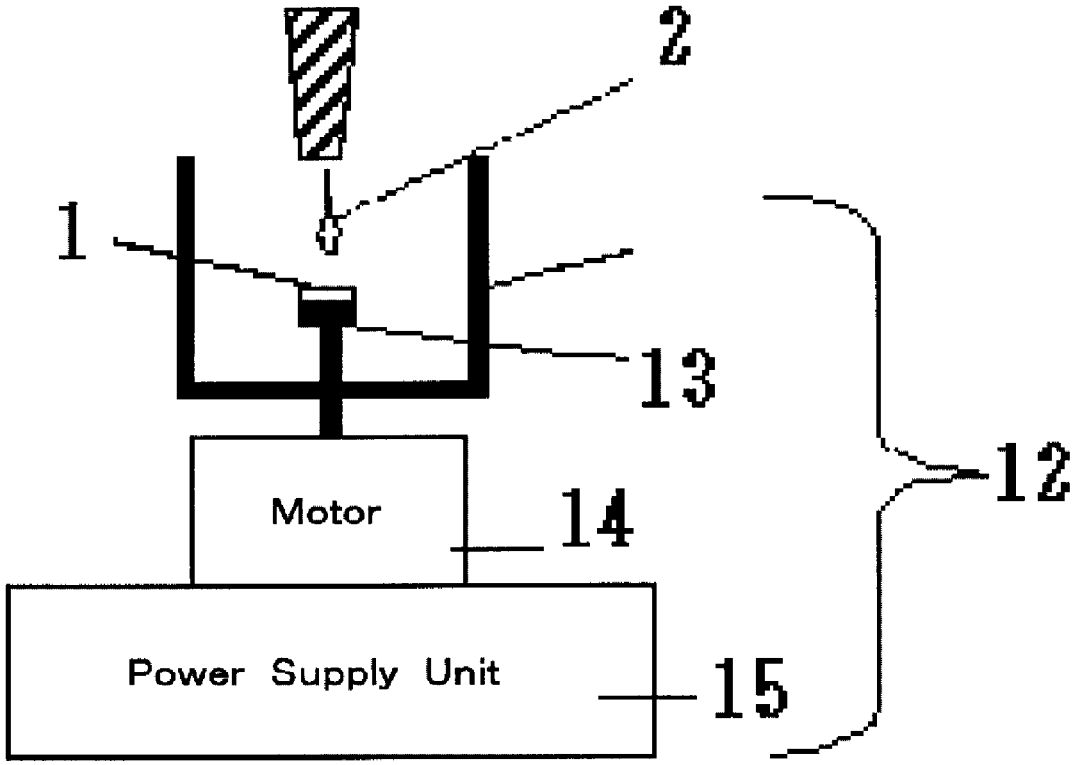
FIG. 14 is an outline view of a spin coater.

FIG. 12 is an outline view of a sample the adhesive force of which is measured according to the present invention. An adhesive 2 is uniformly applied to a circular sample substrate 1 (having a diameter of 10 mm) formed of aluminum, one layer of a carrier 3 is fixed to the adhesive, and the upper portion of the carrier is coated with a toner 4. FIG. 13 is a view showing all steps for the measurement of the adhesive force. In an adhesive application step 5, the adhesive 2 is applied to the sample substrate 1 with a spin coating apparatus. A spin coating apparatus 12 shown in FIG. 14 is formed of a seat 13, a motor 14 for rotating the seat 13, a power supply unit 15, and a cover 16 for preventing the scattering of the adhesive.

The adhesive 2 is an epoxy resin adhesive, and a "CEMEDINE HIGHSUPER 5" is used as the adhesive in this application. In addition, the adhesive is applied by being rotated for 60 seconds at about 10,000 rpm so that the adhesive having a thickness of about 20 μm is fixed to the sample substrate 1.

After the application of the adhesive 2, the measurement shifts to a carrier fixing step 6. The sample substrate 1 is removed from the seat 13, and the carrier 3 is sprinkled on the adhesive layer before the adhesive 2 cures. The resultant is left to stand in a state where the carrier is heaped to the extent possible until the adhesive 2 completely cures. The resultant is left to stand for 24 hours in each example to be described later.

Figure 15:
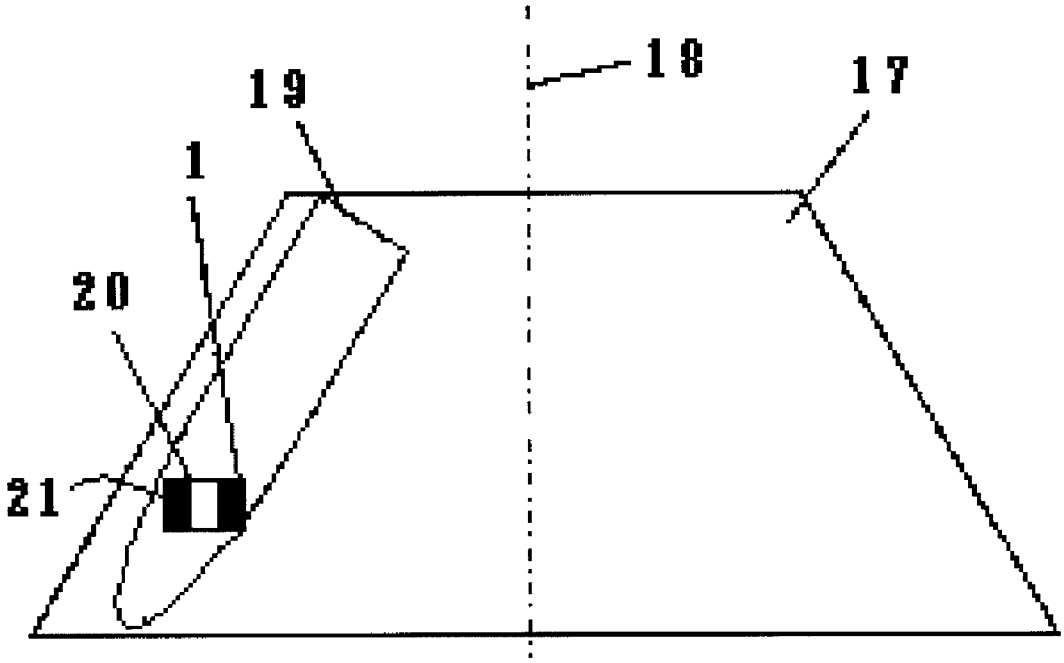
FIG. 15 is a schematic view showing the inside of the rotor of a centrifugal separator.

After that, as shown in FIG. 15, the sample substrate 1 is placed with its sample surface facing outward in a holder 19 placed in a rotor 17 for centrifugal separation so that the perpendicular of the sample surface of the sample substrate 1 may be perpendicular to a rotation axis 18. In addition, a receiving substrate 21 is placed through a product having a hollow central portion like a spacer 20 so as to be parallel to the sample substrate 1 and be outside with respect to the sample substrate 1. In this state, the rotor is provided with a sufficient number of revolutions. At that time, the rotor is desirably provided with the maximum number of revolutions of a centrifugal separator to be used. The centrifugal separator used in this application is a CP100MX manufactured by Hitachi Koki Co., Ltd. (maximum rotational rate: 100,000 rpm, maximum centrifugal acceleration 803,000×g), and an Angle Rotor P100AT manufactured by Hitachi Koki Co., Ltd. is used as the rotor. A centrifugal force generated by the centrifugal separation can remove the redundant carrier 3 out of contact with the adhesive 2, and can prevent the liberation of the carrier from the sample substrate 1 upon centrifugal separation while the toner 4 is caused to adhere to the carrier. The calculation of the magnitude of the centrifugal force will be described later. Thus, a sample to which one layer of the carrier, or the carrier in a state close to the layer, has been fixed is produced.

Next, a toner adhesion step 7 is performed. In the step, the following work is performed: the charged toner 4 is caused to adhere to the sample substrate 1 to which the carrier 3 has been fixed. In ordinary cases, a carrier and toner charge each other in a triboelectric manner in a developing device, whereby the carrier and the toner are charged so as to be opposite in polarity, and adhere to each other. The following operation is performed in order that a state close to the foregoing may be realized. First, the toner 4 and the carrier 3 are weighed and taken in a polybottle so that a toner concentration is 4, 6, 8, 10, 12, or 14 mass %, and, thereafter, are stored under a normal-temperature, normal-humidity (23° C., 50% RH) environment for 24 hours. After that, the polybottle containing the weighed sample is attached to a shaker, and is shaken at a stroke of 150 times/min so that the toner and the magnetic carrier are mixed for 5 minutes, whereby a developer 22 having each toner concentration is obtained.

Figure 16:
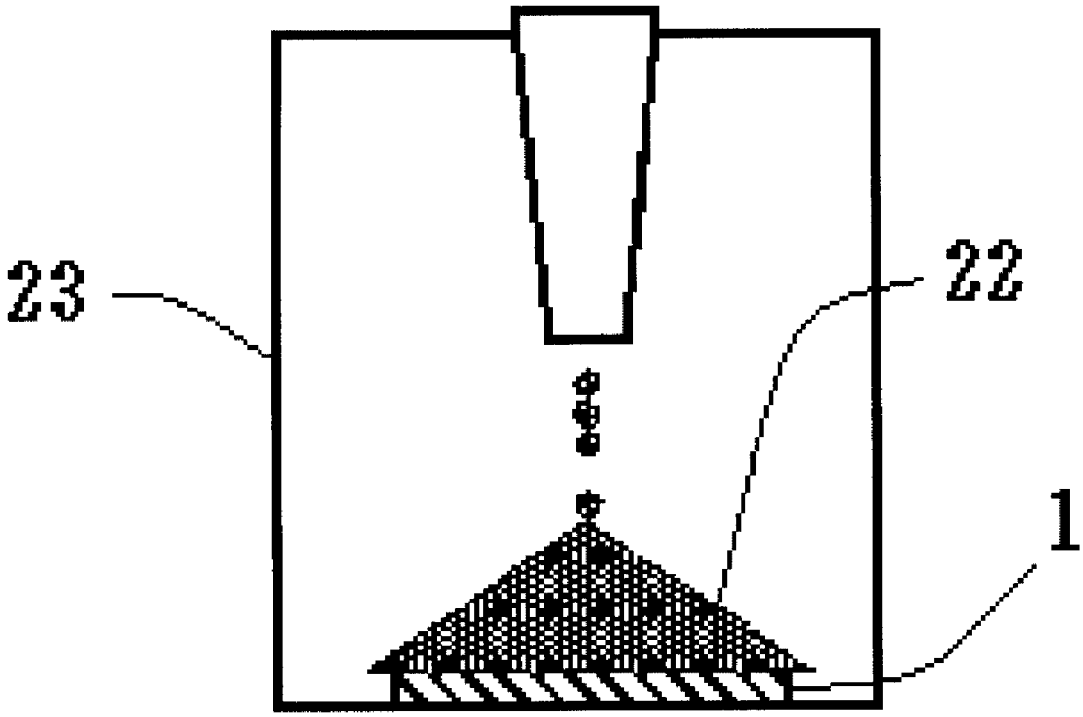
FIG. 16 is a view showing a toner adhesion step.

After that, as shown in FIG. 16, the sample substrate 1 is stuck to the bottom portion of a container 23, and the developer 22 is sufficiently charged on the sample substrate until the sample substrate hides. The container 23 is shaken with a hand well so that the developer 22 is brought into contact with the carrier 3 present on the surface of the sample substrate 1. As a result, the toner 4 in the developer 22 moves onto the carrier 3 present on the surface of the sample substrate 1, whereby the sample substrate 1 to which the toner 4 has adhered is obtained. The states of the toner and the carrier on the sample substrate 1 are close to a relationship between toner and a carrier in a general developer.

After the performance of the toner adhesion step 7, the measurement enters a centrifugal separation step 8. The produced sample substrate 1 and the receiving substrate 21 are loaded into the holder 19 placed in the rotor 17 for centrifugal separation as described above, and the rotor 17 is rotated. At that time, a mark or the like is placed in advance at one site of each of the sample substrate 1 and the receiving substrate 21, and, upon loading into the holder 19, the orientation of the mark or the like is always regulated. In addition, a distance between the receiving substrate 21 and the measurement sample substrate 1 is preferably as short as possible; the distance is 2 mm in this application.

Figure 17:
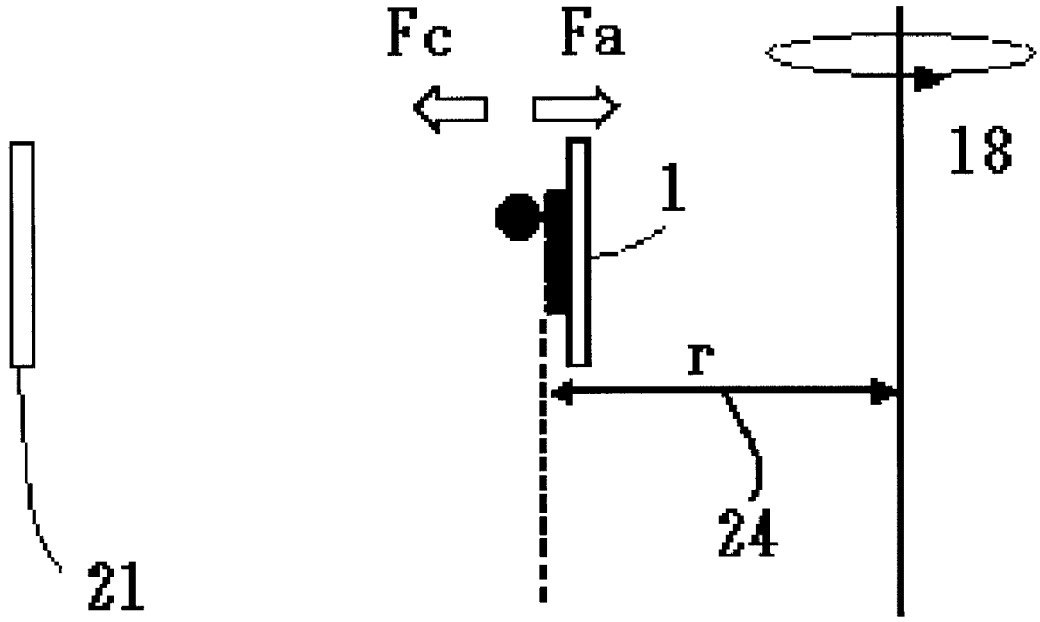
FIG. 17 is a view showing the outline of the principle of a centrifugal separation method.

The centrifugal separator is driven and the rotor 17 is rotated, whereby powders in a measurement cell each receive a centrifugal force in accordance with the size and mass of the powder. FIG. 17 shows an outline view of the principle of a centrifugal separation method. Reference symbol Fa represents an adhesive force, and reference symbol Fc represents a centrifugal force. The toner 4 on the measurement sample surface 1 receives a centrifugal force in accordance with each number of revolutions, and, when the centrifugal force acting on the toner 4 is larger than the adhesive force of the toner with respect to the measurement sample surface 1, the toner 4 moves from the measurement sample surface 1 toward the receiving substrate 21. A centrifugal force F' (N) received by a particle having a mass of m (kg) is determined from the following equation (1) when the number of revolutions of the rotor is represented by f (rpm) and a distance between the rotation axis 18 and the toner 4 on the measurement sample substrate 1 is represented by r (m) 24.

$$F'=m\times r\times(2\pi f/60)^2 \quad (1)$$

In addition, here, the mass m (kg) of the powder is determined from the following equation (2) by using a true specific gravity ρ (kg/m$^3$) and a circle-equivalent diameter d (m).

$$m=(4\pi/3)\times\rho\times(d/2)^3 \quad (2)$$

In the centrifugal separation step 8, the receiving substrate 21 is exchanged every certain number of revolutions (it is preferable that the substrate be exchanged when the number of revolutions is 5,000 rpm or 10,000 rpm, and, at a number of revolutions of 10,000 rpm or more, be exchanged every time the number of revolutions is increased by 2,000 rpm). The removed receiving substrate is observed with a microscope (at a magnification of about 1,000), and is photographed with a camera connected to the microscope. The circle-equivalent diameter of a particle on the substrate (the diameter of a circle having the same area as the projected area of the particle) is determined by analyzing the resultant image. It should be noted that, at the time of the analysis, the image may be additionally magnified as required. For example, when the number of revolutions of the rotor upon exchange is 1,000 rpm, f is set to 1,000, the mass m is calculated from the equation (2) by using the circle-equivalent diameter distribution of the toner obtained in the foregoing, and a centrifugal force acting on each particle is calculated from the equation (1) by using these values.

In addition, a number average common logarithmic value A of centrifugal forces is determined from the centrifugal force F' obtained as described above by using the following equation (3). A is a value obtained by dividing the sum of common logarithmic values for the centrifugal forces F' acting on the respective particles by the number N of toner particles.

$$A=\Sigma\log(F')/N \quad (3)$$

Then, an average adhesive force F at a certain toner concentration is obtained by using the following equation (4).

$$F=10^A \quad (4)$$

The resultant average adhesive forces of the developer at the respective toner concentrations are plotted versus the absolute values for the triboelectric charge quantity of the toner at the respective toner concentrations separately determined so that a graph where the axis of abscissa indicates the absolute value for the triboelectric charge quantity and the axis of ordinate indicates an average adhesive force is obtained. The plots are subjected to first-order linear approximation, and the adhesive force at which the absolute value for the triboelectric charge quantity is 50 mC/kg is calculated and defined as F(50).

<Methods of Measuring Lightness L* and Chroma C* of Toner in Powder State>

The lightness L* and chroma C* of toner in a powder state are measured by using a spectral color difference meter "SE-2000" (manufactured by NIPPON DENSHOKU INDUSTRIES CO., LTD.) in conformance with JIS Z-8722 with an observation light source of D50 at an observation view angle of 2°. The measurement is performed in accordance with the attached instruction manual; the standardization of a standard plate is desirably performed in a state where glass having a thickness of 2 mm and a diameter of 30 mm is placed in an optional cell for powder measurement.

To be more specific, the measurement is performed in a state where a cell filled with a sample powder is placed on a sample table for a powder sample (attachment) of the above spectral color difference meter. It should be noted that the cell is filled with the powder sample so that the powder sample accounts for 80% or more of the internal volume of the cell before the cell is placed on the sample table for a powder sample, and the measurement is performed while vibration is applied to the cell on a vibrating table at once/sec for 30 seconds.

<Method of Taking Magnetic Component (Porous Magnetic Core Particles) Out of Magnetic Carrier>

10.0 g of a magnetic carrier are prepared and loaded into a crucible. The crucible is heated with a muffle furnace mounted with an $N_2$ gas introduction port and an exhaust unit (FP-310, manufactured by Yamato Scientific Co., Ltd.) at 900° C. for 16 hours while an $N_2$ gas is introduced. After that, the crucible is left to stand until the temperature of the magnetic carrier becomes 50° C. or lower.

The magnetic carrier after the heating is loaded into a 50-cc polybottle, and 0.2 g of an alkylbenzene sulfonate and 20 g of water are added to the polybottle to wash off soot or the like adhering to the magnetic carrier. At that time, the magnetic carrier is rinsed while being fixed with a magnet lest the magnetic carrier should flow. In addition, the rinsing is performed with water five times or more lest the alkylbenzene sulfonate should remain on the magnetic carrier. After that, the magnetic carrier is dried at 60° C. for 24 hours, and a magnetic component is taken out of the magnetic carrier. It should be noted that the above operation is performed multiple times so that a needed amount of the magnetic component is secured.

<Method of Measuring Packed Bulk Density of Magnetic Component of Magnetic Carrier>

The packed bulk density of the magnetic component of the magnetic carrier is measured in accordance with JIS Z 2504. To be specific, the packed bulk density of the magnetic component of the magnetic carrier subjected to moisture conditioning under a normal-temperature, normal-humidity environment (23° C., 60%) for 24 hours is measured with a JIS bulk specific gravity measuring device (TSUTSUI SCIENTIFIC INSTRUMENTS CO., LTD.).

<Method of Measuring True Density of Magnetic Component of Magnetic Carrier>

The true density of the magnetic component of the magnetic carrier is measured with a dry automatic densimeter Autopicnometer (manufactured by Yuasa Ionics Inc.) under the following conditions.

Cell: SM cell (10 ml)

Sample amount: 2.0 g

The measurement method involves measuring the true density of solid or liquid on the basis of a vapor-phase substitution method. The vapor-phase substitution method, which is based on Archimedes' principle as in the case of a liquid-phase substitution method, shows high accuracy in measurement for a substance having a fine pore because a gas (argon gas) is used as a substitution medium.

<Specific Resistance of Magnetic Component (Porous Magnetic Core Particles) of Magnetic Carrier>

Figure 10:
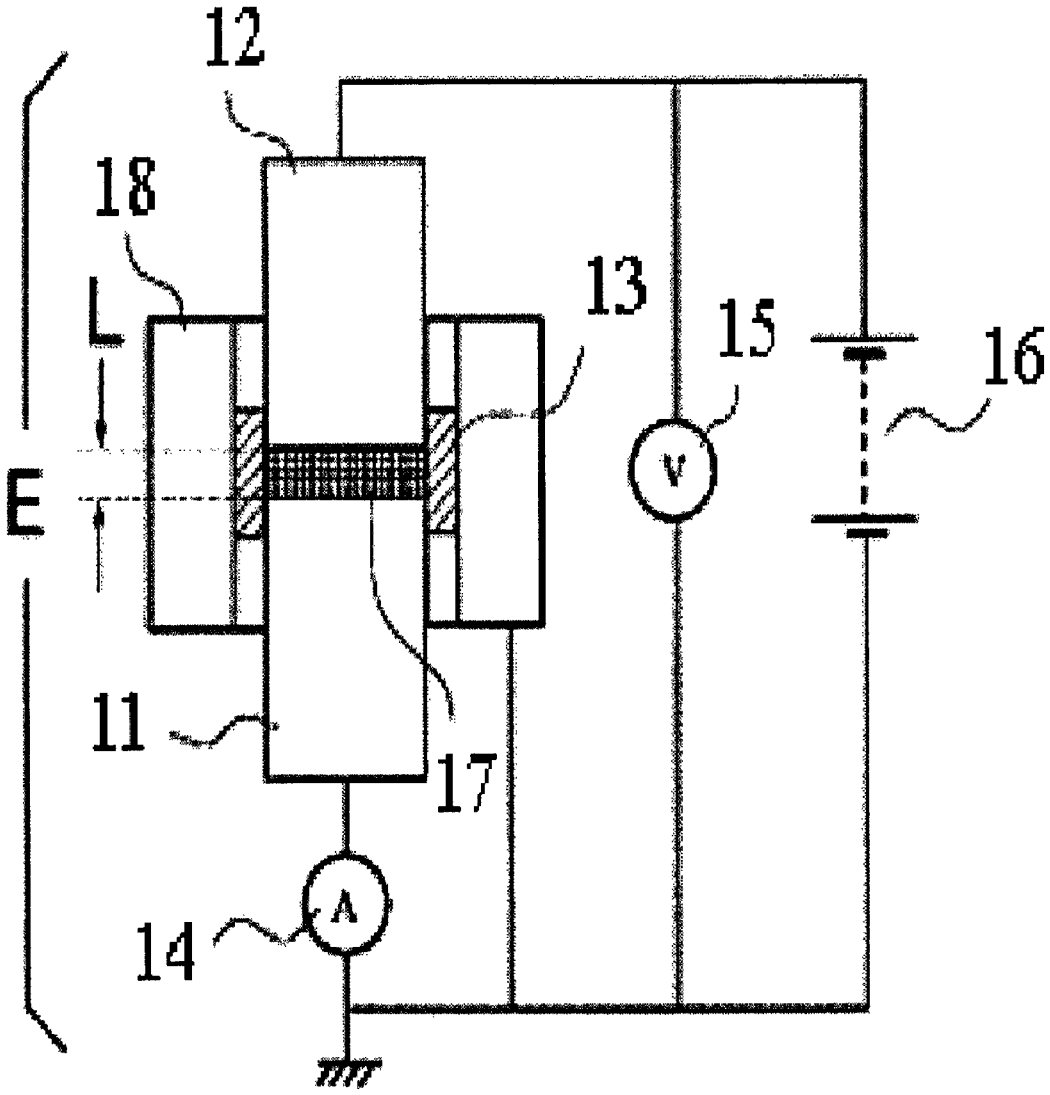
FIG. 10 is a view showing an example of the constitution of an apparatus for measuring the specific resistance of the magnetic component of a magnetic carrier.

The specific resistance of the magnetic component (porous magnetic core particles) of the magnetic carrier is measured with a measuring apparatus outlined in FIG. 10. A resistance measurement cell E is filled with a magnetic component 17 of a magnetic carrier, and a lower electrode 11 and an upper electrode 12 are placed so as to be in contact with the loaded magnetic component of the magnetic carrier. A voltage is applied between those electrodes, and the specific resistance of the magnetic component of the magnetic carrier is determined by measuring a current flowing at that time.

The above specific resistance is measured under the following conditions: a contact area S between the magnetic component and each electrode is 2.4 $cm^2$, and the load of the upper electrode is 240 g. 10.0 g of a sample (magnetic component) are weighed and loaded into the resistance measurement cell, and a thickness d of the sample is accurately measured. The voltage is applied under the following application conditions I, II, and III in the stated order, and a current at the applied voltage of the application condition III is measured. The specific resistance at an electric field intensity at the time of the application condition III of 100 V/cm (that is, when a value for the applied voltage divided by d equals 100 V/cm) is defined as the specific resistance of the magnetic component of the magnetic carrier.

Application Condition

I: (the voltage is changed from 0 V to 500 V: the voltage is increased by 100 V every 30 seconds in a stepwise manner)

II: (the voltage is held at 500 V for 30 seconds)

III: (the voltage is changed from 500 V to 0 V: the voltage is decreased by 100 V every 30 seconds in a stepwise manner)

$$\text{Specific resistance } (\Omega\cdot\text{cm}) = (\text{applied voltage (V)}/\text{measured current } (A)) \times S\ (\text{cm}^2)/d\ (\text{cm})$$

$$\text{Electric field intensity (V/cm)} = \text{applied voltage (V)}/d\ (\text{cm})$$

<Methods of Measuring Average Breaking Strength P1 of Magnetic Carrier Having Particle Diameter of D50−5 μm or More and D50+5 μm or Less and Average Breaking Strength P2 of Magnetic Carrier Having Particle Diameter of 10 μm or More and Less than 20 μm>

The average breaking strengths P1 and P2 of the magnetic carrier are measured with a microscopic compression tester MCTM-500 manufactured by Shimadzu Corporation in accordance with the operation manual of the measuring apparatus. Various settings of the measuring apparatus are as described below.

| | |
|---|---|
| Measurement mode | 1 (compression test) |
| Load | 300 mN |
| Load rate | 3.87 mN/sec |
| Displacement scale | 100 μm |
| Upper pressure indenter | flat indenter having a diameter of 50 μm |
| Lower pressure plate | SKS flat plate |

The magnetic carrier on the lower pressure plate is observed with the optical monitor of the apparatus. When the 50% particle diameter on a volume basis of the magnetic carrier is represented by D50, the magnetic carrier having a particle diameter of D50−5 μm or more and D50+5 μm or less is selected at random, and the breaking strengths of 100 corresponding particles are measured. The average of the breaking strengths is defined as the average breaking strength P1 (MPa).

It should be noted that, in the case of a carrier having a D50 of less than 25 μm, the magnetic carrier having a particle diameter of 20 μm or more and D50+5 μm or less is subjected to the same measurement, and the resultant value is defined as P1.

In addition, the magnetic carrier having a particle diameter of 10 μm or more and less than 20 μm is also selected at random, and the breaking strengths of 30 corresponding particles are measured. The average of the breaking strengths is defined as the average breaking strength P2 (MPa).

<Method of Measuring Weight-Average Particle Diameter of Toner Particles or Toner>

The weight-average particle diameter of the above toner particles or toner is measured with a Coulter Counter TA-II or Coulter Multisizer II (manufactured by Beckman Coulter, Inc) in accordance with the operation manual of the measuring apparatus. An aqueous solution of NaCl having a concentration of about 1% is used as an electrolyte solution. An electrolyte solution prepared by using first grade sodium chloride or, for example, an ISOTON (registered trademark)-II (manufactured by Coulter Scientific Japan, Co.) may be used as the electrolyte solution.

A method of measuring the weight-average particle diameter of the toner will be specifically described below. 0.1 g of a surfactant (preferably an alkylbenzene sulfonate) as a dispersant is added to 100 ml of the above electrolyte solution. Further, 5 mg of a sample to be measured (toner or toner particles) are added to the mixture. The electrolyte solution in which the sample has been suspended is subjected to a dispersion treatment with an ultrasonic dispersing unit for about 2 minutes, whereby a measurement sample is obtained.

A 100-μm aperture is used as an aperture. The volumes and number of sample particles are measured for each channel, and the volume and number distributions of the sample are calculated. The weight-average particle diameter of the sample is determined from the calculated distributions. The channels to be used have 13 channels, and each channel having a particle diameter range of 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm, respectively.

<Method of Measuring Number Average Particle Diameter (D1) of Inorganic Fine Particles or Fine Particles>

The number average particle diameter (D1) of the above inorganic fine particles or fine particles is measured with a scanning electron microscope FE-SEM (S-4700 manufactured by Hitachi, Ltd.) in accordance with the operation manual of the measuring apparatus. To be specific, a toner surface is photographed at a magnification of 100,000, and the resultant image is subjected to contrast adjustment and then binarization. The binarized image is additionally magnified, the longer diameters of 50 arbitrary particles are measured with a ruler or a caliper, and the number average particle diameter of the particles is calculated. At that time, an X-ray microanalyzer included with the above apparatus is used for the discrimination of the composition of a fine particle from that of any other particle.

<Measurement of Molecular Weight of Resin by Gel Permeation Chromatography (GPC)>

The molecular weight of a resin can be measured by GPC under the following conditions.

A column is stabilized in a heat chamber at 40° C. Tetrahydrofuran (THF) as a solvent is flowed into the column at the temperature at a flow rate of 1 ml/min, and 100 μl of a THF sample solution of a resin having a sample concentration adjusted to 0.5 mass % are injected for measurement. A refractive index (RI) detector is used as a detector. A combination of multiple commercially available polystyrene gel columns is preferably used as a column for accurately measuring a molecular weight region of $1\times10^3$ to $2\times10^6$. Preferable examples of the combination of commercially available polystyrene gel columns include: a combination of μ-styragel 500, 103, 104, and 105 manufactured by Waters Corporation; and a combination of shodex KA-801, 802, 803, 804, 805, 806, and 807 manufactured by Showa Denko K.K.

In measuring the molecular weight of the resin as a sample, the molecular weight distribution possessed by the resin is calculated from a relationship between a logarithmic value for a calibration curve prepared by several kinds of monodisperse polystyrene standard samples and the number of counts. Examples of the standard polystyrene samples for preparing a calibration curve to be used include samples manufactured by Pressure Chemical Co. or by TOSOH CORPORATION each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, or $4.48\times10^6$. At least about ten standard polystyrene samples are suitably used.

<Measurement of Average Circularity of Toner>

The average circularity of toner is measured with a flow-type particle image analyzer "FPIA-3000 type" (manufactured by SYSMEX CORPORATION) in accordance with the operation manual of the measuring apparatus under the same measurement and analysis conditions as those at the time of a calibration operation.

Specifically, optimum amount of a surfactant (preferably alkylbenzene sulfonate) is added as a dispersant to 20 ml of ion-exchanged water, and then 0.02 g of measurement sample is added to and uniformly dispersed into the mixture. The resultant mixture is subjected to a dispersion treatment for 2 minutes by using a bench ultrasonic washing disperser with a maximum oscillation frequency of 50 KHz and electrical output of 150 W (such as "VS-150" (manufactured by VELVO CLEAR CO., LTD.) to prepare a dispersion liquid for measurement. At that time, the dispersion liquid is appropriately cooled in order that the temperature of the dispersion liquid may be 10° C. or higher and 40° C. or lower.

The flow-type particle image analyzer mounted with a standard objective lens (at a magnification of 10) is used in the measurement, and a particle sheath "PSE-900A" (manufactured by SYSMEX CORPORATION) is used as a sheath liquid. The dispersion liquid prepared in accordance with the procedure is introduced into the flow-type particle image analyzer, and the particle diameters of 3,000 toner particles are measured according to the total count mode of an HPF measurement mode. The average circularity of the toner is determined with a binarization threshold at the time of particle analysis set to 85% and particle diameters to be analyzed limited to ones each corresponding to a circle-equivalent diameter of 2.00 μm or more and 200.00 μm or less.

Prior to the initiation of the measurement, automatic focusing is performed by using standard latex particles (obtained by diluting, for example, a 5200A manufactured by Duke Scientific with ion-exchanged water). After that, focusing is preferably performed every two hours from the initiation of the measurement.

It should be noted that, in each example of the description, a flow-type particle image analyzer which has been subjected to a calibration operation by SYSMEX CORPORATION, and which has received a calibration certificate issued by SYSMEX CORPORATION is used, and the measurement is performed under measurement and analysis conditions identical to those at the time of the reception of the calibration certificate except that particle diameters to be analyzed are limited to ones each corresponding to a circle-equivalent diameter of 2.00 μm or more and 200.00 μm or less.

The measurement principle of the flow-type particle image analyzer "FPIA-3000 type" (manufactured by SYSMEX CORPORATION) is as follows: flowing particles are photographed as a static image, and the image is analyzed. A sample added to a sample chamber is transferred to a flat sheath flow cell with a sample sucking syringe. The sample transferred to the flat sheath flow cell is sandwiched between sheath liquids to form a flat flow. The sample passing through the inside of the flat sheath flow cell is irradiated with stroboscopic light at an interval of 1/60 second, whereby flowing particles can be photographed as a static image. In addition, the particles are photographed in focus because the flow of the particles is flat. A particle image is photographed with a CCD camera, and the photographed image is subjected to image processing at an image processing resolution of 512×512 pixels (each measuring 0.37 μm by 0.37 μm) so that the border of each particle image is sampled. Then, the projected area, perimeter, and the like of each particle image are measured.

Next, a circle-equivalent diameter and a circularity are determined by using values for the particle projected area of each measured particle image and the perimeter of a particle projected image. The circle-equivalent diameter is defined as the diameter of a circle having the same area as that of the projected area of a particle image, the circularity is defined as a value obtained by dividing the perimeter of a circle determined from the circle-equivalent diameter by the perimeter of a particle projected image, and the circle-equivalent diameter and the circularity are calculated from the following equations.

$$\text{Circle-equivalent diameter}=(\text{particle projected area}/\pi)^{1/2}\times2$$

$$\text{Circularity}=(\text{perimeter of circle having same area as particle projected area})/(\text{perimeter of particle projected image})$$

When a particle image is of a circular shape, the circularity of the particle in the image becomes 1. As the degree of surface unevenness in the outer periphery of the particle image increases, the circularity shows a reduced value. After the circularities of the respective particles have been calculated, circularities in the range of 0.2 to 1.0 are divided into 800 sections, and the average circularity of the particles is calculated by dividing the circularities in the sections by the number of measured particles.

<Measurement of Bet Specific Surface Area>

The BET specific surface area of a fine particle is calculated by employing a BET multipoint method with a specific surface area measuring apparatus AUTOSORB 1 (manufactured by Yuasa Ionics Inc.) while causing a nitrogen gas to adsorb to the sample surface according to a BET method.

<Method of Measuring 50% Particle Diameter on Volume Basis (D50) of Magnetic Carrier>

The 50% particle diameter on a volume basis (D50) of a magnetic carrier is measured with, for example, a multi-image analyzer (manufactured by Beckman Coulter, Inc) as described below. A solution prepared by mixing an aqueous solution of NaCl having a concentration of about 1% and glycerin at 50 vol %:50 vol % is used as an electrolyte solution. Here, the aqueous solution of NaCl has only to be prepared by using first grade sodium chloride, or, for example, an ISOTON (registered trademark)-II (manufactured by Coulter Scientific Japan, Co.) may also be used as the aqueous solution. Glycerin has only to be a reagent grade or first grade reagent. 0.5 ml of a surfactant (preferably sodium dodecylbenzenesulfonate) as a dispersant is added to the electrolyte solution (about 30 ml). Further, 10 mg of a measurement sample are added to the mixture. The electrolyte solution in which the sample has been suspended is subjected to a dispersion treatment with an ultrasonic dispersing unit for about 1 minute, whereby a dispersion liquid is obtained. The electrolyte solution and the dispersion liquid are charged into a glass measurement container, and the concentration of magnetic carrier particles in the measurement container is set to 10 vol %. The contents in the glass measurement container are stirred at the maximum stirring speed. A suction pressure for the sample is set to 10 kPa. When each of the magnetic carrier particles has so large a specific gravity as to be apt to sediment, a time period for the measurement is set to 20 minutes. In addition, the measurement is suspended every 5 minutes, and the container is replenished with the sample liquid and the mixed solution of the electrolyte solution and glycerin.

The settings of the apparatus, which uses a 200-μm aperture as an aperture and a lens having a magnification of 20, are as shown below. It should be noted that the number of measured particles is 2,000.

| | |
|---|---|
| Average brightness in measurement frame: | 220 to 230 |
| Measurement frame setting: | 300 |
| Threshold (SH): | 50 |
| Binarization level: | 180 |

After the completion of the measurement, blurred images, agglomerated particles (multiple particles are simultaneously subjected to measurement), and the like are removed from a particle image screen with software in the main body of the apparatus.

The circle-equivalent diameter of the magnetic carrier is calculated from the following equation.

$$\text{Circle-equivalent diameter}=(4\cdot\text{Area}/\pi)^{1/2}$$

The term "Area" as used herein is defined as the projected area of a binarized particle image, while the term "Max-Length" as used herein is defined as the maximum diameter of the particle image. A circle-equivalent diameter is represented as the diameter of a true circle when the "Area" is regarded as the area of the true circle. The resultant individual circle-equivalent diameters are classified into 256 divisions ranging from 4 to 100 μm, and are plotted on a logarithmic graph on a volume basis, whereby a 50% particle diameter on a volume basis (D50) is determined.

EXAMPLES

Hereinafter, the present invention will be described more specifically by way of specific production examples and examples. However, the present invention is not limited to these examples alone.

Production Example of Resin A

Hybrid Resin

A dropping funnel was loaded with 1.9 mol of styrene, 0.21 mol of 2-ethylhexyl acrylate, 0.15 mol of fumaric acid, 0.03 mol of a dimer of α-methylstyrene, and 0.05 mol of dicumyl peroxide each serving as a monomer for a vinyl polymer. In addition, a 4-L four-necked flask formed of glass was loaded with 7.0 mol of polyoxypropylene(2.2)-2,2-bis(4-hydroxyphenyl)propane, 3.0 mol of polyoxyethylene(2.2)-2,2-bis(4-hydroxyphenyl)propane, 3.0 mol of terephthalic acid, 2.0 mol of trimellitic anhydride, 5.0 mol of fumaric acid, and 0.2 g of dibutyltin oxide. A temperature gauge, a stirring rod, a condenser, and a nitrogen introducing pipe were installed on the four-necked flask, and the flask was placed in a mantle heater. Next, air in the flask was replaced with a nitrogen gas, and then the flask was gradually heated while the mixture in the flask was stirred. Then, the monomers for a vinyl resin and a polymerization initiator were dropped from the dropping funnel over 5 hours to the flask while the mixture in the flask was stirred at a temperature of 145° C. Next, the temperature of the mixture was increased to 200° C., and then the mixture was subjected to a reaction at 200° C. for 4.5 hours, whereby a hybrid resin (Resin A) was obtained. Table 1 shows the result of the measurement of the molecular weight of the resin by gel permeation chromatography (GPC). It should be noted that, in Table 1, Mw represents a weight-average molecular weight, Mn represents a number average molecular weight, and Mp represents a peak molecular weight.

TABLE 1

| | Mw | Mn | Mw/Mn | Mp |
|---|---|---|---|---|
| Resin A | 66,000 | 4,500 | 15 | 7,500 |

Production Example of Inorganic Fine Particles

A dispersion medium prepared by mixing methanol, water, and ammonia water was heated to 35° C., and tetramethoxysilane was dropped to the dispersion medium while the dispersion medium was stirred, whereby a suspension of silica fine particles was obtained. The solvent of the suspension was replaced, and hexamethyldisilazane as a hydrophobic treatment agent was added to the resultant dispersion liquid at room temperature. After that, the mixture was heated to 130° C. and subjected to a reaction, whereby a hydrophobic treatment for a silica fine particle surface was performed. The resultant was passed through a wet sieve so that coarse particles were removed. After that, the solvent was removed, and the remainder was dried, whereby inorganic fine particles (sol-gel silica fine particles) were obtained. The inorganic fine particles had a number average particle diameter of 76 nm. In the same manner, inorganic fine particles (sol-gel silica fine particles) having a number average particle diameter of 84 nm, 110 nm, 290 nm, or 310 nm were prepared by appropriately changing a reaction temperature and a stirring speed.

[Production of Magenta Toner 1]

| <Production of magenta master batch> | |
|---|---|
| Resin A (for master batch) | 60 parts by mass |
| Magenta pigment (C.I. Pigment Red 57) | 20 parts by mass |
| Magenta pigment (C.I. Pigment Red 122) | 20 parts by mass |
| The above materials were melted and kneaded with a kneader mixer, whereby a magenta master batch was produced. | |
| <Production of magenta toner> | |
| Resin A | 88.3 parts by mass |
| Refined paraffin wax (highest endothermic peak: 70° C., Mw = 450, Mn = 320) | 5.0 parts by mass |
| Above magenta master batch (colorant content 40 mass %) | 19.5 parts by mass |
| Aluminum compound of 3,5-di-t-butylsalicylic acid (negative charge control agent) | 1.0 part by mass |

Preliminary mixing was sufficiently performed with a Henschel mixer in accordance with the above formulation. The resultant was melted and kneaded with a biaxial extruding kneader so that the temperature of the kneaded product was 150° C. After having been cooled, the resultant was coarsely pulverized with a hammer mill into particles each having a particle diameter of about 1 to 2 mm. After that, the particles were pulverized with the hammer mill with its hammer shape changed, and coarse particles were removed with a mesh, whereby coarsely pulverized products each having a particle diameter of about 0.3 mm were produced. Next, the coarsely pulverized products were formed into moderately pulverized products each having a particle diameter of about 11 μm with a Turbo mill (RS rotor/SNB liner) manufactured by Turbo Kogyo Co., Ltd. Further, the moderately pulverized products were pulverized with a Turbo mill (RSS rotor/SNNB liner) manufactured by Turbo Kogyo Co., Ltd. into particles each having a particle diameter of about 6 μm, and then the particles were formed into finely pulverized products each having a particle diameter of about 5 μm with the Turbo mill (RSS rotor/SNNB liner) again. After that, the resultant finely pulverized products were subjected to classification and sphering at the same time with a particle design apparatus manufactured by Hosokawa Micron Corporation (product name: Faculty) with the shapes and number of its hammers improved, whereby magenta toner particles 1 having a weight-average particle diameter of 5.3 μm were obtained.

0.9 part by mass of an anatase-type titanium oxide fine powder (BET specific surface area 80 $m^2/g$, number average particle diameter (D1): 15 nm, treated with 12 mass % of isobutyltrimethoxysilane) was externally added to 100 parts by mass of the above magenta toner particles 1 with a Henschel mixer. Next, 1.2 parts by mass of oil-treated silica fine particles (BET specific surface area 95 $m^2/g$, treated with 15 mass % of silicone oil) and 1.5 parts by mass of the above inorganic fine particles (sol-gel silica fine particles: BET specific surface area 24 $m^2/g$, number average particle diameter (D1): 110 nm) were loaded into the Henschel mixer to be externally added to the mixture, whereby Magenta Toner 1 was obtained. Table shows the physical property values of Magenta Toner 1.

[Production of Magenta Toners 2 to 8]

Magenta Toners 2 to 8 were each produced in the same manner as in the above production of Magenta Toner 1 except that a compounding ratio among Resin A, the refined paraffin wax, the magenta master batch, and the aluminum compound of di-t-butylsalicylic acid was changed as shown in Table 3. Table 2 shows the physical property values of Magenta Toners 2 to 8.

[Production of Yellow Toner 1]

| <Production of yellow master batch> | |
|---|---|
| Resin A | 60 parts by mass |
| Yellow pigment (C.I. Pigment Yellow 17) | 40 parts by mass |
| The above materials were melted and kneaded with a kneader mixer, whereby a yellow master batch was produced. | |
| <Production of yellow toner> | |
| Resin A | 89.5 parts by mass |
| Refined paraffin wax (highest endothermic peak: 70° C., Mw = 450, Mn = 320) | 5.0 parts by mass |
| Above yellow master batch (colorant content 40 mass %) | 17.5 parts by mass |
| Aluminum compound of 3,5-di-t-butylsalicylic acid (negative charge control agent) | 1.0 part by mass |

Yellow Toner 1 was obtained in the same manner as in the production example of Magenta Toner 1 in accordance with the above formulation. Table 2 shows the physical property values of Yellow Toner 1.

[Production of Yellow Toners 2 to 7]

Yellow Toners 2 to 7 were each produced in the same manner as in the above production of Yellow Toner 1 except that a compounding ratio among Resin A, the refined paraffin wax, the yellow master batch, and the aluminum compound of di-t-butylsalicylic acid was changed as shown in Table 3. Table 2 shows the physical property values of Yellow Toners 2 to 7.

[Production of Cyan Toner 1]

| <Production of cyan master batch> | |
|---|---|
| Resin A | 60 parts by mass |
| Cyan pigment (C.I. Pigment Blue 15:3) | 40 parts by mass |
| The above materials were melted and kneaded in accordance with the above formulation, whereby a cyan master batch was produced. | |
| <Production of cyan toner> | |
| Resin A | 92.6 parts by mass |
| Refined paraffin wax (highest endothermic peak: 70° C., Mw = 450, Mn = 320) | 5.0 parts by mass |
| cyan master batch (colorant content 40 mass %) | 12.4 parts by mass |
| Aluminum compound of 3,5-di-t-butylsalicylic acid (negative charge control agent) | 1.0 part by mass |

Cyan Toner 1 was obtained in the same manner as in the production example of Magenta Toner 1 in accordance with the above formulation. Table 2 shows the physical property values of Cyan Toner 1.

[Production of Cyan Toner 2]

Cyan Toner 2 was produced in the same manner as in the above production of Cyan Toner 1 except that the amount of Resin A was changed to 91.6 parts by mass and the amount of the cyan master batch was changed to 14.1 parts by mass. Table 2 shows the physical property values of Cyan Toner 2.

[Production of Cyan Toner 3]

Cyan Toner 3 was produced in the same manner as in the above production of Cyan Toner 1 except that the amount of Resin A was changed to 89.9 parts by mass and the amount of the cyan master batch was changed to 16.9 parts by mass. Table 2 shows the physical property values of Cyan Toner 3.

[Production of Cyan Toner 4]

Cyan Toner 4 was produced in the same manner as in the above production of Cyan Toner 1 except that the amount of Resin A was changed to 86.5 parts by mass and the amount of the cyan master batch was changed to 22.5 parts by mass. Table 2 shows the physical property values of Cyan Toner 4.

[Production of Cyan Toner 5]

Cyan Toner 5 was produced in the same manner as in the above production of Cyan Toner 4 except that 1.5 parts by mass of the above inorganic fine particles (sol-gel silica fine particles; BET specific surface area 34 $m^2/g$) having a number average particle diameter (D1) of 76 nm were added instead of the inorganic fine particles having a number average particle diameter (D1) of 110 nm. Table 2 shows the physical property values of Cyan Toner 5.

[Production of Cyan Toner 6]

Cyan Toner 6 was produced in the same manner as in the above production of Cyan Toner 4 except that 1.5 parts by mass of the above inorganic fine particles (sol-gel silica fine particles; BET specific surface area 32 $m^2/g$) having a number average particle diameter (D1) of 84 nm were added instead of the inorganic fine particles having a number average particle diameter (D1) of 110 nm. Table 2 shows the physical property values of Cyan Toner 6.

[Production of Cyan Toner 7]

Cyan Toner 7 was produced in the same manner as in the above production of Cyan Toner 4 except that 1.5 parts by mass of a fumed silica (BET specific surface area 10 $m^2/g$) having a number average particle diameter (D1) of 280 nm were added instead of the inorganic fine particles having a number average particle diameter (D1) of 110 nm. Table 2 shows the physical property values of Cyan Toner 7.

[Production of Cyan Toner 8]

Cyan Toner 8 was produced in the same manner as in the above production of Cyan Toner 4 except that 1.5 parts by mass of the above inorganic fine particles (sol-gel silica fine particles; BET specific surface area 9.1 $m^2/g$) having a number average particle diameter (D1) of 290 nm were added instead of the inorganic fine particles having a number average particle diameter (D1) of 110 nm. Table 2 shows the physical property values of Cyan Toner 8.

[Production of Cyan Toner 9]

Cyan Toner 9 was produced in the same manner as in the above production of Cyan Toner 4 except that 1.5 parts by mass of the above inorganic fine particles (sol-gel silica fine particles; BET specific surface area 8.5 $m^2/g$) having a number average particle diameter (D1) of 310 nm were added instead of the inorganic fine particles having a number average particle diameter (D1) of 110 nm. Table 2 shows the physical property values of Cyan Toner 9.

[Production of Cyan Toner 10]

Cyan Toner 10 was produced in the same manner as in the above production of Cyan Toner 1 except that the amount of Resin A was changed to 83.1 parts by mass, the amount of the cyan master batch was changed to 28.1 parts by mass, and 1.5 parts by mass of the above inorganic fine particles (sol-gel silica fine particles; BET specific surface area 9.1 $m^2/g$) having a number average particle diameter (D1) of 290 nm were added instead of the inorganic fine particles having a number average particle diameter (D1) of 110 nm. Table 2 shows the physical property values of Cyan Toner 10.

[Production of Cyan Toner 11]

Cyan Toner 11 was produced in the same manner as in the production example of Cyan Toner 10 except that the temperature of the kneaded product produced by the biaxial extruding kneader was changed to 110° C. Table 2 shows the physical property values of Cyan Toner 11.

[Production of Cyan Toner 12]

Cyan Toner 12 was produced in the same manner as in the above production of Cyan Toner 11 except that the amount of Resin A was changed to 79.8 parts by mass and the amount of the cyan master batch was changed to 33.8 parts by mass. Table 2 shows the physical property values of Cyan Toner 12.

[Production of Cyan Toner 13]

Cyan Toner 13 was produced in the same manner as in the above production of Cyan Toner 12 except that a heat sphering treatment was performed at a heat treatment temperature of 250° C. with a Meteorainbow (manufactured by Nippon Pneumatic Mfg. Co., Ltd.) instead of classification and sphering with the particle design apparatus manufactured by Hosokawa Micron Corporation (product name: Faculty) and classification was performed with an elbow jet classifier. Table 2 shows the physical property values of Cyan Toner 13.

[Production of Cyan Toner 14]

Cyan Toner 14 was produced in the same manner as in the above production of Cyan Toner 13 except that the heat treatment temperature in the heat sphering treatment with the Meteorainbow (manufactured by Nippon Pneumatic Mfg. Co., Ltd.) was increased by 50° C. Table 2 shows the physical property values of Cyan Toner 14.

[Production of Cyan Toner 15]

Cyan Toner 15 was produced in the same manner as in the above production of Cyan Toner 12 except that, after the coarse pulverization with the hammer mill to provide particles each having a particle diameter of about 1 to 2 mm, the particles were formed into the finely pulverized products each having a particle diameter of about 5 μm with the Turbo mill (RS rotor/SNNB liner) in one stroke. Table 2 shows the physical property values of Cyan Toner 15.

[Production of Cyan Toner 16]

Cyan toner particles were produced in the same manner as in the above production of Cyan Toner 15 except that, with regard to conditions for the treatment with the particle design apparatus manufactured by Hosokawa Micron Corporation (product name: Faculty), the number of dispersion rotations was reduced in half.

0.9 part by mass of an anatase-type titanium oxide fine powder (BET specific surface area 80 $m^2/g$, treated with 12 mass % of isobutyltrimethoxysilane) was externally added to 100 parts by mass of the resultant cyan toner particles with a Henschel mixer. Further, 2.5 parts by mass of oil-treated silica (BET specific surface area 147 $m^2/g$, treated with 15 mass % of silicone oil) and 0.5 part by mass of the above inorganic fine particles (sol-gel silica fine particles: number average particle diameter (D1): 290 nm) were loaded into the Henschel mixer to be externally added to the mixture, whereby Cyan Toner 16 was obtained. Table 2 shows the physical property values of Cyan Toner 16.

[Production of Cyan Toner 17]

1.0 part by mass of an anatase-type titanium oxide fine powder (BET specific surface area 80 $m^2/g$, treated with 12 mass % of isobutyltrimethoxysilane) was externally added to 100 parts by mass of the cyan toner particles obtained in the above production of Cyan Toner 16 with a Henschel mixer. Further, 0.5 part by mass of oil-treated silica (BET specific surface area 95 $m^2/g$, treated with 15 mass % of silicone oil), and 1.5 parts by mass of the above inorganic fine particles (sol-gel silica fine particles: number average particle diameter (D1): 290 nm) were loaded into the Henschel mixer to be externally added to the mixture, whereby Cyan Toner 17 was obtained. Table 2 shows the physical property values of Cyan Toner 17.

[Production of Cyan Toner 18]

0.5 part by mass of an anatase titanium oxide fine powder (BET specific surface area 80 $m^2/g$, treated with 12 mass % of isobutyltrimethoxysilane) was externally added to 100 parts by mass of the cyan toner particles obtained in the above production of Cyan Toner 13 with a Henschel mixer. Further, 0.5 part by mass of a rutile-type titanium oxide fine powder (BET specific surface area 33 $m^2/g$ isobutyltrimethoxysilane/trifluoropropyltrimethoxysilane=6 mass %/6 mass %, number average particle diameter (D1): 35 nm, 0.5 part by mass of oil-treated silica (BET specific surface area 95 $m^2/g$, treated with 15 mass % of silicone oil), and 1.5 parts by mass of the above inorganic fine particles (sol-gel silica fine particles: number average particle diameter (D1): 290 nm) were sequentially loaded into the Henschel mixer to be externally added to the mixture, whereby Cyan Toner 18 was obtained. Table 2 shows the physical property values of Cyan Toner 18.

[Production of Cyan Toner 19]

1.0 part by mass of an anatase-type titanium oxide fine powder (BET specific surface area 80 $m^2/g$, treated with 12 mass % of isobutyltrimethoxysilane) was externally added to 100 parts by mass of the cyan toner particles obtained in the above production of Cyan Toner 13 with a Henschel mixer. Further, 0.5 part by mass of oil-treated silica (BET specific surface area 147 $m^2/g$, treated with 15 mass % of silicone oil), and 0.5 part by mass of the above inorganic fine particles (sol-gel silica fine particles: number average particle diameter (D1): 290 nm) were loaded into the Henschel mixer to be externally added to the mixture, whereby Cyan Toner 19 was obtained. Table 2 shows the physical property values of Cyan Toner 19.

[Production of Cyan Toner 20]

Cyan toner particles were obtained in the same manner as in the above production of Cyan Toner 1 except that the amount of Resin A was changed to 73.0 parts by mass and the amount of the cyan master batch was changed to 45.0 parts by mass. 0.5 part by mass of an anatase-type titanium oxide fine powder (BET specific surface area 80 $m^2/g$, treated with 12 mass % of isobutyltrimethoxysilane) was externally added to 100 parts by mass of the cyan toner particles with a Henschel mixer. Further, 0.5 part by mass of a rutile-type titanium oxide fine powder (BET specific surface area 33 $m^2/g$ isobutyltrimethoxysilane/trifluoropropyltrimethoxysilane=6 mass %/6 mass %), 0.5 part by mass of oil-treated silica (BET specific surface area 95 $m^2/g$, treated with 15 mass % of silicone oil), and 1.5 parts by mass of the above inorganic fine particles (sol-gel silica fine particles: number average particle diameter (D1): 290 nm) were loaded into the Henschel mixer to be externally added to the mixture, whereby Cyan Toner 20 was obtained. Table 2 shows the physical property values of Cyan Toner 20.

[Production of Cyan Toner 21]

Cyan Toner 21 was produced in the same manner as in the above production of Cyan Toner 11 except that, the amount of Resin A was changed to 66.3 parts by mass, and the amount of the cyan master batch was changed to 56.3 parts by mass. Table 2 shows the physical property values of Cyan Toner 21.

[Production of Cyan Toner 22]

Resin A 100.0 parts by mass Cyan pigment (C.I. Pigment Blue 15:3) 23.4 parts by mass Refined paraffin wax (highest endothermic peak: 70° C., Mw=450, Mn=320) 5.0 parts by mass Aluminum compound of 3,5-di-t-butylsalicylic acid (negative charge control agent) 1.0 part by mass Cyan Toner 1 was obtained in the same manner as in the production example of Cyan Toner 1 in accordance with the above formulation. 0.9 part by mass of an anatase-type titanium oxide fine powder (BET specific surface area 80 $m^2/g$, number average particle diameter (D1): 15 nm, treated with 12 mass % of isobutyltrimethoxysilane) was externally added to 100 parts by mass of the above cyan toner particles with a Henschel mixer. Next, 1.2 parts by mass of oil-treated silica fine particles (BET specific surface area 95 $m^2/g$, treated with 15 mass % of silicone oil) and 1.5 parts by mass of the above inorganic fine particles (sol-gel silica fine particles, number average particle diameter (D1): 290 nm) were loaded into the Henschel mixer to be externally added to the mixture, whereby Cyan Toner 22 was obtained. Table 2 shows the physical property values of Cyan Toner 22.

[Production of Cyan Toner 23]

Cyan Toner 23 was obtained in the same manner as in the production of Cyan Toner 22 except that the amount of the cyan pigment (Pigment Blue 15:3) was changed to 4.5 parts by mass and, in the step of producing the toner particles, the resultant mixture was coarsely pulverized with a hammer mill into particles each having a particle diameter of about 1 to 2 mm, and the particles were formed into finely pulverized products each having a particle diameter of about 5 μm with an air-jet pulverizer (Supersonic Jet Mill, Nippon Pneumatic Mfg. Co., Ltd.) in one stroke. Table 2 shows the physical property values of Cyan Toner 23.

[Production of Cyan Toner 24]

Cyan Toner 24 was obtained in the same manner as in the production of Cyan Toner 22 except that the amount of the cyan pigment (Pigment Blue 15:3) was changed to 4.5 parts by mass and, in the step of producing the toner particles, the resultant mixture was coarsely pulverized with a hammer mill into particles each having a particle diameter of about 1 to 2 mm, the particles were formed into finely pulverized products each having a particle diameter of about 5 μm with an air-jet pulverizer (Supersonic Jet Mill, Nippon Pneumatic Mfg. Co., Ltd.) in one stroke, and then the finely pulverized products were classified with a classifier (Elbow Jet, manufactured by Nittetsu Mining Co., Ltd.). Table 2 shows the physical property values of Cyan Toner 24.

[Production of Cyan Toner 25]

Cyan Toner 25 was obtained in the same manner as in the production of Cyan Toner 22 except that the amount of the cyan pigment (Pigment Blue 15:3) was changed to 0.6 part by mass. Table 2 shows the physical property values of Cyan Toner 25.

TABLE 2

| | (A712/Cc) (A538/Cm) (A422/Cy) | L* | C* | Weight-average particle diameter of toner (μm) | Average circularity of toner | Number average particle diameter of inorganic fine particles (D1:nm) |
|---|---|---|---|---|---|---|
| Yellow Toner 1 | 4.79 | 90.9 | 108.3 | 5.5 | 0.953 | 110 |
| Yellow Toner 2 | 6.04 | 90.1 | 108.8 | 5.5 | 0.952 | 110 |
| Yellow Toner 3 | 7.19 | 89.5 | 109.8 | 5.4 | 0.952 | 110 |
| Yellow Toner 4 | 9.58 | 89.1 | 110.2 | 5.5 | 0.952 | 110 |
| Yellow Toner 5 | 11.98 | 87.5 | 112.4 | 5.5 | 0.952 | 110 |
| Yellow Toner 6 | 14.37 | 86.4 | 114.0 | 5.7 | 0.951 | 110 |
| Yellow Toner 7 | 15.33 | 84.5 | 115.5 | 5.7 | 0.953 | 110 |
| Magenta Toner 1 | 1.63 | 40.6 | 59.7 | 5.6 | 0.953 | 110 |
| Magenta Toner 2 | 2.04 | 38.5 | 60.5 | 5.6 | 0.951 | 110 |
| Magenta Toner 3 | 2.45 | 37.8 | 62.4 | 5.7 | 0.951 | 110 |
| Magenta Toner 4 | 3.26 | 36.3 | 65.8 | 5.6 | 0.950 | 110 |

TABLE 2-continued

| | (A712/Cc) (A538/Cm) (A422/Cy) | L* | C* | Weight-average particle diameter of toner (μm) | Average circularity of toner | Number average particle diameter of inorganic fine particles (D1:nm) |
|---|---|---|---|---|---|---|
| Magenta Toner 5 | 4.08 | 36.0 | 66.8 | 5.5 | 0.950 | 110 |
| Magenta Toner 6 | 4.89 | 35.4 | 67.5 | 5.5 | 0.948 | 110 |
| Magenta Toner 7 | 6.52 | 35.1 | 68.8 | 5.7 | 0.948 | 110 |
| Magenta Toner 8 | 6.85 | 34.9 | 72.1 | 5.6 | 0.948 | 110 |
| Cyan Toner 1 | 1.81 | 36.1 | 55.9 | 5.4 | 0.955 | 110 |
| Cyan Toner 2 | 2.04 | 34.8 | 55.6 | 5.6 | 0.955 | 110 |
| Cyan Toner 3 | 2.44 | 32.8 | 55.1 | 5.6 | 0.955 | 110 |
| Cyan Toner 4 | 3.26 | 29.6 | 53.8 | 5.5 | 0.953 | 110 |
| Cyan Toner 5 | 3.26 | 29.6 | 53.8 | 5.5 | 0.953 | 76 |
| Cyan Toner 6 | 3.26 | 29.6 | 53.8 | 5.5 | 0.953 | 84 |
| Cyan Toner 7 | 3.26 | 29.6 | 53.8 | 5.5 | 0.953 | 280 |
| Cyan Toner 8 | 3.26 | 29.6 | 53.8 | 5.5 | 0.953 | 290 |
| Cyan Toner 9 | 3.26 | 29.6 | 53.8 | 5.5 | 0.953 | 310 |
| Cyan Toner 10 | 4.07 | 29.3 | 53.5 | 5.6 | 0.951 | 290 |
| Cyan Toner 11 | 4.07 | 28.1 | 53.2 | 5.6 | 0.950 | 290 |
| Cyan Toner 12 | 4.89 | 28.1 | 53.1 | 5.5 | 0.953 | 290 |
| Cyan Toner 13 | 4.89 | 28.1 | 53.1 | 5.9 | 0.967 | 290 |
| Cyan Toner 14 | 4.89 | 28.1 | 53.1 | 6.1 | 0.976 | 290 |
| Cyan Toner 15 | 4.89 | 28.1 | 53.1 | 5.5 | 0.942 | 290 |
| Cyan Toner 16 | 4.89 | 28.1 | 53.1 | 5.7 | 0.938 | 290 |
| Cyan Toner 17 | 4.89 | 28.1 | 53.1 | 5.5 | 0.938 | 290 |
| Cyan Toner 18 | 4.89 | 28.1 | 53.1 | 5.9 | 0.967 | 290 |
| Cyan Toner 19 | 4.89 | 28.1 | 53.1 | 5.9 | 0.967 | 290 |
| Cyan Toner 20 | 6.51 | 26.8 | 53.0 | 5.7 | 0.953 | 290 |
| Cyan Toner 21 | 8.14 | 25.7 | 52.0 | 5.6 | 0.953 | 290 |
| Cyan Toner 22 | 8.47 | 25.1 | 49.9 | 5.7 | 0.952 | 290 |
| Cyan Toner 23 | 1.61 | 37.2 | 48.1 | 5.9 | 0.935 | 290 |
| Cyan Toner 24 | 1.30 | 42.2 | 50.1 | 5.9 | 0.925 | 290 |
| Cyan Toner 25 | 0.22 | 61.2 | 45.9 | 6.2 | 0.946 | 290 |

TABLE 3

| | Resin A/ part(s) by mass | Refined paraffin wax/ part(s) by mass | Charge control agent/ part(s) by mass | Magenta master batch/ part(s) by mass |
|---|---|---|---|---|
| Magenta Toner 1 | 88.3 | 5.0 | 1.0 | 19.5 |
| Magenta Toner 2 | 85.4 | 5.0 | 1.0 | 24.4 |
| Magenta Toner 3 | 82.5 | 5.0 | 1.0 | 29.3 |
| Magenta Toner 4 | 76.6 | 5.0 | 1.0 | 39.0 |
| Magenta Toner 5 | 70.8 | 5.0 | 1.0 | 48.8 |
| Magenta Toner 6 | 64.9 | 5.0 | 1.0 | 58.5 |
| Magenta Toner 7 | 53.2 | 5.0 | 1.0 | 78.0 |
| Magenta Toner 8 | 50.9 | 5.0 | 1.0 | 81.9 |
| | | | | Yellow master batch/ part(s) by mass |
| Yellow Toner 1 | 89.5 | 5.0 | 1.0 | 17.5 |
| Yellow Toner 2 | 86.9 | 5.0 | 1.0 | 21.9 |
| Yellow Toner 3 | 84.3 | 5.0 | 1.0 | 26.3 |
| Yellow Toner 4 | 79.0 | 5.0 | 1.0 | 35.0 |
| Yellow Toner 5 | 68.5 | 5.0 | 1.0 | 52.5 |
| Yellow Toner 6 | 66.4 | 5.0 | 1.0 | 56.0 |
| Yellow Toner 7 | 47.5 | 5.0 | 1.0 | 87.5 |

Production Example of Magnetic Component Particles (Porous Magnetic Core Particles) A of Carrier <1. Weighing and Mixing>

The following materials were weighed in accordance with the composition.

| | |
|---|---|
| $Fe_2O_3$ | 76.6 mass % |
| MnO | 20.0 mass % |
| MgO | 3.0 mass % |
| SrO | 0.4 mass % |

Ferrite raw materials blended in accordance with the above composition were subjected to wet mixing with a ball mill.

<2. Calcination>

The above mixture was dried and pulverized, and was then calcined at 900° C. for 2 hours, whereby a ferrite was produced.

<3. Pulverization>

The ferrite was pulverized with a crusher into particles each having a particle diameter of 0.1 to 1.0 mm. After that, water was added to the particles, and the resultant particles were finely pulverized with a wet ball mill into particles each having a particle diameter of 0.1 to 0.5 μm, whereby ferrite slurry was obtained.

<4. Granulation>

4% of polyester fine particles (having a weight-average particle diameter of 2 μm) as a pore-forming agent and 2% of polyvinyl alcohol as a binder were added to the resultant ferrite slurry, and the mixture was granulated with a Spray Dryer (manufacturer: OHKAWARA KAKOHKI CO., LTD.) into spherical particles.

<5. Sintering>

The above granulated products were sintered in an electric furnace under a nitrogen gas atmosphere having an oxygen gas concentration of 1.0% at 1,200° C. for 4 hours.

<6. Sorting 1>

The resultant sintered products were screened with a sieve having an aperture of 250 μm so that coarse particles were removed.

<7. Sorting 2>

The resultant particles were classified with an air classifier (Elbow Jet Lab EJ-L3, manufactured by Nittetsu Mining Co., Ltd.), whereby magnetic component particles A of a carrier were obtained. Table 4 shows the physical properties of the magnetic component particles A.

Production Examples of Magnetic Component Particles (Porous Magnetic Core Particles) B, C, and F of Carriers Magnetic component particles B were obtained in the same manner as in the production example of the magnetic component particles A of a carrier except that: the addition amount of the polyester fine particles used in the step of granulation was changed from 4% to 12%; and the addition amount of polyvinyl alcohol used in the step of granulation was changed from 2% to 5%. In addition, magnetic component particles C were obtained in the same manner as in the production example except that the addition amount of the polyester fine particles was changed from 4% to 3%. Further, magnetic component particles F were obtained in the same manner as in the production example except that: the addition amount of the polyester fine particles was changed from 4% to 15%; and the addition amount of polyvinyl alcohol was changed from 2% to 7%. Table 4 shows the physical properties of the magnetic component particles B, C, and F.

Production Example of Magnetic Component Particles (Porous Magnetic Core Particles) D of Carrier Magnetic component particles D of a carrier were obtained in the same manner as in the production example of the magnetic component particles A of a carrier except that the following sintering step 2 was performed between the sintering step and the sorting step 1: the resultant sintered products were sintered in an electric furnace under a nitrogen atmosphere at 800° C. for 1 hour and reduced. Table 4 shows the physical properties of the magnetic component particles D.

Production Example of Magnetic Component Particles (Porous Magnetic Core Particles) E of Carrier Magnetic component particles E of a carrier were obtained in the same manner as in the production example of the magnetic component particles A of a carrier except that conditions for the sintering step were changed as follows: the resultant granulated products were sintered under a nitrogen gas atmosphere having an oxygen gas concentration of 1.5% at 1,250° C. for 4 hours. Table 4 shows the physical properties of the magnetic component particles E.

Production Example of Magnetic Component Particles (Porous Magnetic Core Particles) G of Carrier Magnetic component particles G of a carrier were obtained in the same manner as in the production example of the magnetic component particles A of a carrier except that: the addition amount of the polyester fine particles used in the granulating step was changed from 4% to 1%; and conditions for the sintering step were changed as follows: the resultant granulated products were sintered under a nitrogen gas atmosphere having an oxygen gas concentration of 0.5% at 1,100° C. for 4 hours. Table 4 shows the physical properties of the magnetic component particles G.

Production Example of Magnetic Component Particles (Porous Magnetic Core Particles) H of Carrier Magnetic component particles H of a carrier were obtained in the same manner as in the production example of the magnetic component particles A of a carrier except that ferrite raw materials were changed as shown below. Table 4 shows the physical properties of the magnetic component particles H.

| | |
|---|---|
| $Fe_2O_3$ | 69.0 mass % |
| ZnO | 16.0 mass % |
| CuO | 15.0 mass % |

Production Example of Magnetic Component Particles (Porous Magnetic Core Particles) I of Carrier Magnetic component particles I of a carrier were obtained in the same manner as in the production example of the magnetic component particles A of a carrier except that: the number of revolutions of the atomizer disk of the Spray Dryer used in the granulating step was increased; and conditions for the classification with the air classifier (Elbow Jet Lab EJ-L3, manufactured by Nittetsu Mining Co., Ltd.) in the step of sorting 2 were changed so that the amount in which a coarse powder was removed was increased. Table 4 shows the physical properties of the magnetic component particles I.

Production Example of Magnetic Component Particles J of Carrier $Fe_2O_3$, CuO, and MgO were weighed so that a molar ratio "$Fe_2O_3$:CuO:MgO" was 54 mol %:16 mol %:30 mol %, and were mixed with a ball mill for 8 hours. The mixture was calcined at 900° C. for 2 hours, and then the calcined product was pulverized with a ball mill. Further, the pulverized products were granulated with a Spray Dryer. The granulated products were sintered at 1,150° C. for 10 hours, pulverized, and classified, whereby magnetic component particles J were obtained. Table 4 shows the physical properties of the magnetic component particles J.

TABLE 4

| Core particles | Specific resistance (Ω · cm) | Packed bulk density ρ1 (g/cm³) | True density ρ2 (g/cm³) | ρ1/ρ2 |
|---|---|---|---|---|
| Magnetic component particles A of carrier | $6.7 \times 10^6$ | 1.7 | 4.9 | 0.35 |
| Magnetic component particles B of carrier | $4.2 \times 10^7$ | 1.0 | 4.8 | 0.21 |

TABLE 4-continued

| Core particles | Specific resistance (Ω · cm) | Packed bulk density ρ1 (g/cm³) | True density ρ2 (g/cm³) | ρ1/ρ2 |
|---|---|---|---|---|
| Magnetic component particles C of carrier | $5.2 \times 10^5$ | 2.0 | 4.9 | 0.41 |
| Magnetic component particles D of carrier | $2.1 \times 10^3$ | 1.7 | 4.7 | 0.36 |
| Magnetic component particles E of carrier | $4.8 \times 10^7$ | 1.6 | 4.8 | 0.33 |
| Magnetic component particles F of carrier | $7.3 \times 10^7$ | 0.7 | 4.6 | 0.15 |
| Magnetic component particles G of carrier | $4.2 \times 10^4$ | 2.5 | 4.9 | 0.51 |
| Magnetic component particles H of carrier | $8.2 \times 10^8$ | 1.8 | 5.0 | 0.36 |
| Magnetic component particles I of carrier | $7.4 \times 10^6$ | 1.7 | 4.9 | 0.35 |
| Magnetic component particles J of carrier | $4.2 \times 10^6$ | 4.0 | 7.3 | 0.55 |

Production Example of Magnetic Carrier 1

<1. Preparation of Resin Liquid>

| | |
|---|---|
| Straight silicone resin (KR255 manufactured by Shin-Etsu Chemical Co., Ltd.) | 20.0 mass % |
| γ-aminopropyltriethoxysilane | 2.0 mass % |
| Xylene | 78.0 mass % |

The above three kinds of materials were mixed, whereby a resin liquid 1 was obtained.

<2. Resin Penetration Step>

The resin liquid 1 was caused to penetrate into the pores of the magnetic component particles A so that the mass of the silicone resin accounted for 10 mass % of the mass of the magnetic component particles A, and the pores of the magnetic component particles A were filled with the resin. The pores were filled with the resin by using a universal mixing stirrer (product name NDMV; Fuji Paudal Co., Ltd.) at a degree of vacuum of 50 kPa while the particles were heated to 70° C. The resin liquid 1 was charged in three portions at 0 minute, 10 minutes, and 20 minutes. After the filling, the particles were stirred for 1 hour.

<3. Drying Step>

Xylene was removed by using a universal mixing stirrer (product name NDMV; Fuji Paudal Co., Ltd) at a degree of vacuum of 5 kPa while the particles were heated at 100° C. for 5 hours.

<4. Curing Step>

The resultant particles were heated at 200° C. for 3 hours so that the resin was cured.

<5. Screening Step>

The resultant particles were screened with a sieve having an aperture of 75 μm by using a sieve shaker (300MM-2 type, TSUTSUI SCIENTIFIC INSTRUMENTS CO., LTD.), whereby Magnetic Carrier 1 was obtained. It should be noted that Magnetic Carrier 1 obtained here had the porous magnetic core particles the surface of each of which was coated with the resin loaded into the pores of the particles. Table 5 shows the physical property values of Magnetic Carrier 1 obtained here.

Production Example of Magnetic Carrier 2

Magnetic Carrier 2 was obtained in the same manner as in the production example of Magnetic Carrier 1 except that: the magnetic component particles B were used instead of the magnetic component particles A; and, in the resin penetration step of the production example of Magnetic Carrier 1, the resin liquid 1 was caused to penetrate so that the mass of the silicone resin accounted for 20 mass % of the mass of the magnetic component particles. Table 5 shows the physical property values of Magnetic Carrier 2 obtained here.

Production Example of Magnetic Carrier 3

Magnetic Carrier 3 was obtained in the same manner as in the production example of Magnetic Carrier 1 except that: the magnetic component particles C were used instead of the magnetic component particles A; and, in the resin penetration step of the production example of Magnetic Carrier 1, the resin liquid 1 was caused to penetrate so that the mass of the silicone resin accounted for 5 mass % of the mass of the magnetic component particles. Table 5 shows the physical property values of Magnetic Carrier 3 obtained here.

Production Examples of Magnetic Carriers 4, 5, and 10

Magnetic Carriers 4, 5, and 10 were each obtained in the same manner as in the production example of Magnetic Carrier 1 except that one of the magnetic component particles D, E, and H were used instead of the magnetic component particles A. Table 5 shows the physical property values of Magnetic Carriers 4, 5, and 10 obtained here.

Production Example of Magnetic Carrier 6

<1. Step of Preparing Resin Liquid>

| | |
|---|---|
| Polymethyl methacrylate (Mw = 58,000) | 1.5 mass % |
| Toluene | 98.5 mass % |

The above materials were mixed, whereby a resin liquid 2 was obtained.

<2. Resin Penetration Step>

The resin liquid 2 was caused to penetrate into the pores of the magnetic component particles A so that the mass of the polymethyl methacrylate accounted for 4 mass % of the mass of the magnetic component particles A, and the pores of the magnetic component particles A were filled with the resin. The pores were filled with the resin by using a universal mixing stirrer (product name NDMV; Fuji Paudal Co., Ltd.) at a degree of vacuum of 50 kPa while the particles were heated to 60° C. The resin liquid 2 was charged in three portions at 0 minute, 10 minutes, and 20 minutes. After the filling, the particles were stirred for 1 hour.

<3. Drying Step>

Toluene was removed by using a universal mixing stirrer (product name NDMV; Fuji Paudal Co., Ltd.) at a degree of vacuum of 5 kPa while the particles were heated at 100° C. for 5 hours.

<4. Curing Step>

The resultant particles were heated at 220° C. for 3 hours so that the resin was cured.

<5. Screening Step>

The resultant particles were screened with a sieve having an aperture of 75 μm by using a sieve shaker (300MM-2 type, TSUTSUI SCIENTIFIC INSTRUMENTS CO., LTD.), whereby resin-containing Magnetic Particle 6 was obtained. The resin-containing Magnetic Particle 6 was named Magnetic Carrier 6. It should be noted that Magnetic Carrier 6 obtained here had the porous magnetic core particles the surface of each of which was coated with the resin loaded into the pores of the particles. Table 5 shows the physical property values of Magnetic Carrier 6 obtained here.

Production Example of Magnetic Carrier 7

Magnetic Carrier 1 obtained in the production example of Magnetic Carrier 1 was pulverized with a collision type air pulverizer, and was then classified with an air classifier (Elbow Jet Lab EJ-L3, manufactured by Nittetsu Mining Co., Ltd.), whereby Magnetic Carrier 7 was obtained. Table 5 shows the physical property values of Magnetic Carrier 7 obtained here.

Production Example of Magnetic Carrier 8

Magnetic Carrier 8 was obtained in the same manner as in the production example of Magnetic Carrier 2 except that the magnetic component particles B of a carrier were changed to the magnetic component particles F of a carrier. Table 5 shows the physical property values of Magnetic Carrier 8 obtained here.

Production Example of Magnetic Carrier 9

Magnetic Carrier 9 was obtained in the same manner as in the production example of Magnetic Carrier 3 except that the magnetic component particles C of a carrier were changed to the magnetic component particles G of a carrier. Table 5 shows the physical property values of Magnetic Carrier 9 obtained here.

Production Example of Magnetic Carrier 11

Magnetic Carrier 11 was obtained in the same manner as in the production example of Magnetic Carrier 6 except that, in the resin penetration step of the example, polymethyl methacrylate was used so as to account for 3 mass % of the mass of the magnetic carrier core (the magnetic component particles A). Table 5 shows the physical property values of Magnetic Carrier 11 obtained here.

Production Example of Magnetic Carrier 12

Magnetic Carrier 12' was obtained in the same manner as in the production example of Magnetic Carrier 2 except that the magnetic component particles B of a carrier were changed to the magnetic component particles I of a carrier. Magnetic Carrier 12' and Magnetic Carrier 1 were mixed at a mass ratio of 20:80, whereby Magnetic Carrier 12 was obtained. Table 5 shows the physical property values of Magnetic Carrier 12 obtained here.

Production Example of Magnetic Carrier 13

20 parts by mass of toluene, 20 parts by mass of butanol, 20 parts by mass of water, and 40 parts by mass of ice were loaded into a four-necked flask, and 40 parts by mass of a mixture of 15 moles of $CH_3SiCl_3$ and 10 moles of $(CH_3)_2SiCl_2$ were added to the mixture while the mixture was stirred. Further, the resultant mixture was stirred for 30 minutes, and was then subjected to a condensation reaction at 60° C. for 1 hour. After that, the resultant siloxane was sufficiently washed with water and dissolved in a toluene-methyl ethyl ketone-butanol mixed solvent, whereby a silicone varnish having a solid content of 10% was prepared. 2.0 parts by mass of ion-exchanged water, 2.0 parts by mass of the following curing agent (3), and 3.0 parts by mass of the following aminosilane coupling agent (4) were simultaneously added to the silicone varnish with respect to 100 parts by mass of a siloxane solid content, whereby a carrier coat solution was produced.

[Chem 2]

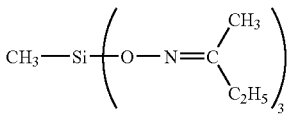

(3)

[Chem 3]

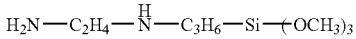

(4)

The above carrier coat solution was applied to the above magnetic component particles J with a coater (manufactured by OKADA SEIKO CO., LTD.: Spira Coater) so that a resin coat amount was 1.0 part by mass with respect to 100 parts by mass of the particles, whereby Magnetic Carrier 13 coated with a silicone resin was obtained. Table 5 shows the physical property values of Magnetic Carrier 13 obtained here.

TABLE 5

| Magnetic carrier | P2/P1 | 50% particle diameter on volume basis (D50) | Carrier core |
|---|---|---|---|
| Carrier 1 | 0.91 | 38 | Magnetic component particles A of carrier |
| Carrier 2 | 0.87 | 44 | Magnetic component particles B of carrier |
| Carrier 3 | 0.95 | 51 | Magnetic component particles C of carrier |
| Carrier 4 | 0.9 | 43 | Magnetic component particles D of carrier |
| Carrier 5 | 0.85 | 65 | Magnetic component particles E of carrier |
| Carrier 6 | 0.72 | 40 | Magnetic component particles A of carrier |
| Carrier 7 | 1.02 | 49 | Magnetic component particles A of carrier |
| Carrier 8 | 0.72 | 44 | Magnetic component particles F of carrier |
| Carrier 9 | 0.96 | 54 | Magnetic component particles G of carrier |
| Carrier 10 | 0.82 | 80 | Magnetic component particles H of carrier |
| Carrier 11 | 0.67 | 37 | Magnetic component particles A of carrier |
| Carrier 12 | 1.32 | 32 | Magnetic component particles A, I of carrier |
| Carrier 13 | 0.92 | 44 | Magnetic component particles J of carrier |

Examples 1 to 38 and Comparative Examples 1 to 12

Starting developers and replenishing developers were produced by combining the above magnetic carriers and the above toners as shown in Table 6. Each of the developers was charged into a reconstructed device of a full-color copying machine CLC5000 manufactured by Canon Inc. (the contents of the reconstruction will be described later), and was evaluated for various items. It should be noted that the starting developers were each prepared by: adding 10 parts by mass of a toner to 90 parts by mass of a magnetic carrier; and mixing the whole with a V-type mixer in a normal-temperature, normal-humidity (23° C., 50% RH) environment. In addition, the replenishing developers used in Examples 1 to 19 and Comparative Examples 1 to 4 were each prepared by: adding 90 parts by mass of a toner to 10 parts by mass of a magnetic carrier; and mixing the whole with a V-type mixer in a normal-temperature, normal-humidity (23° C., 50% RH) environment. Further, none of the replenishing developers of Examples 20 to 38 and Comparative Examples 5 to 12 contained a magnetic carrier. The replenishing developers were each charged into a replenishing developer container.

The reconstructed points of the above CLC5000 reconstructed device are as described below.

Figure 6:
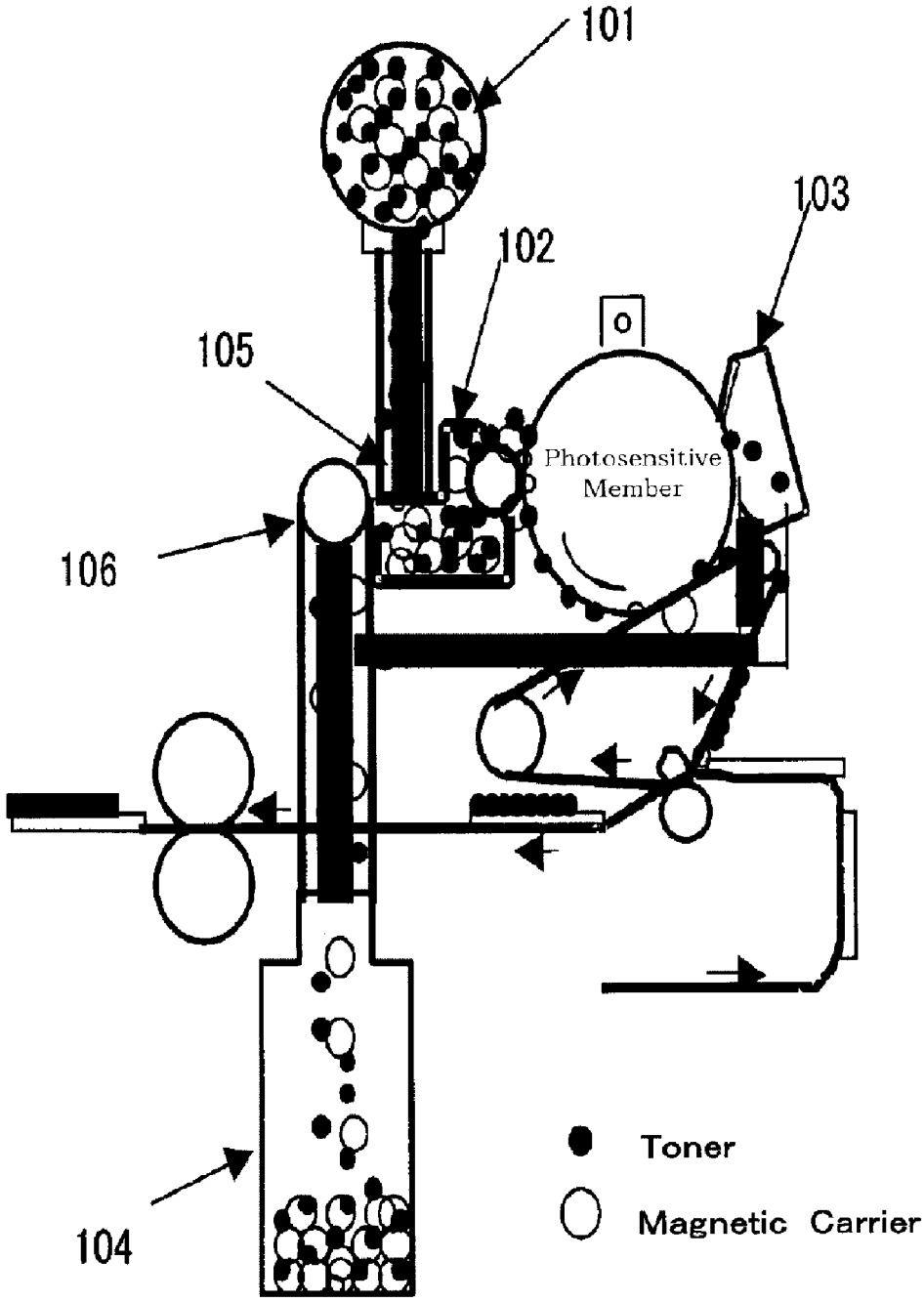
FIG. 6 is a schematic view showing the flow of a replenishing developer in an image-forming apparatus using the developer.

A developing device was reconstructed so that a replenishing developer was introduced from a replenishing developer introduction port 105, and an excess magnetic carrier was discharged from a discharge port 106 placed in a developing chamber as shown in FIG. 6. In addition, a laser spot diameter was reduced so that the output of a laser spot at 600 dpi was attained. Further, the surface layer of the fixing roller of a fixing unit was changed to a perfluoroalkoxyalkane (PFA) tube, and an oil application mechanism was removed.

<Evaluation>

A monochromatic solid image was formed on a transfer material (paper: OK Top Coat, 127.9 g/m$^2$, manufactured by Oji Paper Company, Limited), and a toner laid-on level at which the reflection density of the image was 1.5 was determined. The reflection density as one kind of an image density was measured with a spectral densitometer 500 series (X-Rite Co.).

A 50,000-sheet duration image output test was performed by using a chart having an image area of 5% at such a toner laid-on level that the reflection density of the monochromatic solid image was 1.5 under a normal-temperature, low-humidity (23° C., 5% RH) environment. After the completion of the test under the normal-temperature, low-humidity environment, each image was evaluated for its changing in tinges (ΔE), carrier adhesion, and fogging. After that, an additional 50,000-sheet duration image output test was subsequently performed by using a chart having an image area of 25% under a high-temperature, high-humidity environment (30° C., 80% RH). After the completion of the test under the high-temperature, high-humidity environment, each image was evaluated for its transfer void after duration, transferring performance, and cleaning performance. It should be noted that evaluation items and evaluation criteria are as shown below. Table 7 shows the obtained results of the evaluation.

<Evaluation for Fogging>

The average reflectance Dr (%) of paper was measured with a reflectometer ("REFLECTOMETER MODEL TC-6DS" manufactured by Tokyo Denshoku CO., LTD.). Next, a solid white image was printed after a 50,000-sheet duration image output test (with Vback set to 150 V), and the reflectance Ds (%) of the solid white image was measured. Fogging (%) was calculated by using the following equation.

$$\text{Fogging}(\%)=Dr(\%)-Ds(\%)$$

The resultant fogging (%) was evaluated in accordance with the following evaluation criteria.

A: Less than 0.5% (good)
B: 0.5% or more and less than 1.0%
C: 1.0% or more and less than 2.0%
D: 2.0% or more (bad)

<Evaluation for Changing in Tinges after Duration as Compared to Those Before Duration>

A development voltage was adjusted before a duration test so that toner was laid on paper at such a level that the reflection density of a solid fixed image on the paper was 1.5. Subsequently, a fixing unit was removed, and a solid image (measuring 3 cm by 3 cm) was output in 400 lines, whereby an unfixed image for evaluation was obtained. Next, after a 50,000-sheet duration image output test, a similar unfixed solid image was output at the same development voltage as that before the duration test.

The fixing unit of a CLC5000 was removed, the temperature of the fixing roller of the removed fixing unit was adjusted to 160° C., and paper was passed at 300 mm/sec, whereby a fixed image was obtained. Next, the chromaticity of the resultant fixed image was measured. The chromaticity was measured by using a chromoscope (Spectrolino, manufactured by GRETAGMACBETH) with an observation light source of D50 at an observation view angle of 2°, and ΔE was calculated and evaluated.

Evaluation for changing in tinges was performed as described below. A color difference (ΔE) between a solid image before duration and the image after the duration was quantitatively evaluated on the basis of the definition of a colorimetric system specified by Commission Internationale de l'Eclairage (CIE) in 1976 as described below in accordance with the following evaluation criteria.)

$$\Delta E=\{(L1^*-L2^*)^2+(a1^*-a2^*)^2+(b1^*-b2^*)^2\}^{1/2}$$

L1*: the lightness of an image before duration
a1*, b1*: chromaticities showing the hue and chroma of the image before the duration
L2*: the lightness of the image after the duration
a2*, b2*: chromaticities showing the hue and chroma of the image after the duration (Evaluation Criteria for ΔE)
A: 0.0 or more and less than 1.5 (good)
B: 1.5 or more and less than 3.0
C: 3.0 or more and less than 6.0
D: 6.0 or more (bad)

<Evaluation for Dot Reproducibility>

Evaluation for dot reproducibility was performed after a 50,000-sheet duration image output test had been performed under a normal-temperature, low-humidity (23° C., 5% RH) environment. The evaluation was performed as described below. A dot image in which one pixel was formed of one dot was produced. The spot diameter of a laser beam from a CLC-5000 manufactured by Canon Inc. was adjusted so that the area of one dot on paper became 20,000 μm$^2$ or more and less than 25,000 μm$^2$. After that, the area of 1,000 dots was measured with a digital microscope VHX-500 (manufactured by KEYENCE CORPORATION, mounted with a lens wide-range zoom lens VH-Z100 manufactured by KEYENCE CORPORATION). The number average (S) and standard deviation (σ) of dot areas were calculated, and a dot reproducibility index was calculated from the following equation.

$$\text{Dot reproducibility index } (I)=\sigma/S\times 100$$

(Evaluation Criteria for Dot Reproducibility)
A: I is less than 4.0 (good).
B: I is 4.0 or more and less than 6.0.
C: I is 6.0 or more and less than 8.0.
D: I is 8.0 or more (bad).

<Evaluation for Image Void>

A development contrast was adjusted after a 50,000-sheet duration image output test under a high-temperature, high-humidity environment (30° C./80% RH) so that a toner laid-on level on paper was such that the reflection density of a monochromatic solid image was 1.5. An image was formed so that narrow lines were present in both vertical and lateral directions. Two 2-dot lines, two 4-dot lines, two 6-dot lines, two 8-dot lines, or two 10-dot lines were printed so that the width of a non-latent-image portion between the lines was about 1 mm, and the image was observed with the eyes and a loupe having a magnification of 20.

(Evaluation Criteria for Void)

A: The image is such that nearly no voids are observed in the 2-dot lines even when the image is observed under magnification.

B: The image is such that voids are slightly observed in the 2-dot lines when the image is observed under magnification, but are not observed when the image is observed with the eyes.

C: The image is such that voids are observed in the 2-dot lines when the image is observed with the eyes, but no voids are observed in the 4-dot lines when the image is observed with the eyes.

D: The image is such that voids are observed in the 4-dot lines when the image is observed with the eyes.

<Evaluation for Transferring Performance>

A solid image was output after a 50,000-sheet duration image output test under a high-temperature, high-humidity environment (30° C./80% RH). Transfer residual toner on a photosensitive drum at the time of the formation of the solid image was stripped by taping with an adhesive tape made of transparent polyester. The stripped adhesive tape was stuck on paper, and its density was measured with a spectral densitometer 500 series (X-Rite Co.). In addition, only an adhesive tape was stuck on paper, and a density at the time was also measured. A density difference was calculated by subtracting the latter density from the former density, and evaluation for transferring performance was performed on the basis of the density difference.

(Evaluation Criteria for Transferring Performance)

A: Very good (a density difference of less than 0.05)

B: Good (a density difference of 0.05 or more and less than 0.1)

C: Normal (a density difference of 0.1 or more and less than 0.2)

D: Bad (a density difference of 0.2 or more)

<Evaluation for Cleaning Performance>

1,000 images each having an image area ratio of 10% were output after a 50,000-sheet duration image output test under a high-temperature, high-humidity environment (30° C./80% RH). The extent to which a vertical streak-like or spot-like image resulting from uncleaned residual toner was generated in each image after the output of 1,000 sheets was observed.

(Evaluation Criteria for Cleaning Performance)

A: Very good (No image defect is generated.)

B: Good (Two to three spot-like patterns are generated.)

C: Normal (Spot-like or streak-like patterns are slightly generated.)

D: Bad (Spot-like and streak-like patterns, and image density non-uniformity are generated.)

<Evaluation for Lowest Fixation Temperature>

Figure 11:
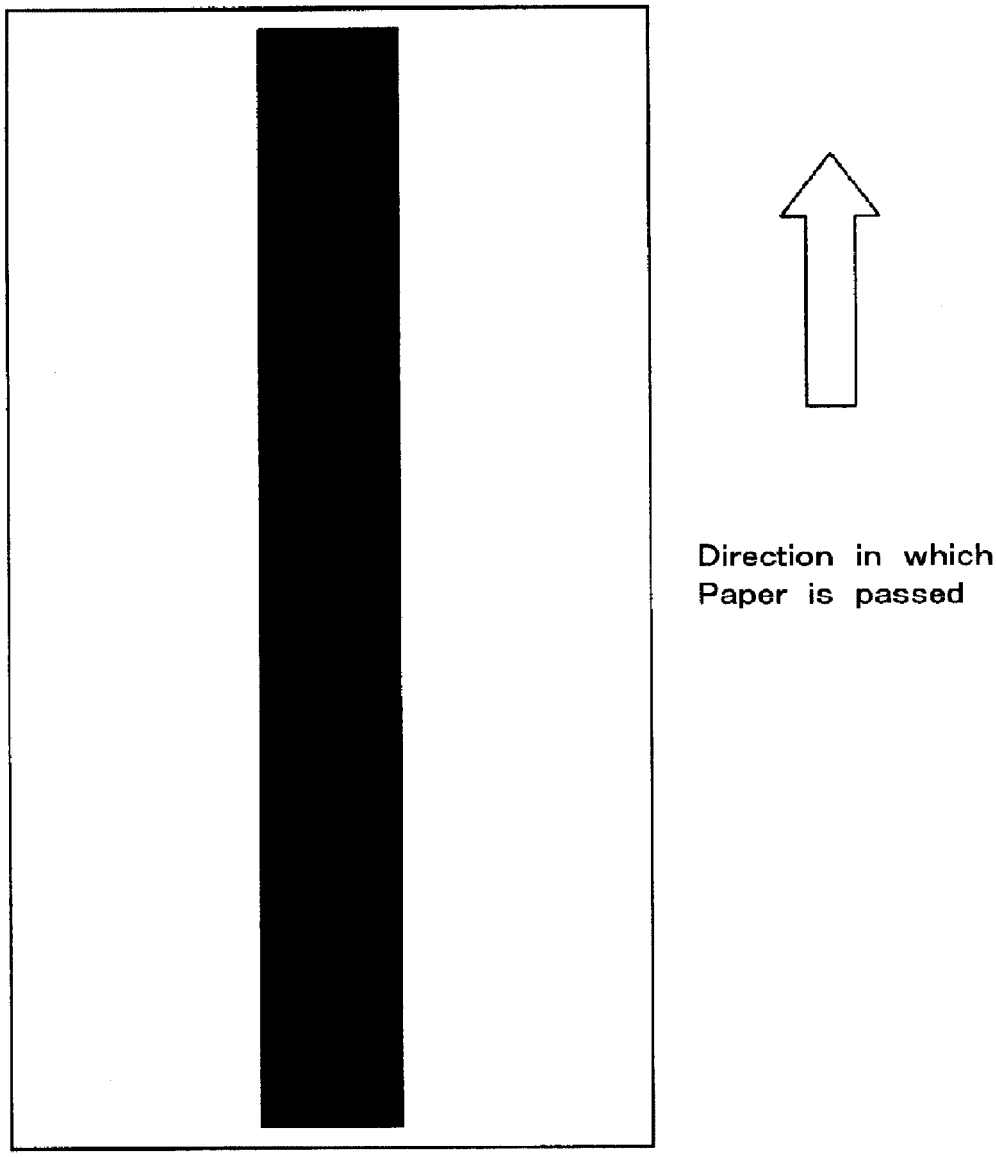
FIG. 11 is a view for explaining an image and a method each employed in evaluation for a lowest fixation temperature.

The reconstructed device of a CLC5000 was used. A toner laid-on level needed for setting the reflection density of a solid portion on a recording material to 1.5 was determined, and conditions for development and transfer were adjusted so that toner was laid on the recording material at a level twice as high as the above level. An unfixed image (A4) shown in FIG. 11 was output under the conditions. It should be noted that paper having a basis weight of 127.9 g/m$^2$ (OK Top Coat, manufactured by Oji Paper Company, Limited) was used as the recording material. The resultant image was subjected to moisture conditioning under a low-temperature, low-humidity environment (15° C./10% RH) for 24 hours, and then the toner was evaluated for its fixing performance under the environment. A fixing unit removed from the CLC5000 was used as a fixing unit, and paper was passed at a process speed of 350 mm/sec while the temperature of the fixing roller of the removed fixing unit was increased in an increment of 5° C. in the range of 100 to 200° C. The recording material to which the toner image had been fixed was folded in a cross fashion at the toner image portion, and a cylindrical roller (made of brass: 798 g) having an outer diameter of 60 mm and a length of 40 mm was reciprocated on the material 5 times. After that, the folded portion was opened, and was rubbed 10 times with lens-cleaning paper (half cut of a Dusper K3 manufactured by OZU CORPORATION) wound around the section of a square pole weight (made of brass: 198 g) measuring 22 mm by 22 mm by 47 mm. The temperature at which the percentage by which the toner image was peeled was 25% or less in the test was defined as a lowest fixation temperature. An image processing system (Personal IAS (registered trademark), QEA) was used for measuring the percentage by which the toner image was peeled.

<Evaluation for Carrier Adhesion>

A development voltage was adjusted so that a toner laid-on level on paper after a 50,000-sheet duration image output test under a normal-temperature, low-humidity (23° C., 5% RH) environment was 0.1 mg/cm$^2$. A latent image for a solid image (1 cm×1 cm) was formed on a photosensitive drum under the condition. The power supply of the main body of the photosensitive drum was turned off when the latent image formed on the photosensitive drum was developed with toner, and the number of magnetic carriers adhering onto the photosensitive drum was counted with an optical microscope.

(Evaluation Criteria for Carrier Adhesion)

A: 3 or less (good)

B: 4 or more and 10 or less

C: 11 or more and 20 or less

D: 21 or more (bad)

TABLE 6

| | Starting developer | | | | Replenishing developer | |
|---|---|---|---|---|---|---|
| | Toner | Carrier | Q/m*$^2$ | Adhesive force | Toner | Carrier |
| Example 1 | Magenta Toner 2 | Carrier 1 | 61 | 13 | Magenta Toner 2 | Carrier 1 |
| Example 2 | Magenta Toner 3 | Carrier 1 | 61 | 13 | Magenta Toner 3 | Carrier 1 |

TABLE 6-continued

| | Starting developer | | | | Replenishing developer | |
|---|---|---|---|---|---|---|
| | Toner | Carrier | Q/m*2 | Adhesive force | Toner | Carrier |
| Example 3 | Magenta Toner 4 | Carrier 1 | 60 | 13 | Magenta Toner 4 | Carrier 1 |
| Example 4 | Magenta Toner 5 | Carrier 1 | 65 | 14 | Magenta Toner 5 | Carrier 1 |
| Example 5 | Magenta Toner 6 | Carrier 1 | 67 | 13 | Magenta Toner 6 | Carrier 1 |
| Example 6 | Magenta Toner 7 | Carrier 1 | 65 | 14 | Magenta Toner 7 | Carrier 1 |
| Comparative Example 1 | Magenta Toner 1 | Carrier 1 | 60 | 13 | Magenta Toner 1 | Carrier 1 |
| Comparative Example 2 | Magenta Toner 8 | Carrier 1 | 68 | 14 | Magenta Toner 8 | Carrier 1 |
| Example 7 | Yellow Toner 2 | Carrier 1 | 72 | 14 | Yellow Toner 2 | Carrier 1 |
| Example 8 | Yellow Toner 3 | Carrier 1 | 75 | 14 | Yellow Toner 3 | Carrier 1 |
| Example 9 | Yellow Toner 4 | Carrier 1 | 75 | 14 | Yellow Toner 4 | Carrier 1 |
| Example 10 | Yellow Toner 5 | Carrier 1 | 78 | 15 | Yellow Toner 5 | Carrier 1 |
| Example 11 | Yellow Toner 6 | Carrier 1 | 78 | 15 | Yellow Toner 6 | Carrier 1 |
| Comparative Example 3 | Yellow Toner 1 | Carrier 1 | 72 | 14 | Yellow Toner 1 | Carrier 1 |
| Comparative Example 4 | Yellow Toner 7 | Carrier 1 | 77 | 15 | Yellow Toner 7 | Carrier 1 |
| Example 12 | Cyan Toner 2 | Carrier 1 | 68 | 13 | Cyan Toner 2 | Carrier 1 |
| Example 13 | Cyan Toner 3 | Carrier 1 | 62 | 12 | Cyan Toner 3 | Carrier 1 |
| Example 14 | Cyan Toner 4 | Carrier 1 | 70 | 13 | Cyan Toner 4 | Carrier 1 |
| Example 15 | Cyan Toner 5 | Carrier 1 | 75 | 14 | Cyan Toner 5 | Carrier 1 |
| Example 16 | Cyan Toner 6 | Carrier 1 | 74 | 14 | Cyan Toner 6 | Carrier 1 |
| Example 17 | Cyan Toner 7 | Carrier 1 | 95 | 15 | Cyan Toner 7 | Carrier 1 |
| Example 18 | Cyan Toner 8 | Carrier 1 | 68 | 13 | Cyan Toner 8 | Carrier 1 |
| Example 19 | Cyan Toner 9 | Carrier 1 | 69 | 13 | Cyan Toner 9 | Carrier 1 |
| Example 20 | Cyan Toner 10 | Carrier 1 | 65 | 12 | Cyan Toner 10 | — |
| Example 21 | Cyan Toner 10 | Carrier 2 | 65 | 12 | Cyan Toner 10 | — |
| Example 22 | Cyan Toner 10 | Carrier 3 | 65 | 12 | Cyan Toner 10 | — |
| Example 23 | Cyan Toner 10 | Carrier 4 | 65 | 12 | Cyan Toner 10 | — |
| Example 24 | Cyan Toner 10 | Carrier 5 | 65 | 12 | Cyan Toner 10 | — |
| Example 25 | Cyan Toner 10 | Carrier 6 | 65 | 12 | Cyan Toner 10 | — |
| Example 26 | Cyan Toner 11 | Carrier 7 | 65 | 12 | Cyan Toner 11 | — |
| Example 27 | Cyan Toner 11 | Carrier 8 | 65 | 12 | Cyan Toner 11 | — |
| Example 28 | Cyan Toner 11 | Carrier 9 | 65 | 12 | Cyan Toner 11 | — |
| Example 29 | Cyan Toner 11 | Carrier 10 | 65 | 12 | Cyan Toner 11 | — |
| Example 30 | Cyan Toner 11 | Carrier 11 | 65 | 12 | Cyan Toner 11 | — |
| Example 31 | Cyan Toner 11 | Carrier 12 | 65 | 12 | Cyan Toner 11 | — |
| Example 32 | Cyan Toner 12 | Carrier 12 | 62 | 12 | Cyan Toner 12 | — |
| Example 33 | Cyan Toner 13 | Carrier 12 | 62 | 12 | Cyan Toner 13 | — |
| Example 34 | Cyan Toner 14 | Carrier 12 | 65 | 11 | Cyan Toner 14 | — |
| Example 35 | Cyan Toner 15 | Carrier 12 | 61 | 12 | Cyan Toner 15 | — |

TABLE 6-continued

| | Starting developer | | | | Replenishing developer | |
|---|---|---|---|---|---|---|
| | Toner | Carrier | Q/m*2 | Adhesive force | Toner | Carrier |
| Example 36 | Cyan Toner 16 | Carrier 12 | 116 | 15 | Cyan Toner 16 | — |
| Example 37 | Cyan Toner 17 | Carrier 12 | 55 | 12 | Cyan Toner 17 | — |
| Example 38 | Cyan Toner 21 | Carrier 13 | 63 | 12 | Cyan Toner 21 | — |
| Comparative Example 5 | Cyan Toner 1 | Carrier 13 | 62 | 12 | Cyan Toner 1 | — |
| Comparative Example 6 | Cyan Toner 22 | Carrier 13 | 55 | 12 | Cyan Toner 22 | — |
| Comparative Example 7 | Cyan Toner 18 | Carrier 13 | 47 | 10 | Cyan Toner 18 | — |
| Comparative Example 8 | Cyan Toner 19 | Carrier 13 | 125 | 18 | Cyan Toner 19 | — |
| Comparative Example 9 | Cyan Toner 20 | Carrier 13 | 49 | 10 | Cyan Toner 20 | — |
| Comparative Example 10 | Cyan Toner 23 | Carrier 13 | 65 | 14 | Cyan Toner 23 | — |
| Comparative Example 11 | Cyan Toner 24 | Carrier 13 | 65 | 14 | Cyan Toner 24 | — |
| Comparative Example 12 | Cyan Toner 25 | Carrier 13 | 60 | 12 | Cyan Toner 25 | — |

*1 An adhesive force (F50) by a centrifugal method when the absolute value for the triboelectric charge quantity of toner is 50 mC/kg

*2 The absolute value for the triboelectric charge quantity of toner measured by a two-component method using the toner and a magnetic carrier

TABLE 7

| | Laid-on level [mg/cm$^2$] | ΔE | Image void | Transferring performance | Lowest fixation temperature ° C. | Fogging | Carrier adhesion | Dot reproducibility | Cleaning performance |
|---|---|---|---|---|---|---|---|---|---|
| Example 1 | 0.49 | A | C | A | 155 | A | A | A | A |
| Example 2 | 0.41 | A | B | A | 150 | A | A | A | A |
| Example 3 | 0.30 | B | A | A | 140 | A | A | A | A |
| Example 4 | 0.25 | A | A | A | 140 | A | A | A | A |
| Example 5 | 0.21 | B | A | A | 135 | B | A | B | A |
| Example 6 | 0.25 | C | A | A | 135 | C | A | B | A |
| Comparative Example 1 | 0.58 | B | D | C | 155 | A | A | C | A |
| Comparative Example 2 | 0.25 | D | A | A | 135 | D | A | D | A |
| Example 7 | 0.44 | A | C | A | 160 | A | A | A | A |
| Example 8 | 0.35 | A | B | A | 155 | A | A | A | A |
| Example 9 | 0.26 | B | A | A | 140 | B | A | A | A |
| Example 10 | 0.20 | A | A | A | 140 | B | A | A | A |
| Example 11 | 0.18 | B | A | A | 135 | C | A | B | A |
| Comparative Example 3 | 0.51 | B | D | C | 160 | A | A | C | A |
| Comparative Example 4 | 0.18 | C | A | A | 135 | D | A | C | A |
| Example 12 | 0.45 | B | C | A | 160 | A | A | A | A |
| Example 13 | 0.37 | A | B | A | 155 | A | A | A | A |
| Example 14 | 0.28 | A | A | A | 140 | A | A | B | A |
| Example 15 | 0.28 | A | A | C | 140 | C | A | B | A |
| Example 16 | 0.28 | A | A | B | 140 | A | A | A | A |
| Example 17 | 0.28 | B | A | A | 140 | C | A | B | A |
| Example 18 | 0.28 | B | A | B | 140 | B | A | B | A |
| Example 19 | 0.28 | B | A | C | 140 | C | A | B | A |

TABLE 7-continued

| | Laid-on level [mg/cm$^2$] | ΔE | Image void | Transferring performance | Lowest fixation temperature ° C. | Fogging | Carrier adhesion | Dot reproducibility | Cleaning performance |
|---|---|---|---|---|---|---|---|---|---|
| Example 20 | 0.23 | C | A | B | 140 | B | A | C | A |
| Example 21 | 0.23 | B | A | B | 140 | B | C | C | A |
| Example 22 | 0.23 | C | A | B | 140 | C | A | C | A |
| Example 23 | 0.23 | B | A | B | 140 | B | C | C | A |
| Example 24 | 0.23 | C | A | B | 140 | B | A | C | A |
| Example 25 | 0.23 | C | A | B | 140 | B | A | C | A |
| Example 26 | 0.22 | C | A | B | 140 | B | A | C | A |
| Example 27 | 0.22 | C | A | B | 140 | B | C | C | A |
| Example 28 | 0.22 | B | A | B | 140 | C | B | C | A |
| Example 29 | 0.22 | B | A | B | 140 | B | A | C | A |
| Example 30 | 0.22 | B | A | B | 140 | B | A | C | A |
| Example 31 | 0.22 | C | A | B | 140 | C | A | C | A |
| Example 32 | 0.20 | C | A | B | 140 | C | A | C | A |
| Example 33 | 0.20 | C | A | B | 140 | C | A | C | B |
| Example 34 | 0.20 | C | A | B | 140 | C | A | C | C |
| Example 35 | 0.20 | C | A | C | 140 | C | A | C | B |
| Example 36 | 0.20 | C | A | C | 140 | C | A | C | A |
| Example 37 | 0.20 | C | A | C | 140 | C | A | C | A |
| Example 38 | 0.24 | C | A | B | 135 | C | A | C | A |
| Comparative Example 5 | 0.55 | B | D | C | 165 | C | A | C | A |
| Comparative Example 6 | 0.25 | D | A | B | 135 | C | A | C | A |
| Comparative Example 7 | 0.20 | D | A | B | 140 | C | A | C | C |
| Comparative Example 8 | — | — | — | — | — | — | — | — | — |
| Comparative Example 9 | 0.20 | D | A | B | 135 | C | A | C | A |
| Comparative Example 10 | 0.60 | C | D | D | 170 | C | A | D | A |
| Comparative Example 11 | 0.68 | B | D | D | 180 | C | A | D | A |
| Comparative Example 12 | — | — | — | — | — | — | — | — | — |

In Comparative Example 8, a charge quantity was so large that a toner amount needed for achieving a required density could not be used for development. In Comparative Example 12, coloring power was so low that there was a need for using a large amount of toner for development, but a needed toner amount could not be used for development, and no subsequent evaluation could be performed.

Example 39

The magenta two-component developer having the constitution of Example 1, the yellow two-component developer having the constitution of Example 7, and the cyan two-component developer having the constitution of Example 12 were each loaded into the above-mentioned reconstructed device of a full-color copying machine CLC5000 manufactured by Canon Inc. Then, a full-color image was formed under such a toner laid-on level condition that the monochromatic solid image density of each color was 1.5. As a result, a good full-color image was obtained. It should be noted that, in this example, the full-color image was formed without the use of any black developer; a good full-color image can be similarly obtained even when a black developer is used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-024381, filed Feb. 2, 2007, which is hereby incorporated by reference herein in its entirety.

What is claimed is:

1. A two-component developer, comprising:

a yellow toner having yellow toner particles each having at least a binder resin and a colorant, and an external additive; and a magnetic carrier, (a) wherein the yellow toner has the following characteristics:

(i) when a concentration of the yellow toner in a solution of the yellow toner in chloroform is represented by Cy (mg/ml) and an absorbance of the solution at a wavelength of 422 nm is represented by A422, a relationship between Cy and A422 satisfies the following expression (5)

$$6.00<A422/Cy<14.40 \quad (5);$$

(ii) a lightness L* and a chroma C* of the yellow toner determined in a powder state satisfy relationships of $85.0 \leqq L^* \leqq 95.0$ and $100.0 \leqq C^* \leqq 115.0$; and (iii) an absolute value for a triboelectric charge quantity of the yellow toner measured by a two-component method using the yellow toner and the magnetic carrier is 50 mC/kg or more and 120 mC/kg or less, and (b) wherein the magnetic carrier comprises at least magnetic core particles and a resin component;

a packed bulk density ρ1 (g/cm$^3$) and a true density ρ2 (g/cm$^3$) of the magnetic core particles of the magnetic carrier satisfy relationships of $0.80 \leqq \rho1 \leqq 2.40$ and $0.20 \leqq \rho1/\rho2 \leqq 0.42$;

a specific resistance of each of the magnetic core particles of the magnetic carrier is $1.0\times10^3$ Ω·cm or more and $5.0\times10^7$ Ω·cm or less; and when a 50% particle diameter on a volume basis of the magnetic carrier is represented by D50, an average breaking strength P1 (MPa) of the magnetic carrier having a particle diameter of D50−5 μm or more and D50+5 μm or less and an average breaking strength P2 (MPa) of the magnetic carrier having a particle diameter of 10 μm or more and less than 20 μm satisfy a relationship of $0.50 \leqq P2/P1 \leqq 1.10$.

2. A two-component developer according to claim 1, wherein:

the relationship between Cy and A422 of the yellow toner satisfies the following expression (6)

$$7.0<A422/Cy<12.00 \quad (6); \text{ and}$$

the lightness L* and chroma C* of the yellow toner determined in a powder state satisfy relationships of $87.0 \leqq L^* \leqq 95.0$ and $100.0 \leqq C^* \leqq 115.0$.

3. A two-component developer according to claim 1, wherein an adhesive force (F50) between the yellow toner and the magnetic carrier by a centrifugal separation method when the absolute value for the triboelectric charge quantity of the yellow toner measured by the two-component method using the yellow toner and the magnetic carrier is 50 mC/kg is 11 nN or more and 16 nN or less.

4. A two-component developer according to claim 1, wherein the yellow toner having a circle-equivalent diameter on a number basis measured with a flow-type particle image measuring apparatus having an image processing resolution of 512×512 pixels each measuring 0.37 μm by 0.37 μm of 2.0 μm or more and 200.00 μm or less has an average circularity of 0.945 or more and 0.970 or less.

5. A two-component developer according to claim 1, wherein the external additive contains inorganic fine particles, and the inorganic fine particles have a number average particle diameter of 80 nm or more and 300 nm or less.

6. A two-component developer according to claim 5, wherein the inorganic fine particles each comprise spherical silica produced by a sol-gel method.

7. A replenishing developer for use in a two-component developing method including: performing development while replenishing a developing device with the replenishing developer; and discharging an excess magnetic carrier in the developing device from the developing device, comprising:

a yellow toner having yellow toner particles each having at least a binder resin and a colorant, and an external additive; and a magnetic carrier, the replenishing developer being a two-component developer containing the yellow toner at a mass ratio of 2 parts by mass or more and 50 parts by mass or less with respect to 1 part by mass of the magnetic carrier, (a) wherein the yellow toner has the following characteristics:

(i) when a concentration of the yellow toner in a solution of the yellow toner in chloroform is represented by Cy (mg/ml) and an absorbance of the solution at a wavelength of 422 nm is represented by A422, a relationship between Cy and A422 satisfies the following expression (5)

$$6.00<A422/Cy<14.40 \quad (5);$$

(ii) a lightness L* and a chroma C* of the yellow toner determined in a powder state satisfy relationships of $85.0 \leqq L^* \leqq 95.0$ and $100.0 \leqq C^* \leqq 115.0$; and (iii) an absolute value for a triboelectric charge quantity of the yellow toner measured by a two-component method using the yellow toner and the magnetic carrier is 50 mC/kg or more and 120 mC/kg or less, and (b) wherein the magnetic carrier comprises at least magnetic core particles and a resin component;

a packed bulk density ρ1 (g/cm$^3$) and a true density ρ2 (g/cm$^3$) of the magnetic core particles of the magnetic carrier satisfy relationships of $0.80 \leqq \rho1 \leqq 2.40$ and $0.20 \leqq \rho1/\rho2 \leqq 0.42$;

a specific resistance of each of the magnetic core particles of the magnetic carrier is $1.0\times10^3$ Ω·cm or more and $5.0\times10^7$ Ω·cm or less; and when a 50% particle diameter on a volume basis of the magnetic carrier is represented by D50, an average breaking strength P1 (MPa) of the magnetic carrier having a particle diameter of D50−5 μm or more and D50+5 μm or less and an average breaking strength P2 (MPa) of the magnetic carrier having a particle diameter of 10 μm or more and less than 20 μm satisfy a relationship of $0.50 \leqq P2/P1 \leqq 1.10$.

8. An image-forming method, comprising:

a charging step of charging an electrostatic latent image bearing member;

a latent image forming step of forming an electrostatic latent image on the electrostatic latent image bearing member charged in the charging step;

a developing step of developing the electrostatic latent image formed on the image bearing member with a two-component developer containing a yellow toner having yellow toner particles each having at least a binder resin and a colorant, and an external additive, and a magnetic carrier to form a yellow toner image;

a transferring step of transferring the cyan toner image on the electrostatic latent image bearing member onto a transfer material through or without through an intermediate transfer body; and a fixing step of fixing the yellow toner image to the transfer material, wherein:

a laid-on level of the yellow toner of a monochromatic solid image portion having an image density of 1.5 in the yellow toner image unfixed to be formed on the transfer material is in a range of 0.10 mg/cm$^2$ or more to 0.50 mg/cm$^2$ or less; and (a) the yellow toner has the following characteristics:

(i) when a concentration of the yellow toner in a solution of the yellow toner in chloroform is represented by Cy (mg/ml) and an absorbance of the solution at a wavelength of 422 nm is represented by A422, a relationship between Cy and A422 satisfies the following expression (5)

$$6.00 < A422/Cy < 14.40 \quad (5);$$

(ii) a lightness L* and a chroma C* of the yellow toner determined in a powder state satisfy relationships of 85.0≦L*≦95.0 and 100.0≦C*≦115.0; and (iii) an absolute value for a triboelectric charge quantity of the yellow toner measured by a two-component method using the yellow toner and the magnetic carrier is 50 mC/kg or more and 120 mC/kg or less, and (b) wherein the magnetic carrier comprises at least magnetic core particles and a resin component;

a packed bulk density ρ1 (g/cm$^3$) and a true density ρ2 (g/cm$^3$) of the magnetic core particles of the magnetic carrier satisfy relationships of 0.80≦ρ1≦2.40 and 0.20≦ρ1/ρ2≦0.42;

a specific resistance of each of the magnetic core particles of the magnetic carrier is 1.0×10$^3$ Ω·cm or more and 5.0×10$^7$ Ω·cm or less; and when a 50% particle diameter on a volume basis of the magnetic carrier is represented by D50, an average breaking strength P1 (MPa) of the magnetic carrier having a particle diameter of D50−5 μm or more and D50+5 μm or less and an average breaking strength P2 (MPa) of the magnetic carrier having a particle diameter of 10 μm or more and less than 20 μm satisfy a relationship of 0.50≦P2/P1≦1.10.

9. An image-forming method according to claim 8, wherein the laid-on level of the yellow toner of the monochromatic solid image portion having an image density of 1.5 in the yellow toner image unfixed to be formed on the transfer material is in a range of 0.10 mg/cm$^2$ or more to 0.35 mg/cm$^2$ or less.

10. An image-forming method according to claim 8, wherein:

the relationship between Cy and A422 of the yellow toner satisfies the following expression (6)

$$7.0 < A422/Cy < 12.00 \quad (6); \text{ and}$$

the lightness L* and chroma C* of the yellow toner determined in a powder state satisfy relationships of 87.0≦L*≦95.0 and 100.0≦C*≦115.0.

* * * * *